US011414904B2

(12) United States Patent
Klein et al.

(10) Patent No.: US 11,414,904 B2
(45) Date of Patent: Aug. 16, 2022

(54) DOUBLE PULL CLOSURE LATCH FOR FRONT TRUNK HAVING EMERGENCY RELEASE

(71) Applicant: Magna BOCO GmbH, Wuppertal (DE)

(72) Inventors: Jörg Thomas Klein, Leverkusen (DE); Vladmir Lebsak, Wuppertal (DE); Henrik Johann, Wermelskirchen (DE)

(73) Assignee: Magna BOCO GmbH, Wuppertal (DE)

( * ) Notice: Subject to any disclaimer, the term of this patent is extended or adjusted under 35 U.S.C. 154(b) by 523 days.

(21) Appl. No.: 16/403,141

(22) Filed: May 3, 2019

(65) Prior Publication Data

US 2019/0338568 A1 Nov. 7, 2019

Related U.S. Application Data

(60) Provisional application No. 62/830,848, filed on Apr. 8, 2019, provisional application No. 62/790,092, filed
(Continued)

(51) Int. Cl.
*E05B 83/24* (2014.01)
*E05B 85/24* (2014.01)
(Continued)

(52) U.S. Cl.
CPC ..... *E05B 83/24* (2013.01); *E05B 81/16* (2013.01); *E05B 81/56* (2013.01); *E05B 83/26* (2013.01); *E05B 85/245* (2013.01)

(58) Field of Classification Search
CPC ..... E05B 83/16; E05B 83/18; E05B 83/24; E05B 83/26; E05B 81/02; E05B 81/04; E05B 81/05; E05B 81/06; E05B 81/08; E05B 81/16; E05B 81/56; E05B 85/20; E05B 85/24; E05B 85/243; E05B 85/26;
(Continued)

(56) References Cited

U.S. PATENT DOCUMENTS 5,445,326 A 8/1995 Ferro et al.
6,018,292 A 1/2000 Penny, Jr.
(Continued)

FOREIGN PATENT DOCUMENTS

CA 2324720 A1 4/2002
CN 101006239 A 7/2007
(Continued)

*Primary Examiner* — Alyson M Merlino
(74) *Attorney, Agent, or Firm* — Dickinson Wright PLLC

(57) ABSTRACT

A latch assembly having an emergency auxiliary release member located in a stowage compartment of a motor vehicle, such as a front trunk, is provided. The latch assembly has a coupling lever that is actuatable to move to a disengaged position if a predetermined condition is met, such as and engine on/off condition or a vehicle speed condition, for example, whereupon the latch assembly is prevented from being fully release, but only allows the latch assembly to move to a partially released state. Upon the predetermined condition be absent, the coupling lever is returned to a position such that the latch assembly can then be fully released from either a passenger compartment of the vehicle or the trunk.

20 Claims, 36 Drawing Sheets

Related U.S. Application Data on Jan. 9, 2019, provisional application No. 62/667,363, filed on May 4, 2018.

(51) Int. Cl.
*E05B 81/16* (2014.01)
*E05B 81/56* (2014.01)
*E05B 83/26* (2014.01)

(58) Field of Classification Search
CPC ..... Y10T 292/1047; Y10T 292/1082; Y10S 292/14; Y10S 292/23; Y10S 292/42; Y10S 292/43; Y10S 292/65
See application file for complete search history.

(56) References Cited

U.S. PATENT DOCUMENTS

| | | | | |
|---|---|---|---|---|
| 6,149,210 | A | 11/2000 | Hunt et al. | |
| 6,209,933 | B1 * | 4/2001 | Ang | E05B 17/10 292/336.3 |
| 6,543,822 | B1 | 4/2003 | King et al. | |
| 9,027,971 | B2 | 5/2015 | Barczynski et al. | |
| 9,145,716 | B2 | 9/2015 | Jayasuriya et al. | |
| 9,163,435 | B2 | 10/2015 | Zysk et al. | |
| 2006/0125246 | A1 | 6/2006 | Lau et al. | |
| 2006/0170224 | A1 | 8/2006 | Mitchell et al. | |
| 2007/0216170 | A1 | 9/2007 | Drescher et al. | |
| 2012/0161456 | A1 | 6/2012 | Riedmayr et al. | |
| 2014/0088826 | A1 | 3/2014 | Wheeler et al. | |
| 2015/0345186 | A1 * | 12/2015 | Park | E05B 83/24 292/194 |
| 2016/0076279 | A1 | 3/2016 | Ilea et al. | |
| 2016/0168883 | A1 * | 6/2016 | Konchan | E05B 83/24 292/197 |
| 2018/0030763 | A1 * | 2/2018 | Distefano | E05B 83/24 |
| 2019/0048625 | A1 | 2/2019 | Ferri et al. | |
| 2020/0217110 | A1 | 7/2020 | Cumbo | |

FOREIGN PATENT DOCUMENTS

| | | | | |
|---|---|---|---|---|
| CN | 106150233 | A | 11/2016 | |
| CN | 107654134 | A | 2/2018 | |
| DE | 10231825 | A1 | 4/2004 | |
| DE | 102005021740 | A1 | 11/2006 | |
| DE | 102005960750 | A1 | 6/2007 | |
| DE | 102007008700 | A1 | 8/2008 | |
| DE | 102009034904 | A1 | 2/2011 | |
| DE | 102009037037 | A1 * | 2/2011 | E05B 83/16 |
| DE | 102010062700 | A1 | 6/2012 | |
| DE | 102011003808 | A1 | 8/2012 | |
| DE | 102012004792 | A1 | 9/2013 | |
| KR | 20160021401 | A * | 2/2016 | |
| KR | 101825391 | B1 * | 2/2018 | |

* cited by examiner

DOUBLE PULL CLOSURE LATCH FOR FRONT TRUNK HAVING EMERGENCY RELEASE

CROSS-REFERENCE TO RELATED APPLICATIONS

This application claims the benefit of U.S. Provisional Application Ser. No. 62/830,848, filed Apr. 8, 2019, and U.S. Provisional Application Ser. No. 62/790,092, filed Jan. 9, 2019, and U.S. Provisional Application Ser. No. 62/667,363, filed May 4, 2018, which are each incorporated herein by reference in their entirety.

FIELD

The present disclosure relates to latch assemblies for motor vehicles, and more particularly, to trunk latch assemblies for motor vehicles.

BACKGROUND

Latches for vehicle front hoods, whether for front engine hoods or front trunk hoods also known as frunks, are typically actuated in two stages. During a first stage a first release device, such as a handle, is actuated from inside the passenger compartment of the vehicle which moves the latch from a primary closed position to secondary closed position, wherein the latch is partially released, but still retains a striker of the hood to keep the hood from being fully opened. To release the latch completely the vehicle occupant typically must exit the vehicle and actuate a second release device, such as a lever, that is under the hood. This may be inconvenient in some situations.

Double-pull release latches for vehicle hoods are also known, which allows a user to pull twice on the hood release handle located inside the passenger compartment of the vehicle to cause the latch to both transition from the primary closed position to the secondary closed position upon the first pull, and then to fully release the latch from the secondary closed position to a fully open position upon the second pull. One drawback of such a double-pull release latch for a vehicle hood is that the user may unintentionally release the hood, which can be particularly problematic if the hood is a front hood that is caused to open while the vehicle is moving. Further yet, if the hood is for a front trunk compartment, the double pull latch is typically only actuatable from inside the passenger compartment, and thus, if a person were to become locked and entrapped inside the front trunk compartment, the entrapped person would be unable to open the front hood.

Desired is a latch which can be unlatched in a multiple stage release actuations from inside of the passenger compartment of the vehicle when intended, such as while the vehicle is not moving, and wherein the latch is prevented from being fully released to an open position while the vehicle is traveling in excess of a predetermined speed and/or while the engine is running and/or other vehicle state. Further, it is desired to integrate an auxiliary mechanism into the multiple stage release hood latch that allows a person to release the latch from within a stowage compartment, including the front trunk compartment. It is further desired to configure the auxiliary latch mechanism to allow the latch to be fully released while the vehicle is not moving or traveling below a predetermined speed and/or while the engine is not on and/or other vehicle state, and to allow the latch to move from the primary closed position to the secondary closed position when the vehicle is moving in excess of the predetermined speed and/or while the engine is on and/or other vehicle state, but not to the fully open position.

SUMMARY

This section provides a general summary of the present disclosure and is not a comprehensive disclosure of its full scope or all of its features, aspects and objectives.

In accordance with another aspect of the disclosure, a latch assembly for a stowage compartment of a motor vehicle is provided, wherein the latch assembly can be opened from within stowage compartment.

In accordance with another aspect of the disclosure, a latch assembly for a front trunk hood, or frunk, is provided, wherein the latch assembly can be opened from within a compartment of the front trunk.

In accordance with another aspect of the disclosure, the latch assembly can be actuated to partially open the front trunk hood, but prevent the front trunk hood from moving to a fully opened position if a predetermined condition is met, such as and engine on/off condition or a vehicle speed condition, for example.

In accordance with another aspect of the disclosure, the latch assembly can be opened from within a passenger compartment of the motor vehicle, and preferably perform as a multiple pull latch assembly, and more preferably a double pull latch assembly, whereupon a first pull acts to move the latch to a secondary, partially open position, and whereupon a second pull acts to move the latch to a fully open position.

In accordance with another aspect of the disclosure, the latch assembly can be opened from within a trunk, and for example a frunk, compartment of the motor vehicle, and preferably perform as a multiple pull latch assembly, and more preferably a double pull latch assembly, whereupon a first pull of an emergency entrapment release lever, or auxiliary release member, located within the trunk, or frunk, acts to move the latch from a primary closed position directly to a fully open position.

In accordance with another aspect of the disclosure, the latch assembly may be configured to operate in a normal mode to allow the latch assembly to be opened from the trunk, and for example a frunk, compartment of the motor vehicle of the motor vehicle if a predetermined condition of the vehicle is not met, and may be configured to operate in a safety mode to allow the latch assembly to be opened to a secondary closed position from within the trunk, and for example a frunk, compartment of the motor vehicle of the motor vehicle, but not to a fully opened condition if a predetermined condition of the vehicle is met.

In accordance with another aspect of the disclosure, a latch assembly for a hood of a trunk of vehicle is provided to include a housing; a ratchet mounted to the housing for pivoting movement between a primary closed position, a secondary closed position and an open position, wherein the ratchet is biased toward the open position; a primary pawl configured for operable communication with a release member and being mounted to the housing for pivoting movement between a primary locking position and a primary unlocking position in response to selective movement of the release member, the primary pawl being biased toward the primary locking position; a secondary pawl mounted to the housing for pivoting movement between a secondary locking position and a secondary unlocking position, the secondary pawl being biased toward the secondary locking position; a coupling lever pivotably mounted to the secondary pawl for movement between an engaged position, a disengaged position, and a home position between the engaged and disengaged positions, the coupling lever being biased toward the engaged position; and an auxiliary release lever configured for attachment to an auxiliary release member within the trunk and being mounted to the housing for pivoting movement between a released position and an actuated position in response to selective actuation of the auxiliary release member, the auxiliary release lever being biased toward the released position. With the coupling lever in the home position and the ratchet in the primary closed position, movement of the auxiliary release lever from the released position toward the actuated position in response to selective actuation of the auxiliary release member causes the auxiliary release lever to pivot the primary pawl from the primary locking position to the primary unlocking position, which causes the ratchet to move from the primary closed position to the secondary closed position and the coupling lever to move from the home position to the engaged position, whereupon the auxiliary release lever engages and moves the coupling lever causing the secondary pawl to pivot from the secondary locking position to the secondary unlocking position, whereupon the ratchet moves from the secondary closed position to the open position.

In accordance with another aspect of the disclosure, the latch assembly includes an actuator operably coupled to the coupling lever. The actuator being configured for communication with a vehicle sensor to selectively move the coupling lever between the home position and the disengaged position in response to a predetermined state, also referred to as condition, of the vehicle. With the coupling lever moved to the disengaged position in response to actuation of the actuator and with the ratchet in the primary closed position, movement of the auxiliary release lever from the released position toward the actuated position in response to selective actuation of the auxiliary release member causes the auxiliary release lever to pivot the primary pawl from the primary locking position to the primary unlocking position, which causes the ratchet to move from the primary closed position to the secondary closed position. The auxiliary release lever is in spaced relation from the coupling lever while in its disengaged position, thereby preventing movement of the coupling lever, and thus, the secondary pawl is caused to remain in the secondary locking position and the ratchet is caused to remain in the secondary closed position until the predetermined condition no longer exists.

In accordance with another aspect of the disclosure, the actuator is configured to selectively move the coupling lever between the home position and the disengaged position in response to a predetermined condition including a speed of the vehicle.

In accordance with another aspect of the disclosure, the coupling lever remains in or is returned to the home position when the speed of the motor vehicle is below a predetermined threshold and is moved to the disengaged position when the speed of the motor vehicle is above the predetermined threshold.

In accordance with another aspect of the disclosure, the actuator is configured to selectively move the coupling lever between the home position and the disengaged position in response the predetermined condition including whether an engine of the vehicle is on or off, wherein the coupling lever remains in or is returned to the home position when the engine is off and is moved to the disengaged position when the engine in on.

In accordance with another aspect of the disclosure, with the coupling lever in the home position and the ratchet in the primary closed position, movement of the primary pawl from the primary locking position to the primary unlocking position in response to a first actuation of the release member causes the ratchet to move from the primary closed position to the secondary closed position, whereupon the coupling lever is automatically biased from the home position to the engaged position. Then, upon biased return of the primary pawl toward the primary locking position and repeated movement, such as a second subsequent movement for example and without limitation, of the primary pawl to the primary unlocking position in response to a second actuation of the release member, the primary pawl engages and moves the coupling lever thereby causing the secondary pawl to pivot from the secondary locking position to the secondary unlocking position, whereupon the ratchet moves from the secondary closed position to the open position.

In accordance with another aspect of the disclosure, a common biasing member simultaneously biases the secondary pawl toward the secondary locking position and the coupling lever toward the engaged position.

In accordance with another aspect of the disclosure, the coupling lever is held against a bias in the home position via abutment with the ratchet when the ratchet is in the primary closed position.

In accordance with another aspect of the disclosure, the ratchet moves out of abutment with the coupling lever when the ratchet moves from the primary closed position to the secondary closed position, whereupon the coupling lever is biased toward the engaged position into abutment with the primary pawl.

In accordance with another aspect of the disclosure, the selective movement of the release member in communication with the primary pawl is caused via one of purely mechanical actuation and/or electrical actuation.

In accordance with another aspect of the disclosure, a latch assembly for a hood of a trunk of vehicle is provided, including a housing; a ratchet mounted to the housing for pivoting movement between a primary closed position, a secondary closed position and an open position, wherein the ratchet is biased toward the open position; a primary pawl configured for operable communication with a release member and being mounted to the housing for pivoting movement between a primary locking position and a primary unlocking position in response to selective movement of the release member, the primary pawl being biased toward the primary locking position; a secondary pawl mounted to the housing for pivoting movement between a secondary locking position and a secondary unlocking position, the secondary pawl being biased toward the secondary locking position; a coupling lever pivotably mounted to the secondary pawl for movement between an engaged position and a disengaged position, the coupling lever being biased toward the engaged position; and an auxiliary release member within the trunk configured in operable communication with the primary pawl to pivot the primary pawl between the primary locking position and the primary unlocking position in response to selective actuation of the auxiliary release member, wherein with the coupling lever in the disengaged position and the ratchet in the primary closed position, actuation of the auxiliary release member causes the primary pawl to pivot from the primary locking position to the primary unlocking position and the secondary pawl to move into the secondary locking position to hold the ratchet in the secondary closed position, and wherein the secondary pawl is prevented from pivoting from the secondary locking position to the secondary unlocking position.

In accordance with another aspect of the disclosure, with the coupling lever in the engaged position and the ratchet in the primary closed position, actuation of the auxiliary release member can cause the primary pawl to pivot from the primary locking position to the primary unlocking position and the secondary pawl to move into the secondary unlocking position, wherein the ratchet pivots from the primary closed position to the open position.

In accordance with another aspect of the disclosure, an actuator can be operably coupled to the coupling lever, with the actuator being configured for communication with a vehicle sensor to selectively move the coupling lever between the engaged position and the disengaged position in response to a predetermined state of the vehicle, with the coupling lever remaining in the disengaged position until the predetermined condition is absent.

In accordance with another aspect of the disclosure, the coupling lever can be biased into the engaged position when the ratchet is in the primary closed position and when the predetermined condition is absent, thereby facilitating a single pull actuation of the latch assembly to move the ratchet from the primary closed position to the fully open position.

In accordance with another aspect of the disclosure, movement of the primary pawl from the primary locking position to the primary unlocking position in response to a first actuation of the release member can cause the ratchet to move from the primary closed position to the secondary closed position, whereupon the coupling lever is automatically biased from the disengaged position to the engaged position, and wherein upon biased return of the primary pawl toward the primary locking position and repeated movement of the primary pawl to the primary unlocking position in response to a second actuation of the release member, the primary pawl engages and moves the coupling lever thereby causing the secondary pawl to pivot from the secondary locking position to the secondary unlocking position, whereupon the ratchet moves from the secondary closed position to the open position.

In accordance with another aspect of the disclosure, the coupling lever can be provided having a home position between the engaged position and the disengaged position, wherein movement of the primary pawl from the primary locking position to the primary unlocking position in response to a first actuation of the release member causes the ratchet to move from the primary closed position to the secondary closed position, whereupon the coupling lever is automatically biased from the home position to the engaged position, and wherein upon biased return of the primary pawl toward the primary locking position and repeated movement of the primary pawl to the primary unlocking position in response to a second actuation of the release member, the primary pawl engages and moves the coupling lever thereby causing the secondary pawl to pivot from the secondary locking position to the secondary unlocking position, whereupon the ratchet moves from the secondary closed position to the open position.

In accordance with another aspect of the disclosure, the coupling lever can be held in the home position against a biasing member via abutment with the ratchet when the ratchet is in the primary closed position.

In accordance with another aspect of the disclosure, the ratchet can be configured to move out of abutment with the coupling lever when the ratchet moves from the primary closed position to the secondary closed position, whereupon the coupling lever can be biased into the engaged position into abutment with the primary pawl to facilitate a double pull actuation release of the latch assembly.

In accordance with another aspect of the disclosure, an auxiliary release lever can be configured for attachment to the auxiliary release member within the trunk and mounted to the latch for pivoting movement between a released position and an actuated position in response to selective actuation of the auxiliary release member, with the auxiliary release lever being configured for operable engagement with the primary pawl to effect movement of the primary pawl between the primary locking position and the primary unlocking position.

In accordance with another aspect of the disclosure, a method of releasing a latch assembly for a hood of a trunk of a vehicle is provided. The latch assembly including a ratchet movable between a primary closed position, a secondary closed position and an open position, and a primary pawl moveable between a primary locking position to hold the ratchet in the primary closed position and a primary unlocking position to release the ratchet from the primary closed position, and a secondary pawl moveable between a secondary locking position to hold the ratchet in the secondary closed position and a secondary unlocking position to release the ratchet from the secondary closed position. The method comprising the steps of: moving the primary pawl from the primary locking position to the primary unlocking position to allow the ratchet to move from the primary closed position; and maintaining the secondary pawl in the secondary unlocking position in response to a predetermined condition of the vehicle.

In accordance with another aspect of the disclosure, the method can further include allowing the secondary pawl to move from the secondary locking position to the secondary unlocking position in response to the predetermined condition being absent.

In accordance with another aspect of the disclosure, the method can further include configuring the predetermined condition to be at least one of a speed of the vehicle, whether an engine of the vehicle is on or off, and whether a shift mechanism of the vehicle is in a park or a non-park position.

In accordance with another aspect of the disclosure, the method can further include maintaining the secondary pawl in the secondary unlocking position in response to the vehicle being above a predetermined speed threshold to prevent the ratchet from moving to the open position.

In accordance with another aspect of the disclosure, the method can further include interconnecting the primary pawl and the secondary pawl with a coupling lever and configuring the coupling lever being moveable between an engaged position and a disengaged position and being biased toward the engaged position, wherein with said coupling lever in the disengaged position the secondary pawl is maintained in the secondary unlocking position.

In accordance with another aspect of the disclosure, the method can further include configuring the coupling lever such that while in the engaged position and with the ratchet in the primary closed position, moving the primary pawl from the primary locking position to the primary unlocking position causes the secondary pawl to move from the secondary locking position to the secondary unlocking position.

In accordance with another aspect of the disclosure, the method can further include causing the primary pawl to move from the primary locking position to the primary unlocking position and the secondary pawl to move from the secondary locking position to the secondary unlocking position in a single actuation.

In accordance with another aspect of the disclosure, the method can further include operably coupling an actuator to the coupling lever and controlling the actuator to move the coupling lever between the engaged position and the disengaged position in response to the predetermined condition.

In accordance with another aspect of the disclosure, the method can further include operably coupling an auxiliary release member within the trunk with the primary pawl to pivot the primary pawl between the primary locking position and the primary unlocking position in response to selective actuation of the auxiliary release member.

In accordance with another aspect, there is also provided a method of releasing a latch assembly for a hood of a trunk of a vehicle, such as a frunk for example, the latch assembly including a ratchet movable between a primary closed position, a secondary closed position and an open position, a pawl assembly moveable between a primary locking state to hold the ratchet in the primary closed position and a primary unlocking state to release the ratchet from the primary closed position, and a secondary locking state to hold the ratchet in the secondary closed position and a secondary unlocking state to release the ratchet from the secondary closed position, the method including the steps of shifting the pawl assembly from the primary locking state to the primary unlocking position in response to actuation of an auxiliary release member located within the trunk or frunk to allow the ratchet to move from the primary closed position to the secondary closed position, and maintaining the pawl assembly in the secondary unlocking position in response to detecting a predetermined condition of the vehicle.

In accordance with another aspect, there is provided a method of releasing a double pull latch assembly for a hood of a trunk of a vehicle, such as a frunk, the double pull latch assembly including a ratchet movable between a primary closed position, a secondary closed position and an open position, a pawl assembly having a primary pawl moveable between a primary locking position to hold the ratchet in the primary closed position and a primary unlocking position to release the ratchet from the primary closed position, and a secondary pawl moveable between a secondary locking position to hold the ratchet in the secondary closed position and a secondary unlocking position to release the ratchet from the secondary closed position, the method comprising the steps of monitoring for a predetermined condition of the vehicle; actuating an auxiliary release member located within the trunk or frunk to move the pawl assembly; and in response to actuating an auxiliary release member, allowing the primary pawl to move from the primary locking position to the primary unlocking position and allowing the secondary pawl to move from the secondary locking position to the secondary unlocking position in response to not detecting the predetermined condition to permit the ratchet to move from the primary closed position directly to the open position.

In accordance with another aspect of the method of releasing a double pull latch assembly for a hood of a trunk, the primary pawl and the secondary pawl are allowed to move simultaneously from the primary locking position to the primary unlocking position from the secondary locking position to the secondary unlocking position in response to actuating an auxiliary release member.

In accordance with another aspect, there is provided a latch system for a closure panel for a vehicle including a ratchet rotatable between a primary closed position, a secondary closed position and an open position, wherein the ratchet is biased towards the open position, a pawl assembly operable in a primary locking state, a secondary locking state and an unlocking state, the pawl mechanism configured in the primary locking state to hold the ratchet in the primary closed position and in the secondary locking state to hold the ratchet in a secondary closed position, and in the unlocking state to release the ratchet from at least one of the primary closed position and secondary closed position, the pawl assembly further operable in a normal mode wherein the pawl assembly is allowed to shift from the secondary locking state to the unlocking state and in a safety mode wherein the pawl assembly is prevented to shift from the secondary locking state to the unlocking state, and a release mechanism operable to actuate the pawl assembly, wherein actuation of the release mechanism when the pawl assembly is operating in the normal mode and in the primary locking state shifts the pawl assembly to one of the a secondary locking state and the unlocking state, wherein actuation of the release mechanism when the pawl assembly is operating in the safety mode and in the primary locking state shifts the pawl assembly to the secondary locking state, an actuator coupled to the pawl assembly and operable to shift the pawl assembly between the safety mode and the normal mode, and a controller configured to operate the actuator to shift the pawl assembly between the safety mode in response to detecting a predetermined condition of the vehicle, and configured to shift the pawl assembly to the normal mode in response to not detecting the predetermined condition of the vehicle.

In accordance with another aspect of the latch system, the release mechanism operable to actuate the pawl assembly is provided within the internal compartment of a trunk or a frunk.

In accordance with another aspect of the latch system, the release mechanism is one of a mechanism and electrical release mechanism.

In accordance with another aspect, there is provided a latch system for a closure panel for a vehicle including a double pull latch having a ratchet rotatable between a primary closed position, a secondary closed position and an open position, wherein the ratchet is biased towards the open position, a pawl assembly operable in a primary locking state, a secondary locking state and an unlocking state, the pawl assembly configured in the primary locking state to hold the ratchet in the primary closed position and in the secondary locking state to hold the ratchet in a secondary closed position, and in the unlocking state to release the ratchet from at least one of the primary closed position and secondary closed position, a double pull release mechanism operable to actuate the pawl assembly, wherein a first actuation of the double pull release mechanism shifts the pawl assembly to the secondary locking state from the primary locking state, and wherein a second actuation of the double pull release mechanism shifts the pawl assembly to the unlocking state from the secondary locking state, an actuator coupled to the double pull release mechanism and operable to actuate the double pull release mechanism, and a controller configured to operate the actuator, the controller further configured to operate the double pull latch in a normal mode in response to not detecting the predetermined condition of the vehicle wherein the actuator is operated to perform a first actuation and a second actuation of the double pull release mechanism to actuate the double pull release mechanism to shift the pawl assembly from the primary locking state to the unlocking state and in a safety mode in response to detecting the predetermined condition of the vehicle wherein the actuator is operated to perform the first actuation of the double pull release mechanism actuate the double pull release mechanism to shift the pawl assembly from the primary locking state to the secondary locking state and not operated to perform a subsequent actuation to maintain the pawl assembly in the secondary locking state.

In accordance with another aspect of the latch system for a closure panel for a vehicle, the double pull latch controller is configured to energize the actuator to actuate the double pull release mechanism and shift the state of the latch and to de-energize the actuator after the state of the latch has been shifted.

In accordance with another aspect of the latch system for a closure panel for a vehicle including a double pull latch, the controller is in communication with a signalling device provided within the trunk or frunk.

BRIEF DESCRIPTION OF THE DRAWINGS

Other advantages of the present disclosure will be readily appreciated, as the same becomes better understood by reference to the following detailed description when considered in connection with the accompanying drawings wherein.

DETAILED DESCRIPTION OF EXAMPLE EMBODIMENTS

Figure 1:
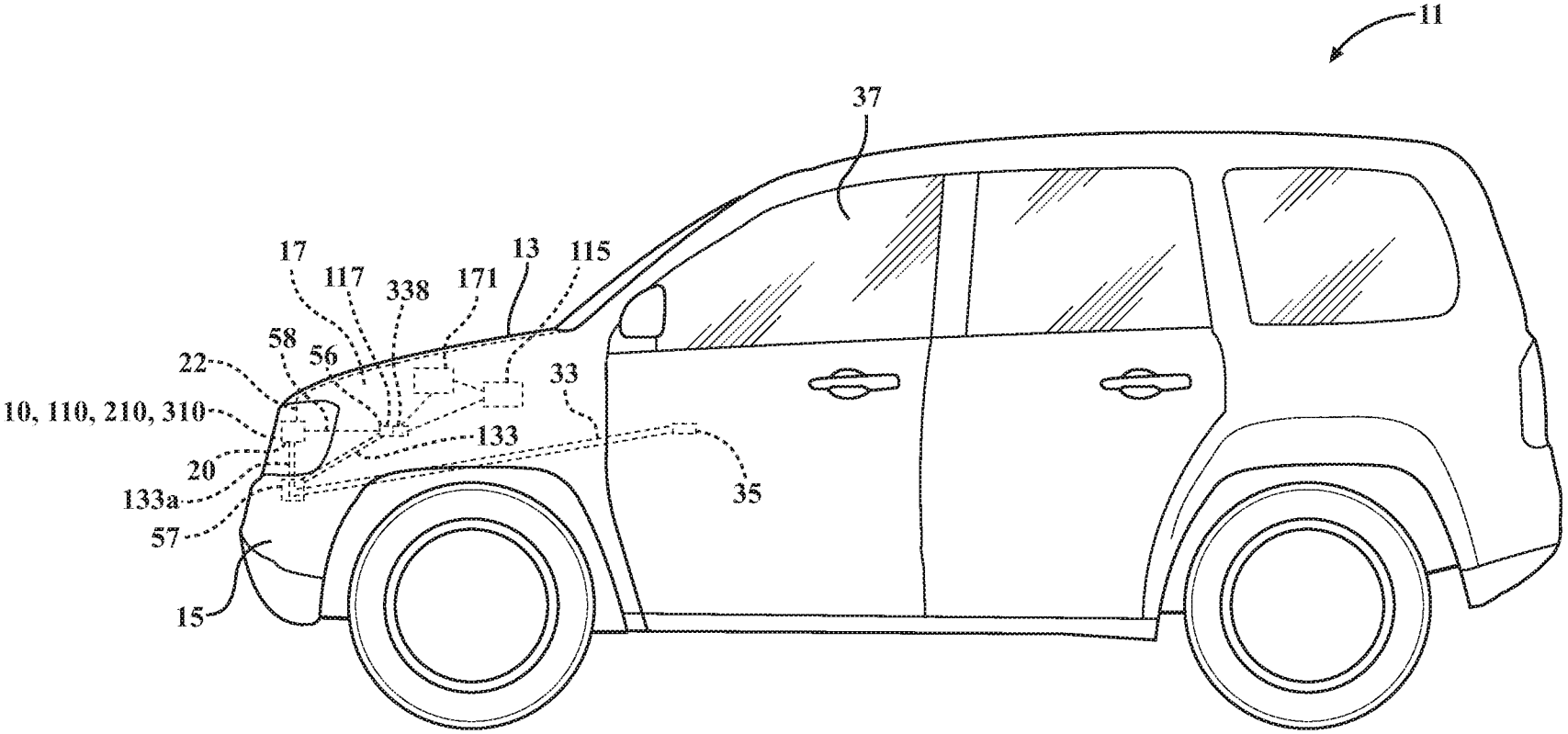
FIG. 1 is a side view of a vehicle including a double pull latch system in accordance with the disclosure.

In general, example embodiments of double pull latch assemblies constructed in accordance with the teachings of the present disclosure will now be disclosed. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail, as they will be readily understood by the skilled artisan in view of the disclosure herein.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom", and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

Figure 1A:
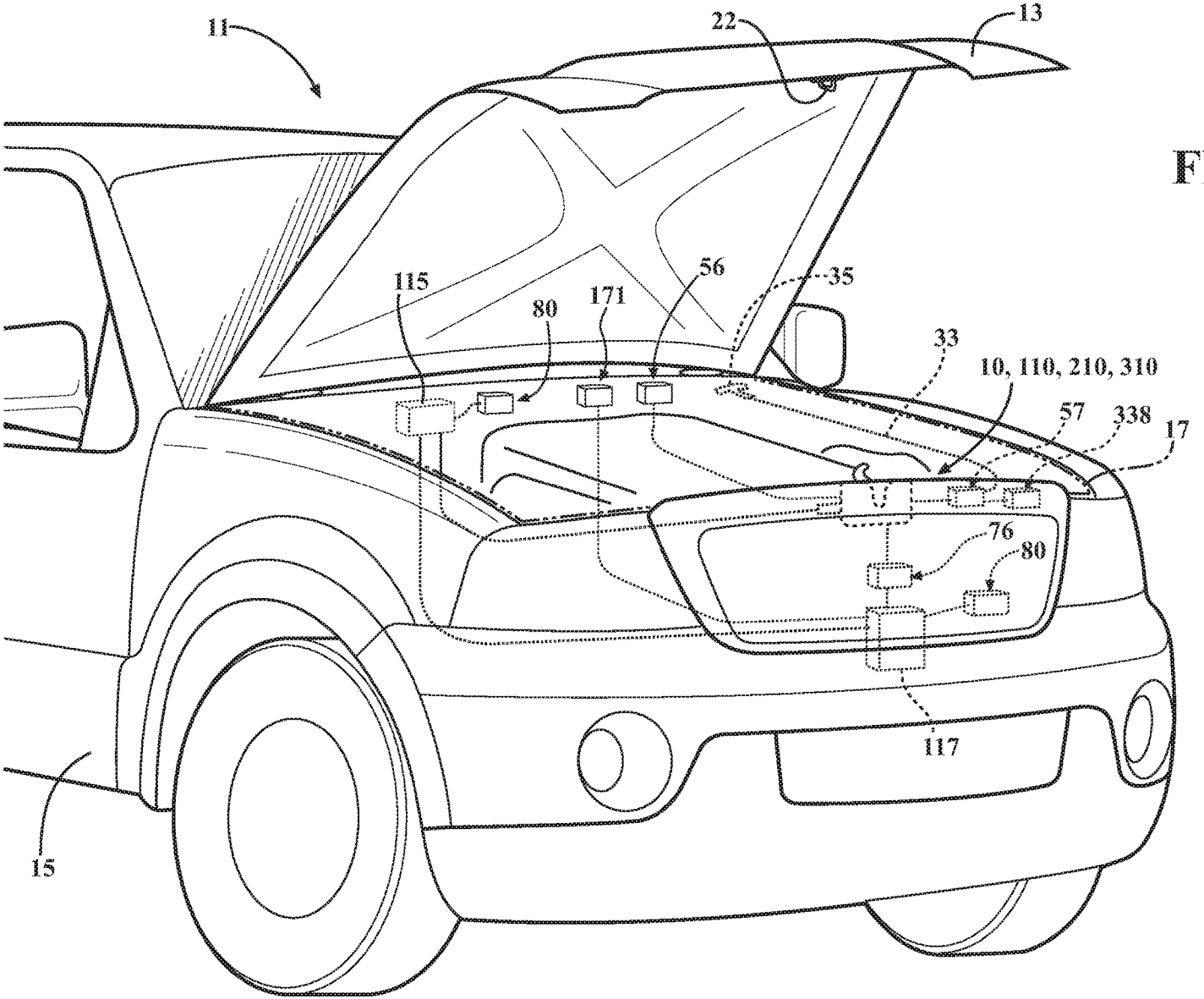
FIG. 1A is a front perspective view of a vehicle including a double pull latch system for a frunk in accordance with the disclosure.

Reference is made to FIG. 1 and FIG. 1A, which shows a motor vehicle 11 that has a front hood 13, to which there is a striker 22 attached. Front hood 13 may enclose a front trunk 17, also referred to as frunk 17, for storage in a compartment provided in the front of the vehicle where an engine typically would occupy but has been provided at another location in the vehicle. The striker 22 is capturable by a double pull closure panel latch assembly, which can also be referred to as a double pull hood latch assembly if used in a vehicle hood application, and is generally referred to hereafter simply as latch assembly or latch 10, which is mounted on a body 15 of the motor vehicle 11. The front hood 13 can be opened to allow access to the stowage space, or frunk 17, with an engine of the vehicle being located elsewhere, such as in the rear of the vehicle, by way of example and without limitation. Referring to FIGS. 2A-15B, the latch 10 includes a ratchet 12, a pawl mechanism or pawl assembly having for example a primary pawl 14 and a secondary pawl 16, a coupling link, also referred to as coupling lever 18, an emergency release lever, also referred to as backup or auxiliary release lever 19, and a housing 20. Pawl assembly is illustratively shown mounted in the housing and operable in a primary locking state, a secondary locking state and an unlocking state, the pawl assembly configured in the primary locking state to hold the ratchet 12 in the primary closed position and in the secondary locking state to hold the ratchet 12 in a secondary closed position, and in the unlocking state to release the ratchet 12 from at least one of the primary closed position and secondary closed position. Illustratively pawl assembly is shown as having a primary pawl 14 and a secondary pawl 16 positioned each on opposite sides of the ratchet 12, but other configurations of the pawl assembly are possible to allow the pawl assembly to hold the ratchet in the primary closed position, the secondary closed position and to release the ratchet 12 from at least one of the primary closed position and secondary closed position. For example pawl assembly may be provided on one side of the ratchet 12, primary pawl 14 and a secondary pawl 16 may be integrated with one another, as but non-limiting examples. The ratchet 12 is pivotably connected to the housing 20 and is movable between a primary closed position or state (FIGS. 2A-3B, 7A, 7B, 9A-10B, 13A, 13B), a secondary closed position or state (FIGS. 4A-5B, 11A-12B, 15A, 15B) and an open position or state (FIGS. 6A, 6B, 8A, 8B) in response to selective movement of the pawl assembly, for example in response to selective movement of the primary and secondary pawls 14, 16, as discussed further hereafter. The pivotal movement of the ratchet 12 may take place about a pin 25 that can be mounted to the housing 20. In the primary and secondary closed positions, the ratchet 12 prevents the withdrawal of the striker 22 that is mounted to the vehicle hood 13 and/or some other closure panel having latch 10. When in the primary closed position, the ratchet 12 holds the striker 22 relatively deeper within a slot, commonly referred to fishmouth (not shown, but well-known in the art), of the housing 20, wherein the hood 13 is in a fully closed state, as compared to when ratchet 12 is in the secondary closed position, wherein the hood 13 is in a partially closed state, but prevented from being moved to the fully open position by ratchet 12. Thus, in the primary closed position the ratchet 12 holds the striker 22 at a first depth in the fishmouth, and in the secondary closed position the ratchet 12 holds the striker 22 at a second depth in the fishmouth of the housing 20, wherein the first depth is greater than the second depth.

A communication link, also referred to as release member, such as cable assembly and/or electrical member 33, that operably interconnects a pivotable primary pawl release lever (not shown, and referred to hereafter as release lever), that is configured in operable communication with primary pawl 14 of latch assembly 10, to an actuation device 35 located within a passenger compartment 37 of motor vehicle 11. The actuation device 35 is directly or indirectly, mechanically and/or electrically coupled for operable communication with the release lever, wherein the actuation device can be provided as a gearshift member, lever, moveable handle, depressible button, switch, rotatable knob, or otherwise.

The primary pawl 14 and auxiliary release lever 19 are shown being supported for respective pivotal movement about a pin 24. Primary pawl 14 has a primary locking surface 26, a first stop surface 27 extending outwardly from the primary locking surface, a second stop surface 28, a driven member 29, shown as a laterally outwardly extending lug or protrusion, and a drive surface 30 extending obliquely from drive surface 28. Primary pawl 14 is biased toward the primary locking position via any suitable biasing member, such as a spring member, shown schematically in FIG. 2B at arrow 32.

Secondary pawl 16 has a secondary locking surface 34 biased into abutment with ratchet 12 via any suitable biasing member, such as a spring member, shown as a coil spring 36, by way of example and without limitation. A pin 38 extends laterally outwardly from a generally planar surface of the secondary pawl 16, wherein pin 38 supports coupling lever 18 for pivotal movement thereon. Pivotal movement of the secondary pawl 16 may take place about a pin 39 that can be mounted to the housing 20. Coupling lever 18 is an illustrative example of a coupling or interconnecting mechanism between primary pawl 14 and secondary pawl 16 providing a relationship between the movement or change of state of the primary pawl 14 and the secondary pawl 16, for example such that a movement or change of state of primary pawl 14 may impart a corresponding or conjoint movement or change of state of secondary pawl 16 when primary pawl 14 and secondary pawl 16 are coupled together, or a movement or change of state of primary pawl 14 may not impart a corresponding or conjoint movement of secondary pawl 16 when primary pawl 14 and secondary pawl 16 are not coupled or interconnected together.

Figure 2B:
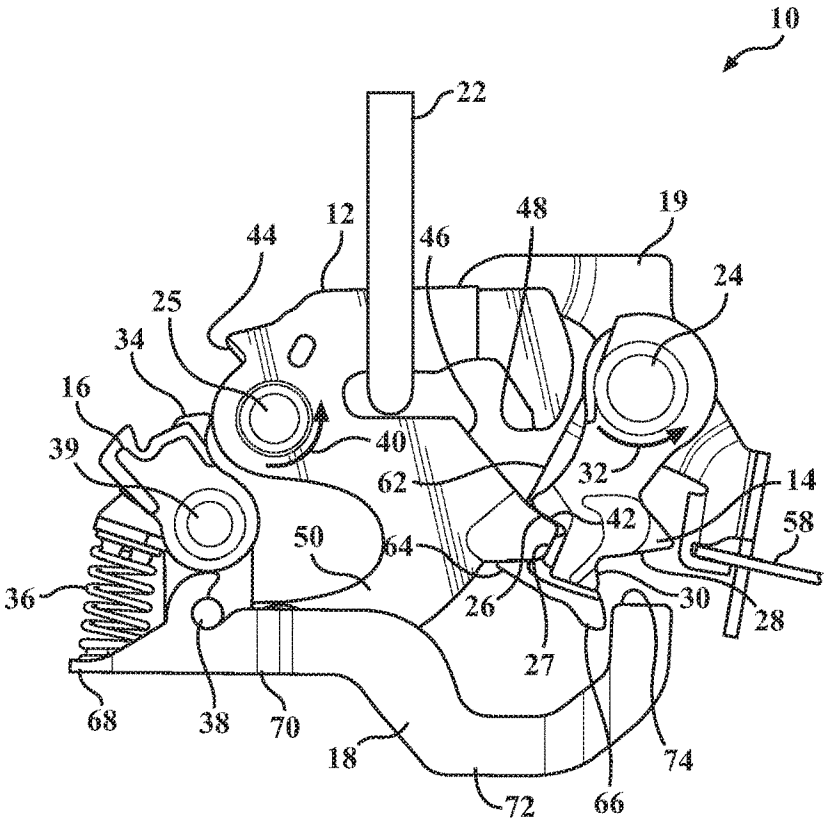
FIGS. 2A and 2B are opposite side views of a double pull latch assembly associated with the vehicle shown in FIG. 1 shown in a fully latched position and constructed according to the present disclosure.
Figure 2A:
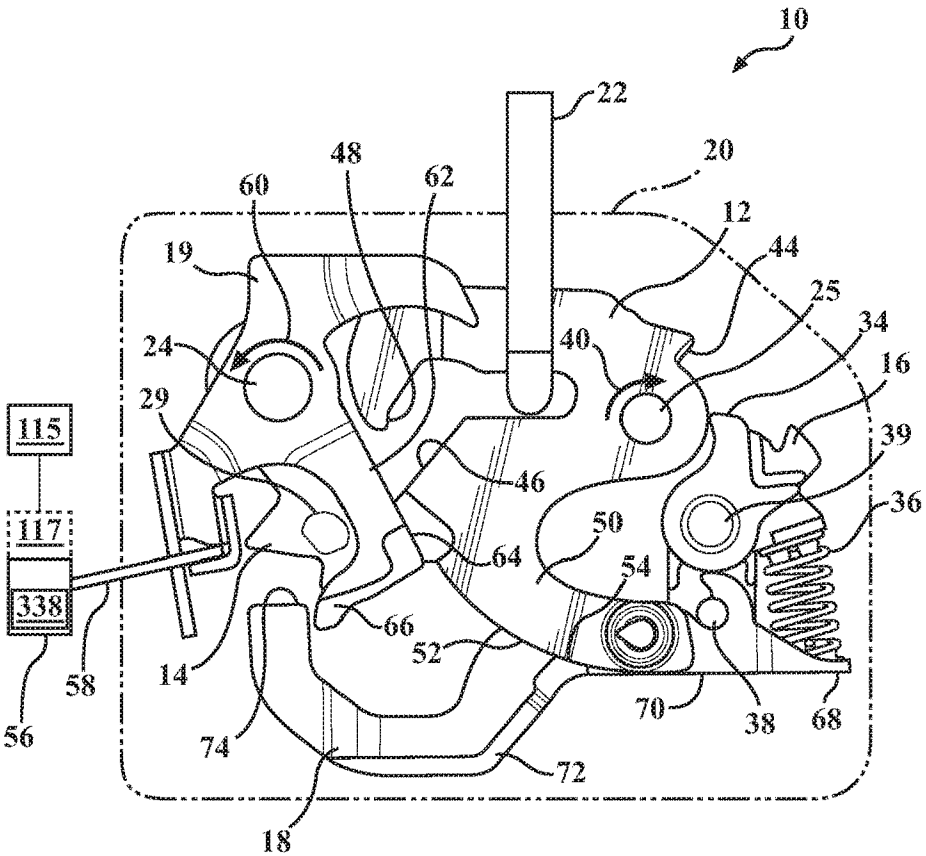
Figure 3B:
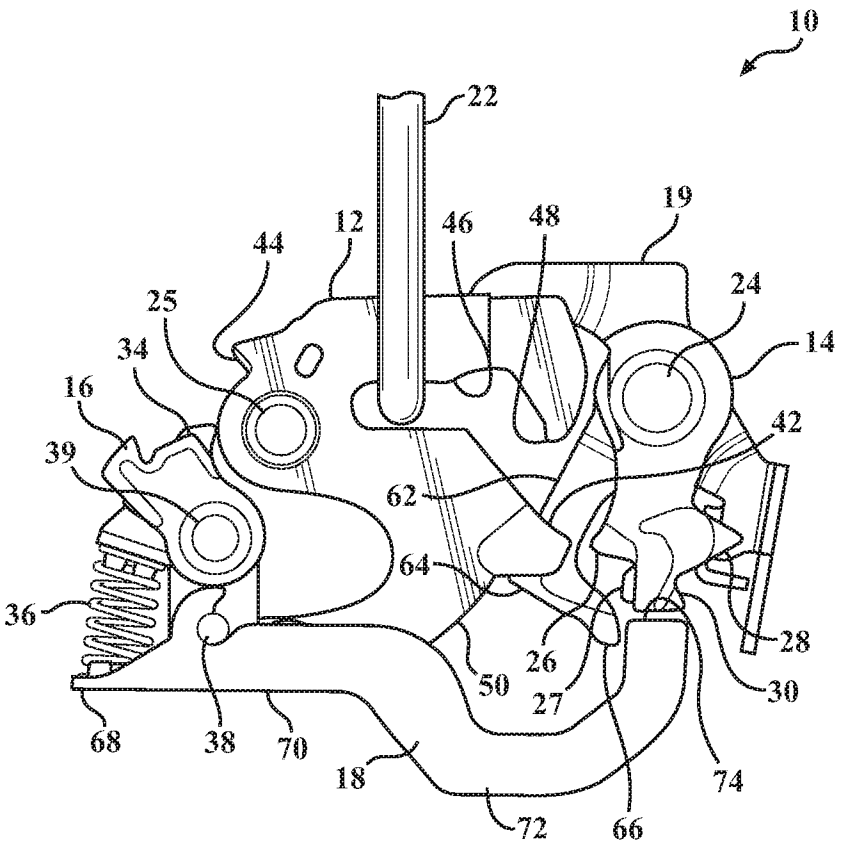
FIGS. 3A and 3B are views similar to FIGS. 2A and 2B with the double pull latch assembly shown during a first actuation of a primary pawl.
Figure 3A:
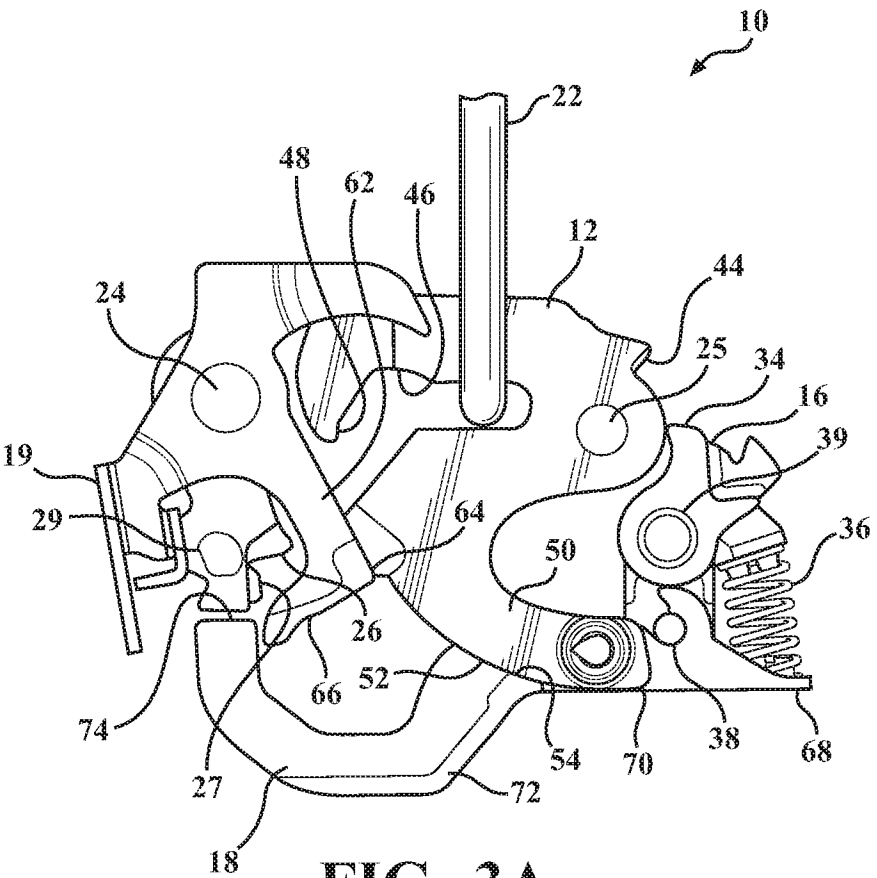

The ratchet 12 is biased toward the open position by a ratchet biasing member, such as via any suitable coil or torsion spring member, by way of example and without limitation, shown schematically by arrow 40 (FIG. 2A). Ratchet 12 has a primary locking surface 42 configured for selective releasably locked engagement with primary locking surface 26 of primary pawl 14 and a secondary locking surface 44 configured for selective releasably locked engagement with secondary locking surface 34 of secondary pawl 16. Ratchet 12 has a slot 46, shown as being generally V-shaped along its length, by way of example and without limitation, configured for receipt of striker 22 therein while in the primary and secondary closed positions, as is known. To facilitate maintaining the ratchet 12 in the secondary closed position, until desired to move ratchet 12 to the fully open position, a hook-shaped nose 48 is provided at an exit region of the slot 46. Ratchet 12 has an elongate, arcuate arm 50 extending away from slot 46 into generally underlying relation with pin 25. Arm 50 has a peripheral outer holding surface 52 contoured for selective abutment with a shoulder 54 of coupling lever 18 to selectively maintain coupling lever in a home position while latch 10 is fully latched with ratchet 12 in its primary closed position.

The auxiliary release lever 19 is configured for attachment to an auxiliary release member (shown schematically at 56 in FIG. 1) within the trunk 17 providing a release mechanism accessible from within the trunk 17 or frunk 17, such as via any suitable mechanically actuatable member 58, including a cable, such as a Bowden cable, or rod, by way of example and without limitation. The auxiliary release lever 19 is mounted to the housing 20 for pivoting movement between a released position and an actuated position in response to selective actuation of the auxiliary release member 56, wherein the auxiliary release lever 19 is biased toward the released position, such as via any suitable biasing member, including a spring member, shown in FIG. 2A schematically at 60. Auxiliary release lever 19 has an elongate drive arm 62 extending away from pin 24 for receipt between driven member 29 of primary pawl 14 and ratchet 12. While in the primary closed position, a generally L-shaped end region 64 of drive arm 62 is biased into abutment with ratchet 12 at a location from which arm 50 extends, with end region 64 also being in abutment with driven member 29. The L-shaped end region 64 has a leg 66 that extends generally about driven member 29 to facilitate capturing and selectively driving driven member 29.

The coupling lever 18 is pivotably mounted to the secondary pawl 16 via pin 38 for movement between a connected position, also referred to as an engaged position or state (FIGS. 4A-6B), a disengaged position or state (FIGS. 9A-15B), and a home position or state (FIGS. 2A-3B, 7A-8B) between the engaged and disengaged positions. The coupling lever 18 is biased toward the engaged position by any suitable biasing member, and is shown as being biased by biasing member 36 in common with secondary pawl 16. Accordingly, biasing member 36 is forcibly compressed between secondary pawl 16 and a free end 68 of coupling lever 18 to cause secondary pawl 16 and coupling lever 18 to be pivoted away from one another about their respective pins 39, 38. Coupling lever 18 extends along a generally straight portion 70 from free end 68 to a generally C-shaped portion 72 that terminates at a free end 74. The C-shaped portion 72 opens toward latch 10 with free end 74, while in the home and engaged positions, wrapping beyond and into close proximity with leg 66 of auxiliary release lever 19.

Figure 9B:
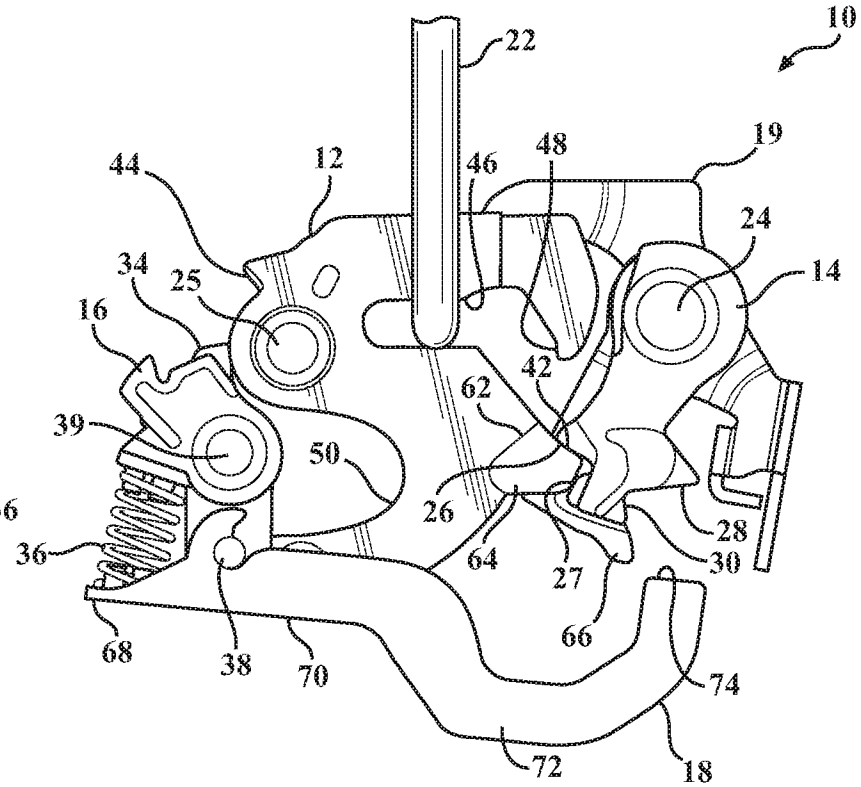
FIGS. 9A and 9B are views similar to FIGS. 2A and 2B with the double pull latch assembly shown while the vehicle is in a predetermined condition causing an actuator to move a coupling lever to a disengaged position.
Figure 9A:
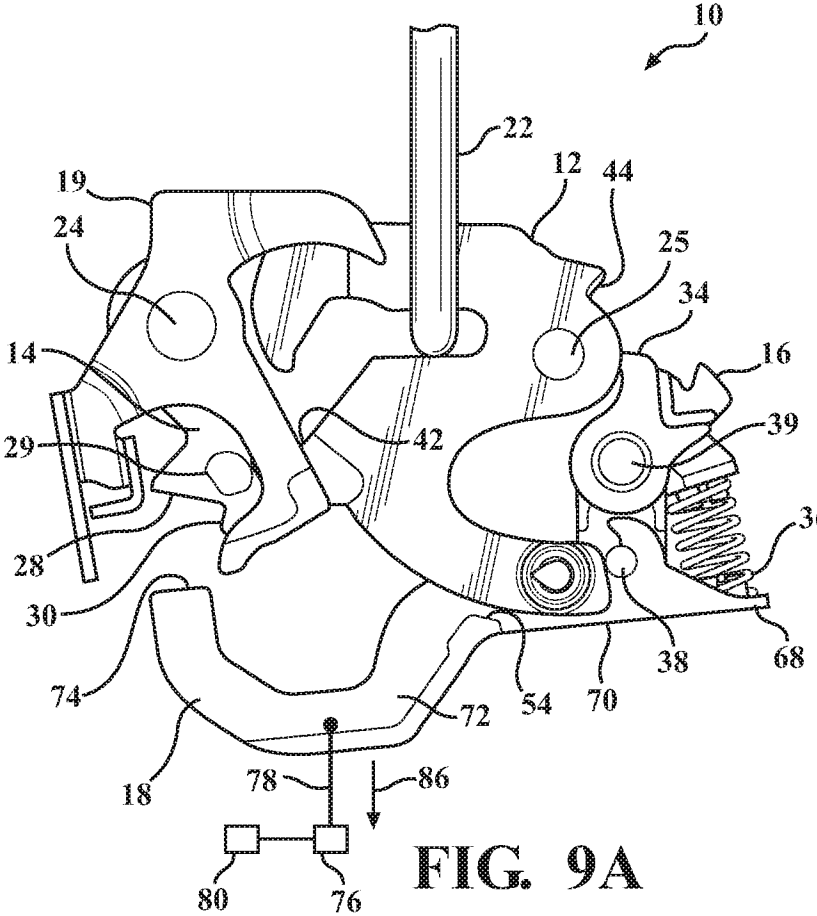
Figure 10B:
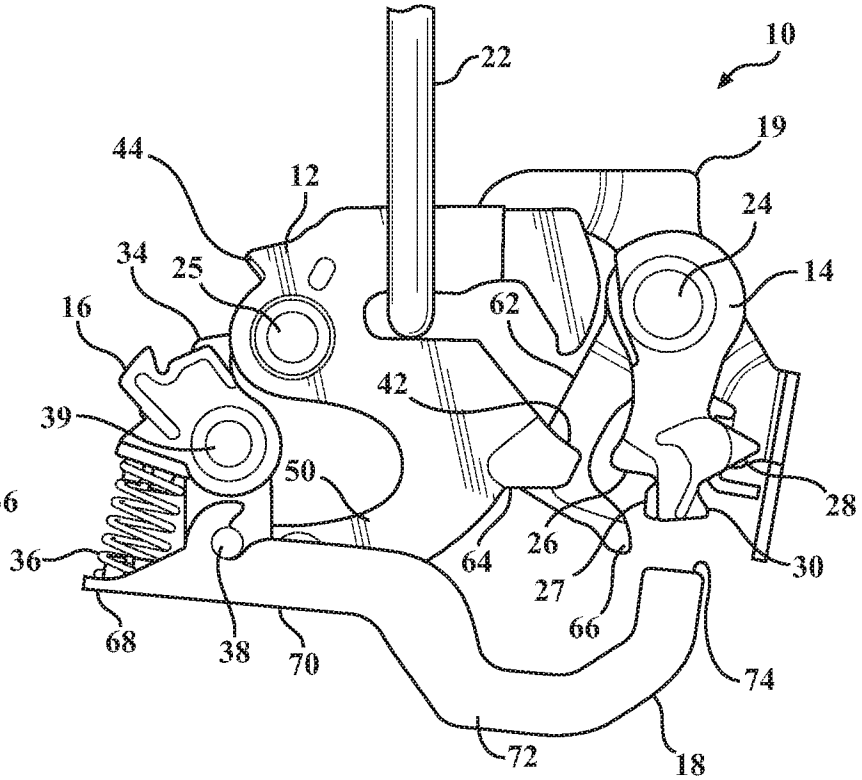
FIGS. 10A and 10B are views similar to FIGS. 9A and 9B with the double pull latch assembly shown during a first actuation of primary pawl with the coupling lever moved to the disengaged position.
Figure 10A:
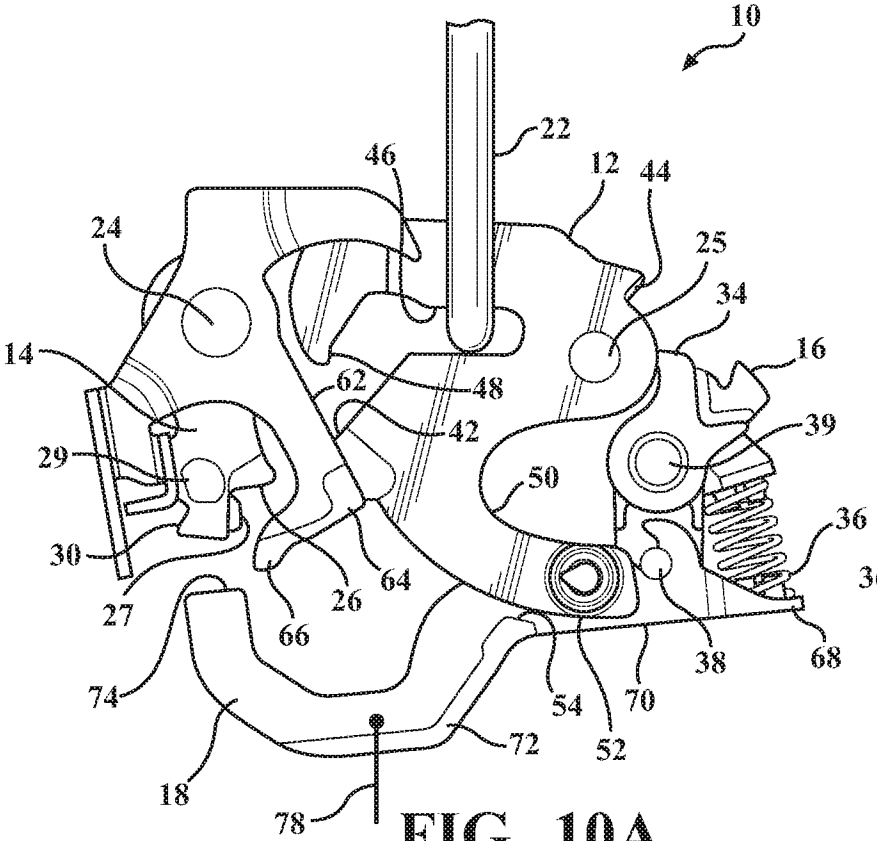
Figure 11B:
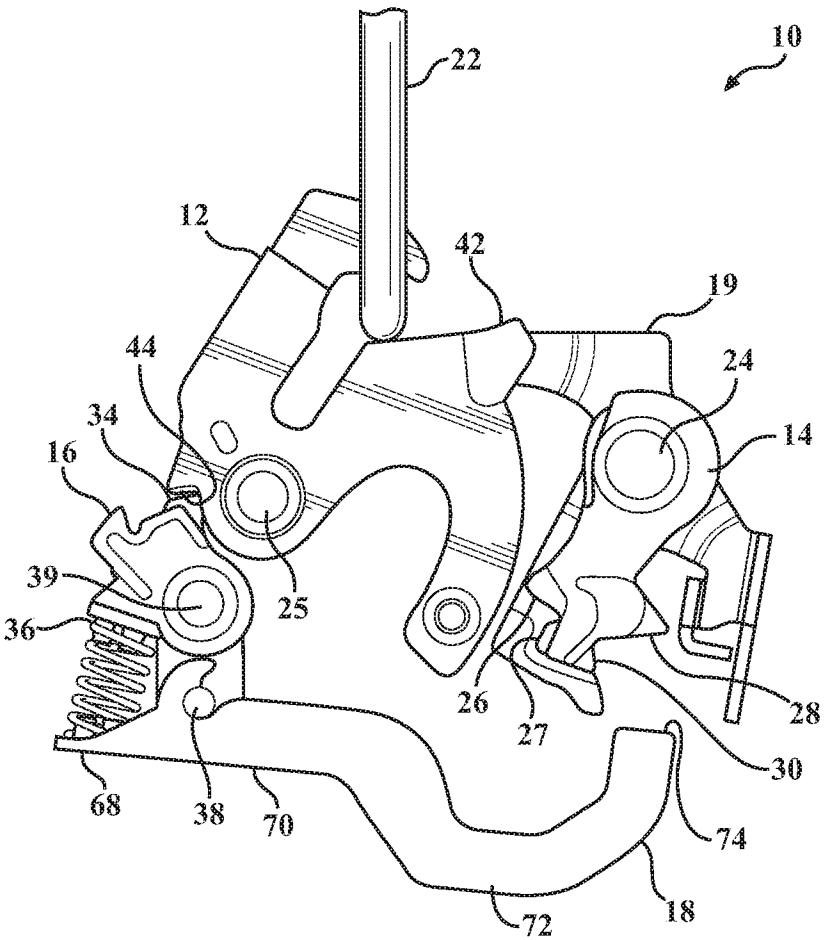
FIGS. 11A and 11B are views similar to FIGS. 10A and 10B with the double pull latch assembly shown after completion of the first actuation of the primary pawl and with a ratchet in the second closed position.
Figure 11A:
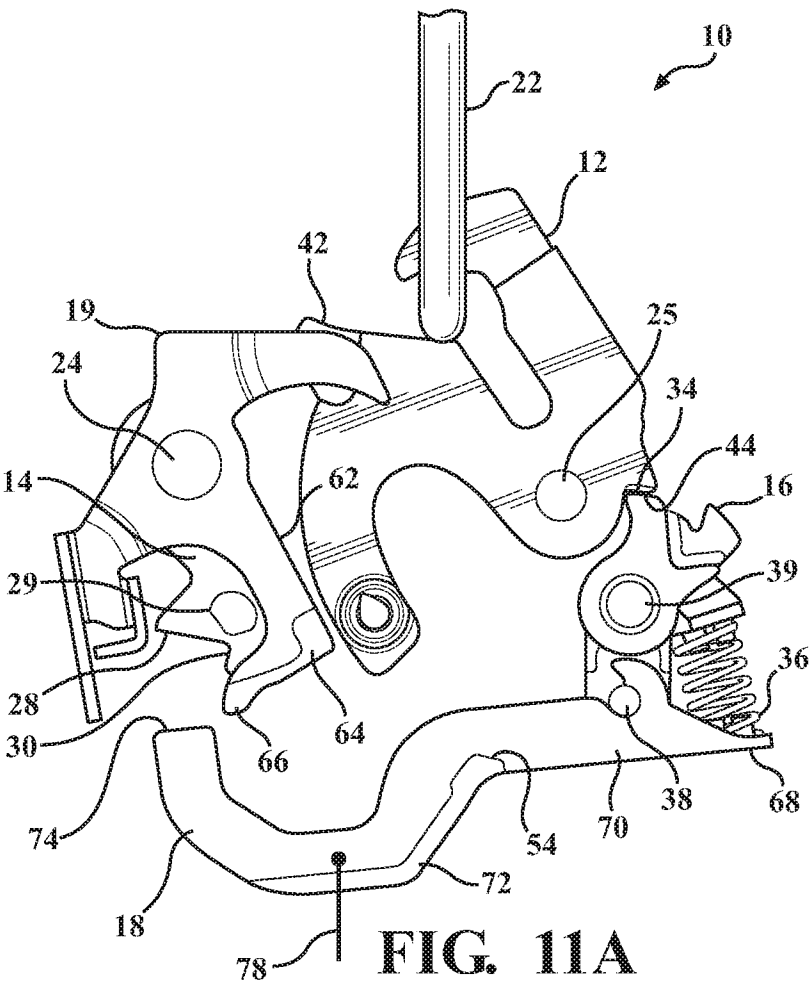
Figure 12B:
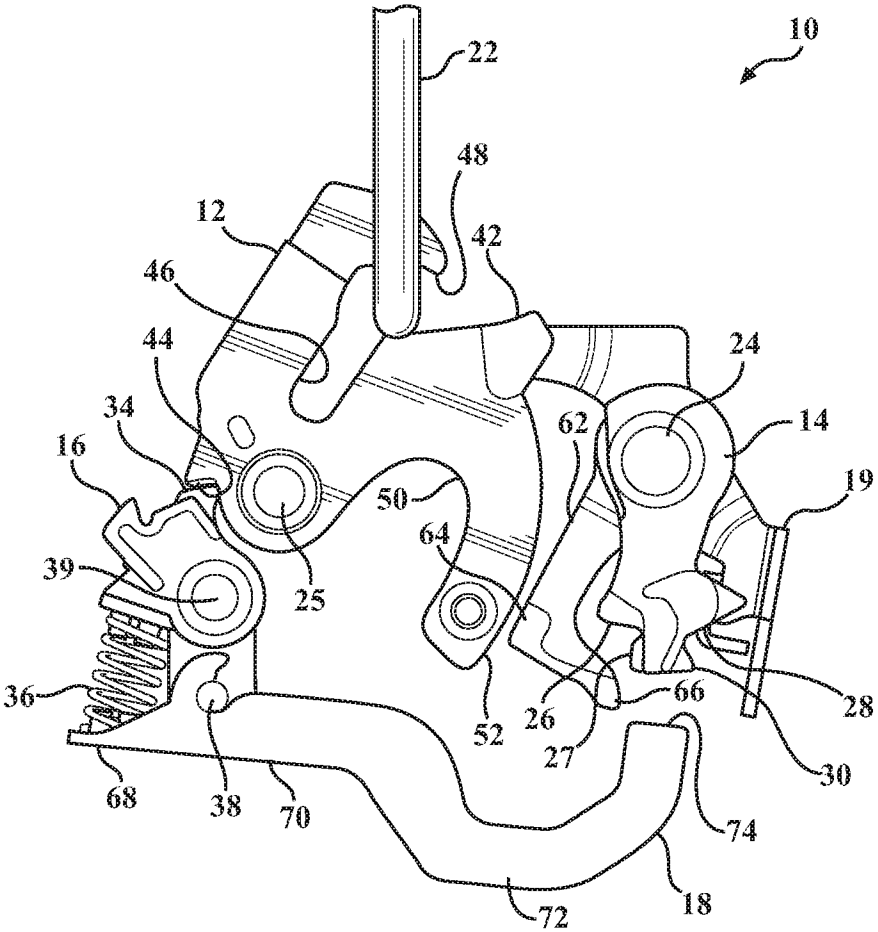
FIGS. 12A and 12B are views similar to FIGS. 11A and 11B illustrating how a second actuation of the primary pawl does not cause the release of a secondary pawl due to the coupling lever being moved to the disengaged position.
Figure 12A:
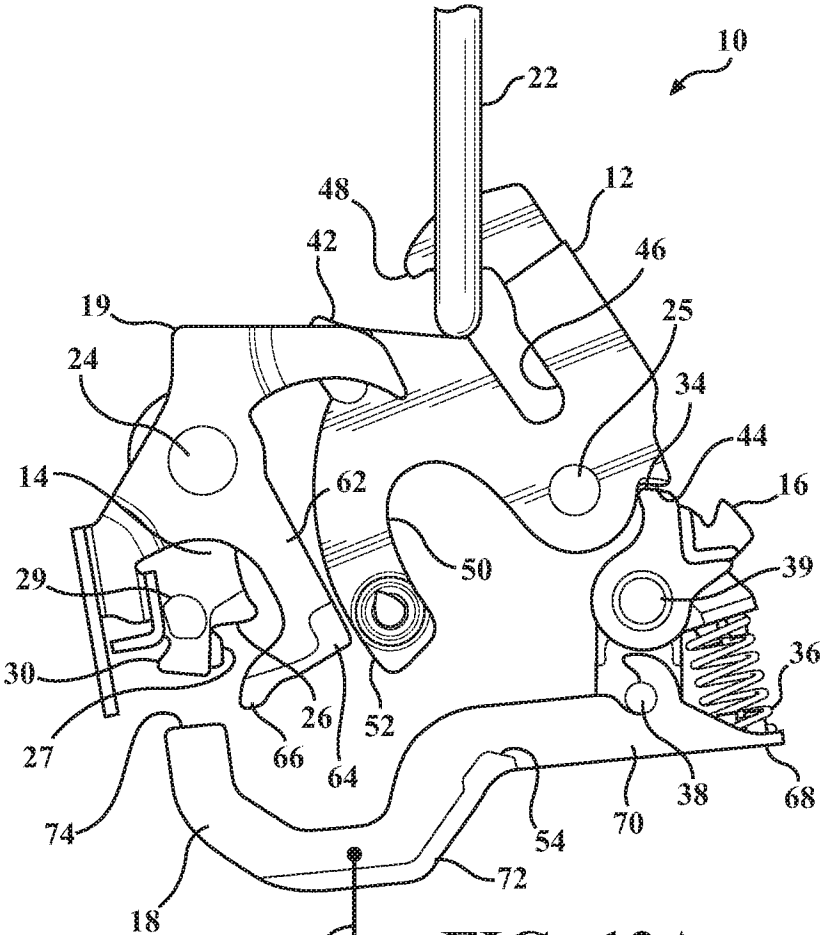
Figure 13B:
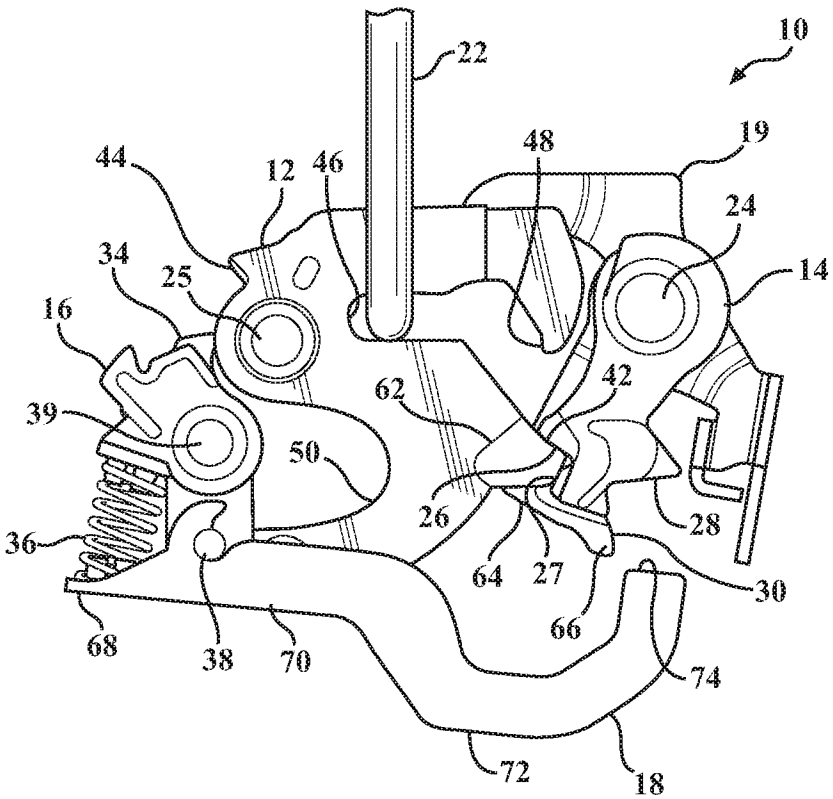
FIGS. 13A and 13B are views similar to FIGS. 9A and 9B.
Figure 13A:
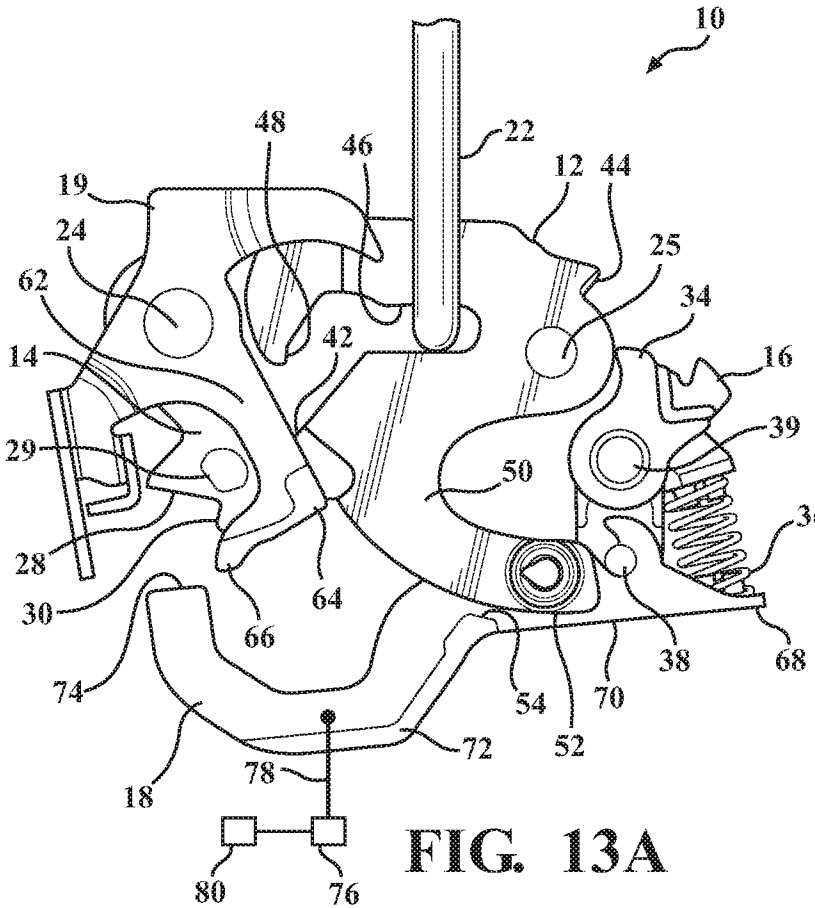
Figure 14B:
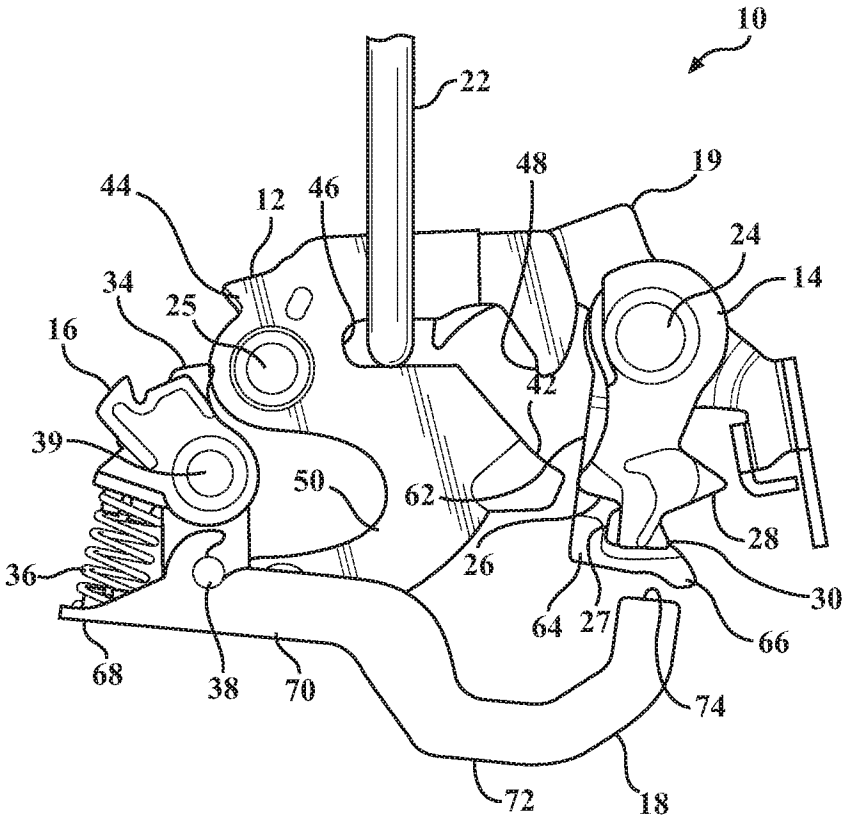
FIGS. 14A and 14B are views similar to FIGS. 13A and 13B with the double pull latch assembly shown during actuation of an auxiliary release lever via an auxiliary release member within the trunk.
Figure 14A:
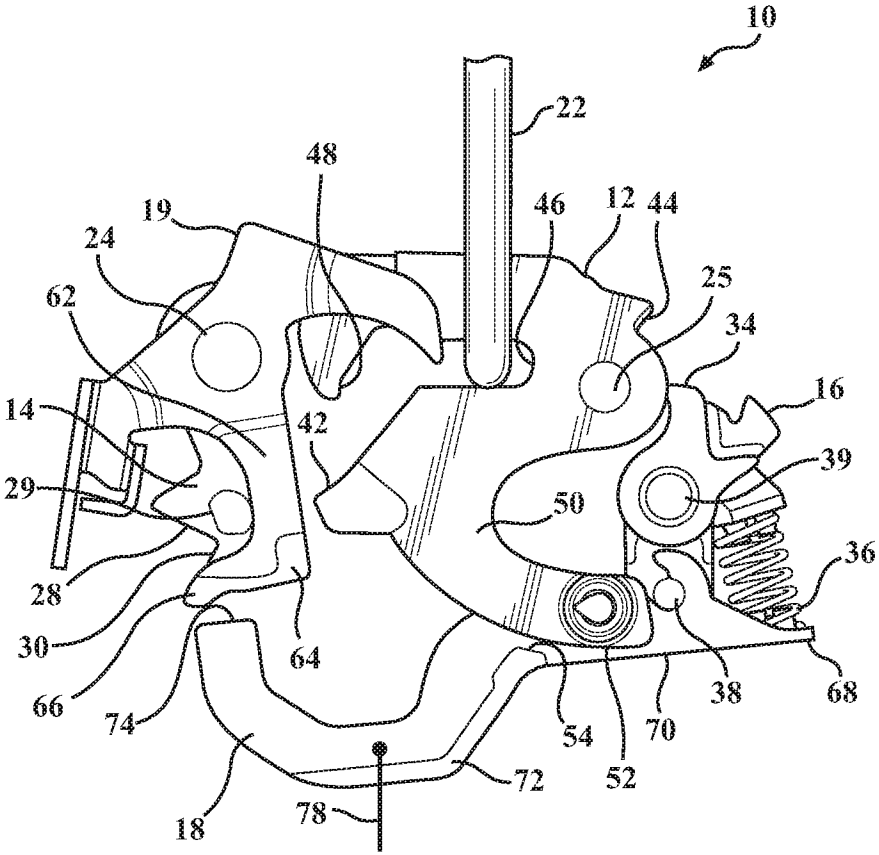

As shown in FIG. 9A, an actuator 76 is operably coupled to the coupling lever 18, such as via a rod or cable 78, by way of example and without limitation. The actuator 76 may be an electric motor type actuator, or a solenoid type actuator for example and without limitation. The actuator 76 is configured for communication with a vehicle sensor 80, either directly or indirectly, to change the operating mode of the latch 10 by controlling the operation of the pawl assembly, and for example by controlling the interrelationship between the primary pawl 14 and the secondary pawl 16, by selectively moving the coupling lever 18 between the home position and the disengaged position in response to a predetermined state of the vehicle in accordance with an illustrative example. The actuator 76 may be indirectly in communication with vehicle sensor 80, for example actuator 76 may be in communication with a Body Control Module such as Body Control Module 115, or other vehicle controller, such as controller 117, which is in turn in communication with the vehicle sensor 80. It is to be recognized that the sensor 80 is configured to detect the desired predetermined state of the vehicle 11 whereupon movement of the coupling lever 18 from the home position to the disengaged position is desired, and vice versa. The sensor 80 may be in operable communication with the vehicle control/computer system, such as the Body Control Module 115, indicating the state of various vehicle operating parameters, such as throttle position, brake pedal position, key inserted, or key/on off positions, speed, engine operation, parking brake engaged, and the like, by way of example and without limitation. As another example, the sensor 80 may be in operable communication with multiple vehicle systems and capable of making a determination as to the motive operation of the motor vehicle 11. Accordingly, the sensor 80 can signal the actuator 76 to move the coupling lever 18 to the disengaged position upon recognition of the predetermined state of the vehicle. In one example, a predetermined state may be associated with the speed of the vehicle, such that upon the motor vehicle 11 reaching or exceeding the predetermined speed, the sensor 80 signals the actuator 76 to move the coupling lever 18 to the disengaged position, thereby prevent the latch 10 from being fully unlatched, as discussed in more detail below. In another example, a predetermined state may be associated with the state of an engine of the vehicle 11, such that if the engine is on, the sensor 80 signals the actuator 76 to move the coupling lever 18 to the disengaged position. It is to be recognized that the actuator 76 will return the coupling lever 18 to the home position upon the sensor 80 detecting the predetermined state no longer exists, such as the vehicle 11 slowing below a predetermined speed or the engine being turned off, by way of example and without limitation.

Figure 4B:
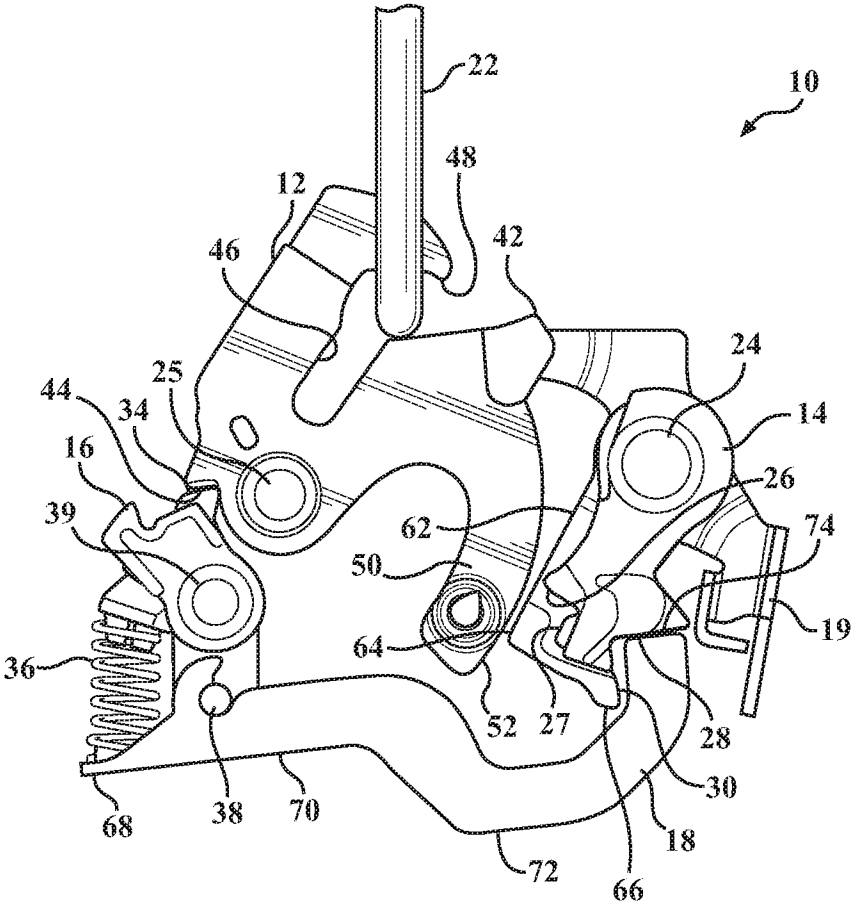
FIGS. 4A and 4B are views similar to FIGS. 3A and 3B with the double pull latch assembly shown after completion of the first actuation.
Figure 4A:
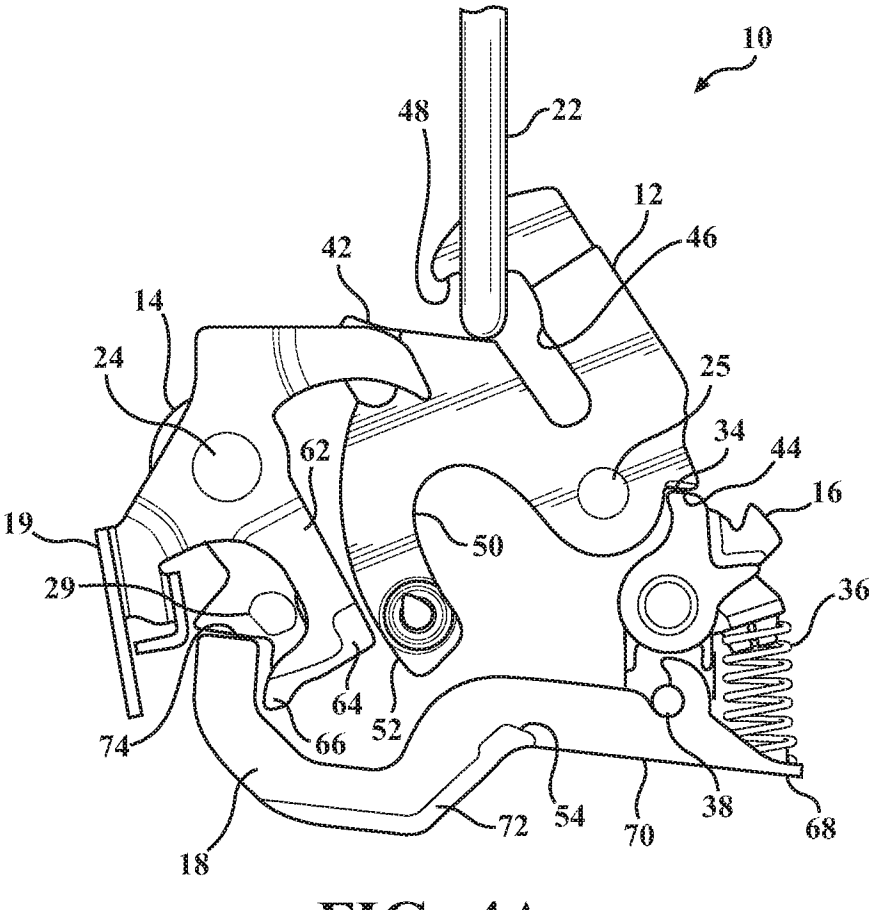
Figure 5B:
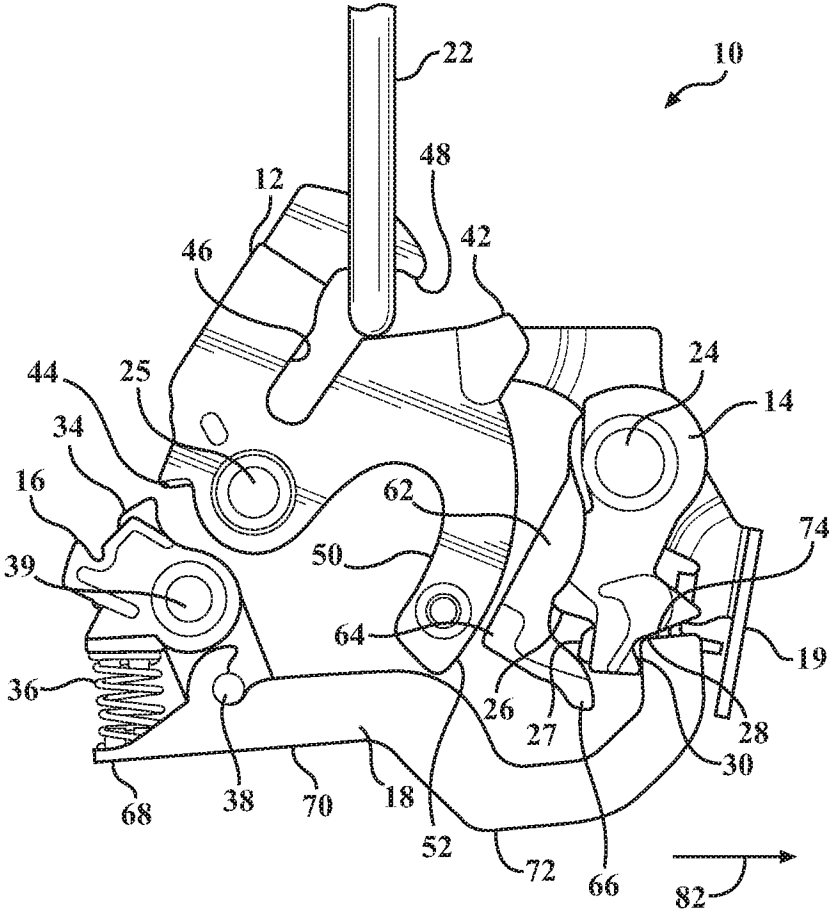
FIGS. 5A and 5B are views similar to FIGS. 4A and 4B with the double pull latch assembly shown during a second actuation of a primary pawl.
Figure 5A:
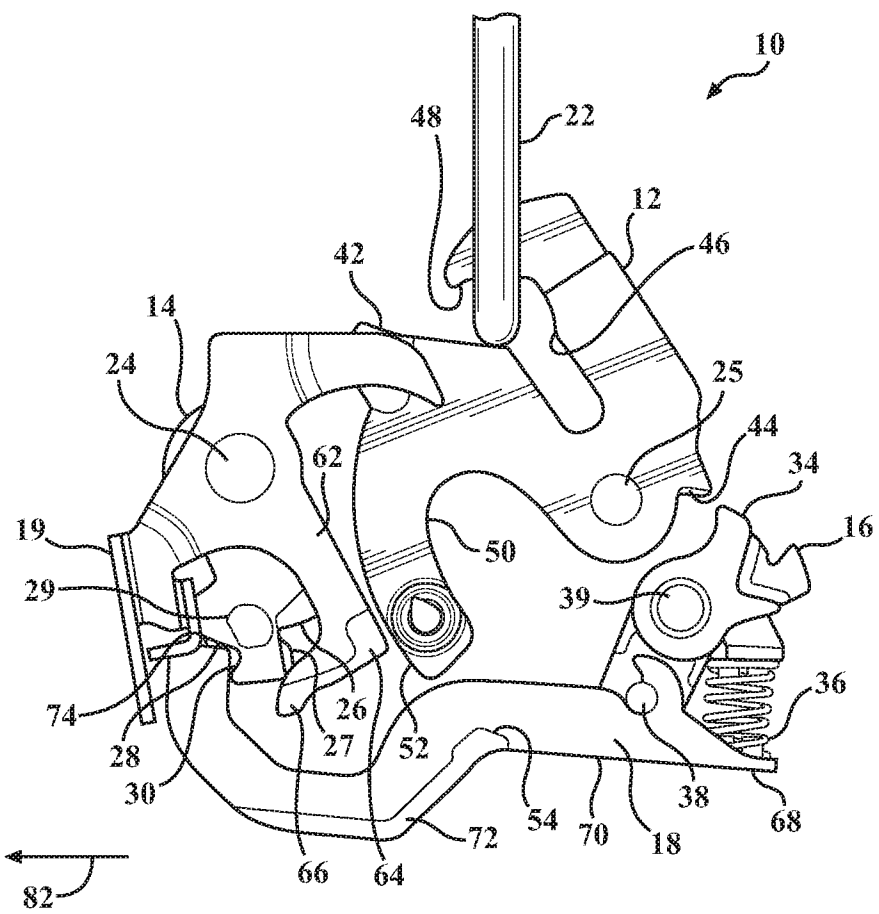
Figure 6B:
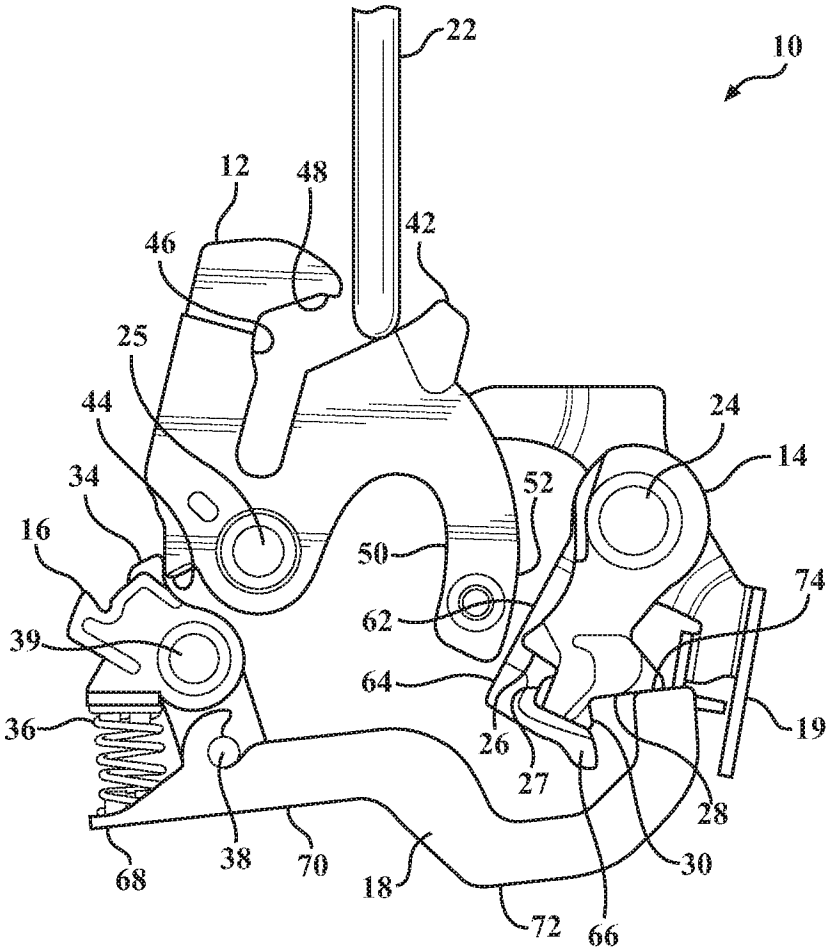
FIGS. 6A and 6B are views similar to FIGS. 3A and 3B with the double pull latch assembly shown after completion of the second actuation and in a fully open position.
Figure 6A:
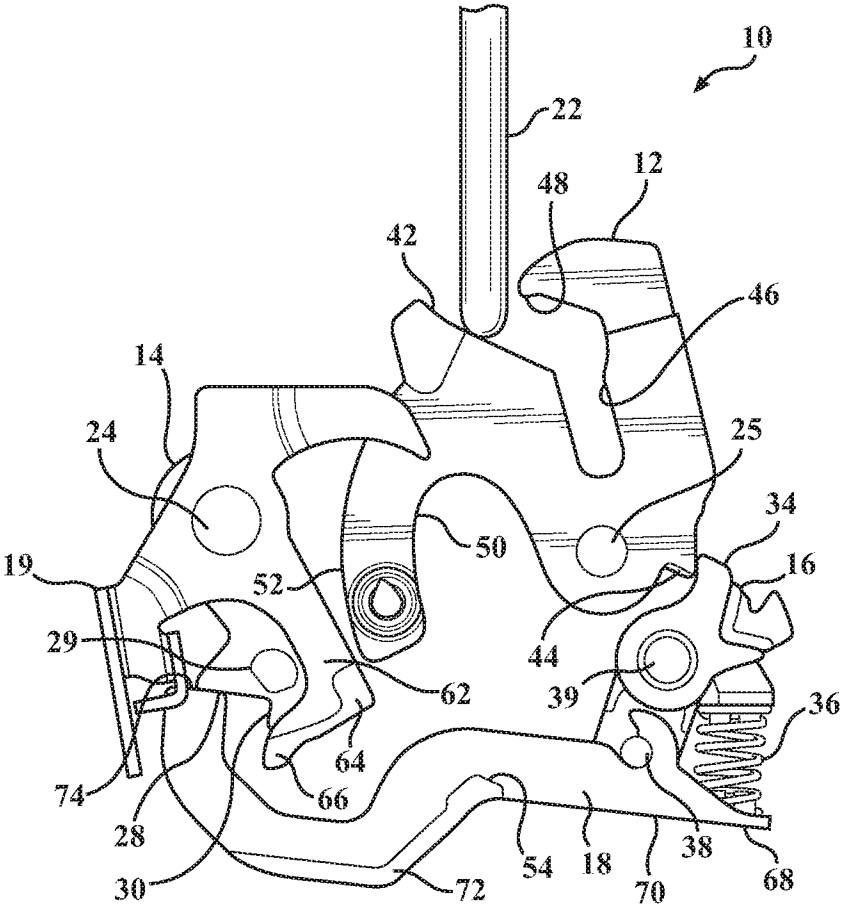
Figure 7B:
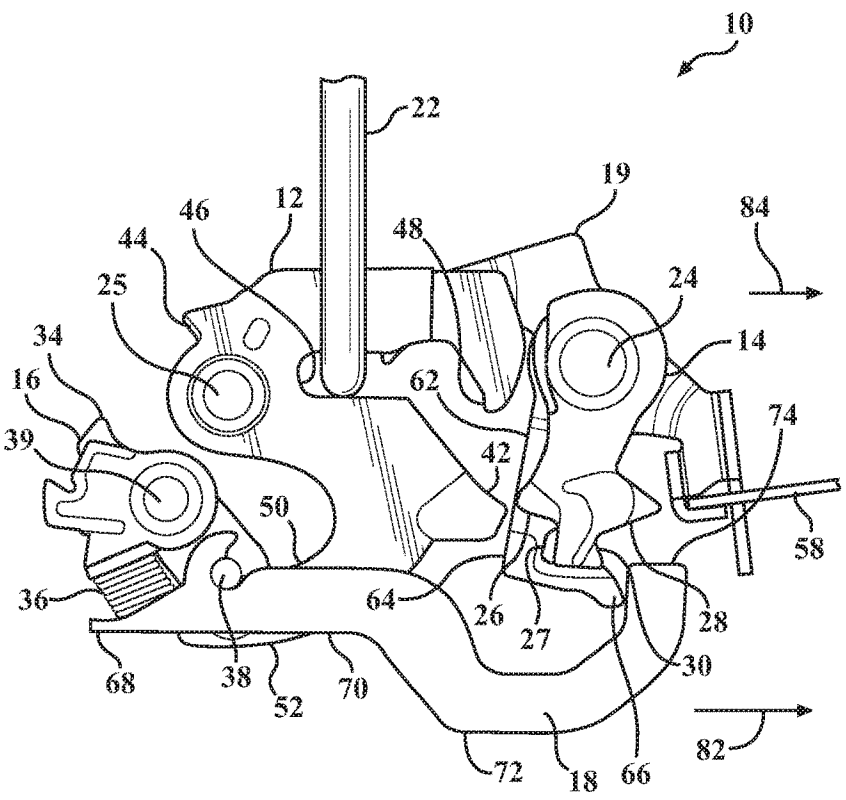
FIGS. 7A and 7B are views similar to FIGS. 2A and 2B with the double pull latch assembly shown during an actuation of an auxiliary release lever via an auxiliary release member within the trunk.
Figure 7A:
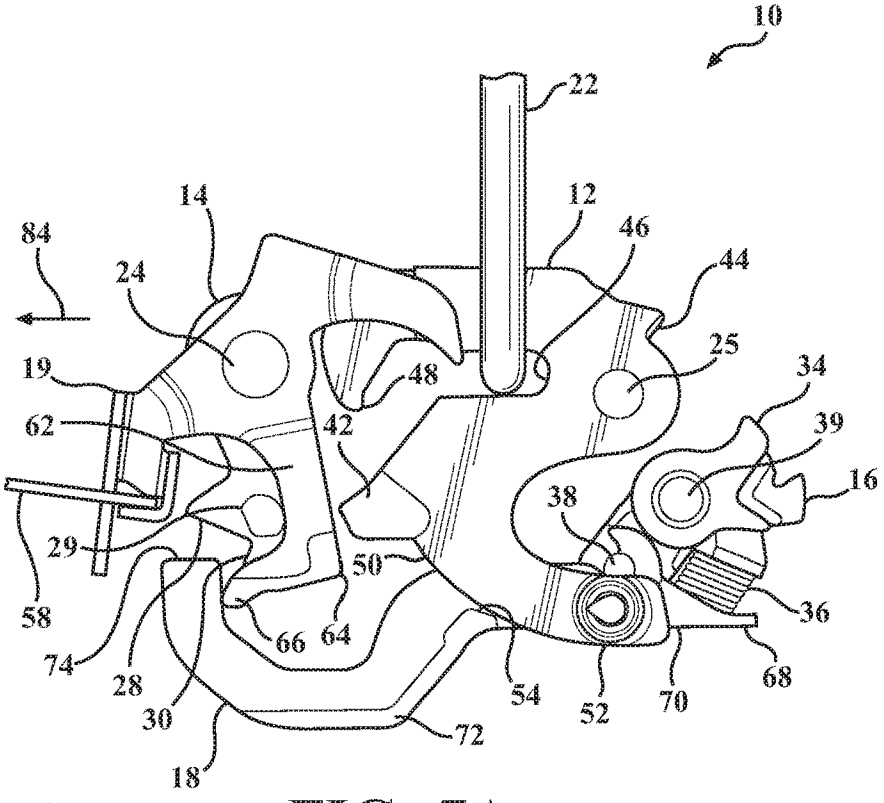

In use, in a normal release condition whereby the pawl assembly is operating in a normal mode, with the coupling lever 18 in the home position and the ratchet 12 in the primary closed position (FIGS. 2A, 2B), movement of the primary pawl 14 from the primary locking position to the primary unlocking position (FIGS. 3A-4B) in response to a first actuation of the release member (e.g. pawl release lever) causes the ratchet 12 to move from the primary closed position to the secondary closed position. During movement of the ratchet 12 to the secondary closed position, the holding surface 52 of ratchet 12 slides along shoulder 54 of coupling lever 18 and ultimately moves out of contact with shoulder 54, whereupon the coupling lever 18 is automatically biased by biasing member 36 to move from the home position to the engaged position. Upon the primary locking surface 26 of primary pawl 14 moving out from engagement from primary locking surface 42 of ratchet 12, the biasing member 40 biases ratchet 12 to the secondary closed position, whereat secondary locking surface 34 of secondary pawl 16 engages secondary locking surface 44 of ratchet 12 to releasably maintain the ratchet 12 in the secondary closed position. Upon performing a first actuation of primary pawl 14, primary pawl 14 is biased by biasing member 32 to return to its home primary locking position whereupon second stop surface 28 confronts and abuts free end 74 of coupling lever 18, thereby holding the coupling lever 18 in the engaged position (FIGS. 4A, 4B). Then, when desired to fully release latch 10, repeated actuation of the primary pawl 14 is performed, such as via a second actuation of actuation device 35 inside the passenger compartment 37, causing movement of the primary pawl 14 to the primary unlocking position in response to a second actuation of the release member, whereupon drive surface 30 of primary pawl 14 engages a region of the coupling lever 18 immediately adjacent free end 74 and moves the coupling lever 18 in translation generally along a direction indicated by arrow 82 (FIGS. 5A, 5B). With coupling lever 18 moved in the direction of arrow 82, the secondary pawl 16 is caused to pivot about pin 39 out from the secondary locking position to the secondary unlocking position, whereupon secondary locking surfaces 34, 44 move out of engagement from one another, whereupon ratchet 12 is caused to move under the bias of biasing member 40 from the secondary closed position to the open position (FIGS. 6A, 6B). At this time, hood 13 may be moved to a fully open position. The above is performed in normal course of use, for example when the latch 10 is operating in a normal mode, without a predetermined condition having been met, such as engine running or exceeding a predetermined speed, by way of example and without limitation, by actuation of the latch 10 from within the passenger compartment 37 via actuation device 35, such that the hood 13 may be moved safely to a fully open position.

Figure 8B:
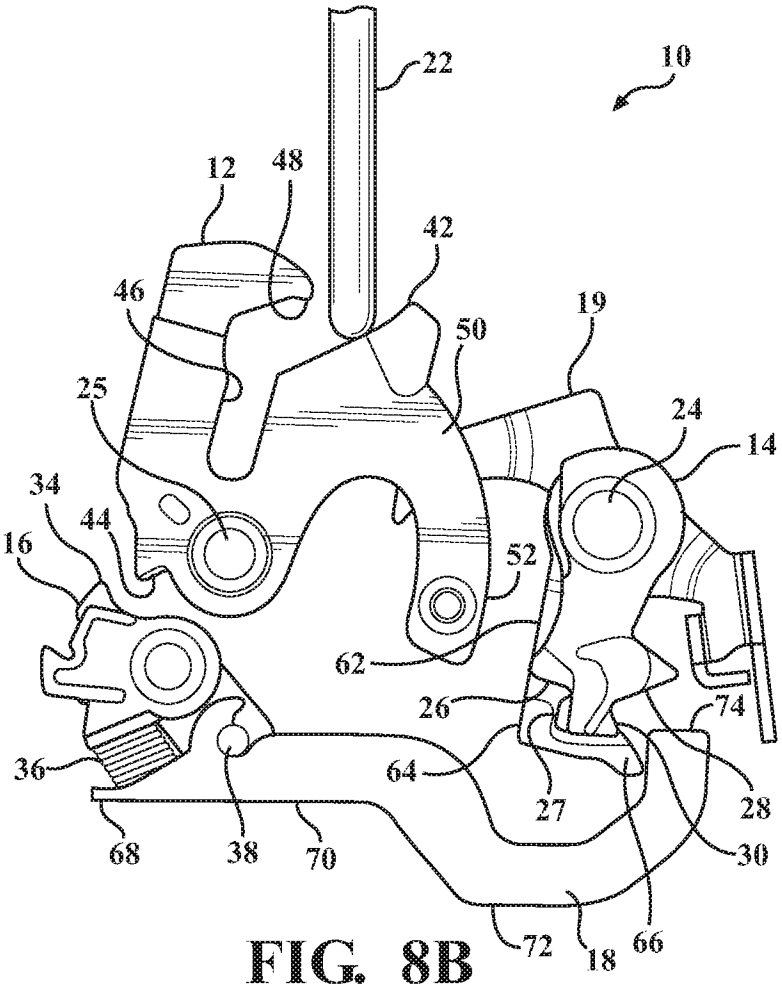
FIGS. 8A and 8B are views similar to FIGS. 7A and 7B with the double pull latch assembly shown after completion of the actuation of the auxiliary release lever and in a fully open position.
Figure 8A:
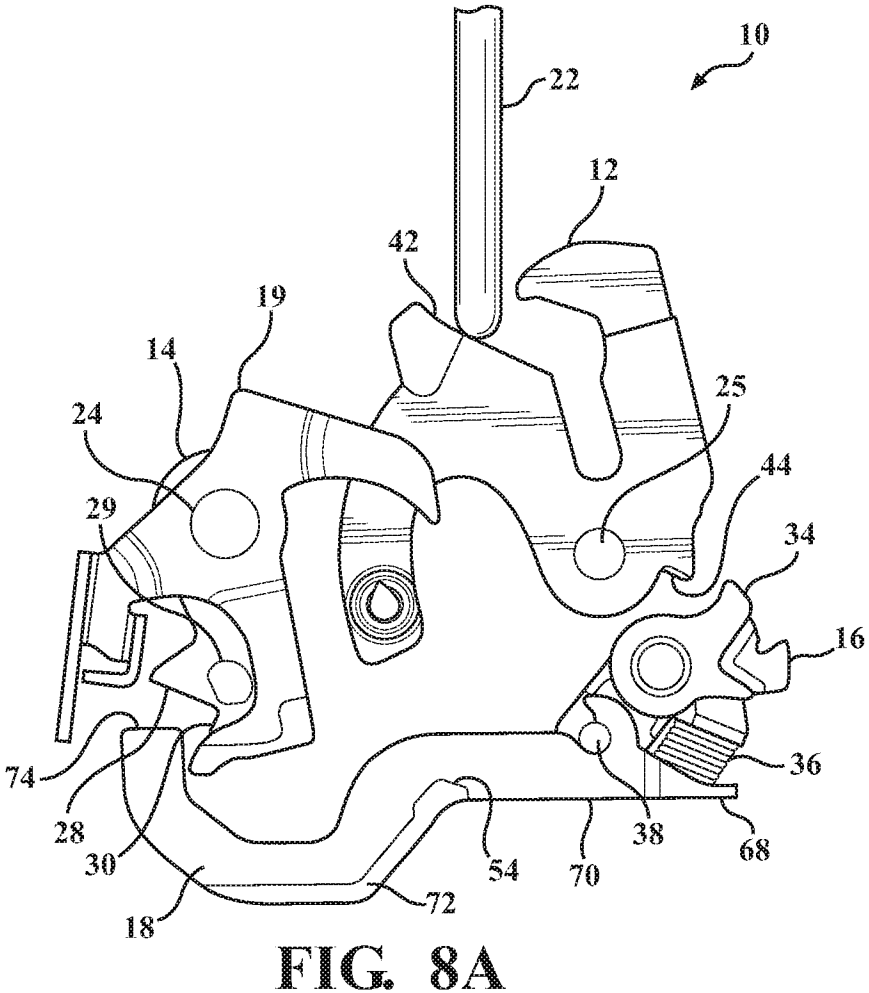

Now, when latch 10 is desired to be unlatched from within trunk 17 by a person locked with trunk 17 to allow the hood 13 to be opened, without a predetermined condition having been met, such as engine running or exceeding a predetermined speed, by way of example and without limitation, the person only need actuate auxiliary release member 56. Auxiliary release member 56 is an example of a release mechanism accessible from within the trunk 17 or frunk 17, and for example may be a mechanically activated release mechanism, or may be an electrically activated released mechanism. Selective actuation of auxiliary release member 56 causes cable/rod 58 to pull auxiliary release lever 19 in the direction of arrow 84 (FIGS. 7A, 7B), which causes drive arm 62 to engage and pull driven member 29 of primary pawl 14, and leg 66 to engage and push the region of coupling lever 18 immediately adjacent free end 74. Auxiliary release member 56 may include a power release mechanism such as a power release motor activatable by a switch or button located in the trunk 17, or frunk 17. Accordingly, the primary locking surface 26 of primary pawl 14 is moved out from engagement from primary locking surface 42 and simultaneously the coupling lever 18 is moved in translation along the direction of arrow 82 to pivot the secondary pawl 16 about pin 39 from the secondary locking position to the secondary unlocking position, whereupon ratchet 12 is caused to move under the bias of biasing member 40 directly from the primary closed position to the open position (FIGS. 8A, 8B). At this time, hood 13 may be moved to a fully open position.

As discussed above, a predetermined condition can be implemented to prevent unwanted release of the ratchet 12 to the fully open position, thereby preventing the unwanted opening of hood 13. In both a normal unlatching mode performed from within the passenger compartment 37 and in an emergency unlatching mode performed from within the trunk 17, if the predetermined condition has been met, the ratchet 12 can be caused to move from the primary closed position to the secondary closed position, but not to the fully open position. With reference to FIGS. 9A-12B, a normal mode of unlatching the latch 10 from within the passenger compartment 37 is shown, wherein the predetermined condition is met, such as engine running or vehicle traveling in excess of a predetermined speed (e.g. 5 km/h). Upon the predetermined condition being met, sensor 80 signals actuator 76 to move coupling lever 18 in the direction of arrow 86 (FIG. 9A) to a disengaged position, wherein coupling lever 18 remains in the disengaged position as long as the predetermined condition exists. With this, it is to be recognized that the coupling lever 18 can be returned to the home position via actuator 76 upon the predetermined condition no longer existing. Upon being moved to the disengaged position, the coupling lever 18 is moved out from potential contact with primary pawl 14 and auxiliary release lever 19. As such, movement of the primary pawl 14 from the primary locking position to the primary unlocking position (FIGS. 10A-11B) in response to a first actuation of the release member (e.g. pawl release lever) causes the ratchet 12 to move from the primary closed position to the secondary closed position. However, it can be seen in FIGS. 12A, 12B that with the coupling lever 18 in the disengaged position, the first or any subsequent actuations of primary pawl 14 fails to cause ratchet 12 to move from the secondary closed position, due to the free end 74 of coupling lever 18 being disposed out of potential contact from primary pawl 14. Accordingly, the hood 13 is prevented from being able to open via actuation of auxiliary release member 56 as long as the predetermined condition is met and as long as the coupling lever 18 remains in the disengaged position.

Figure 15B:
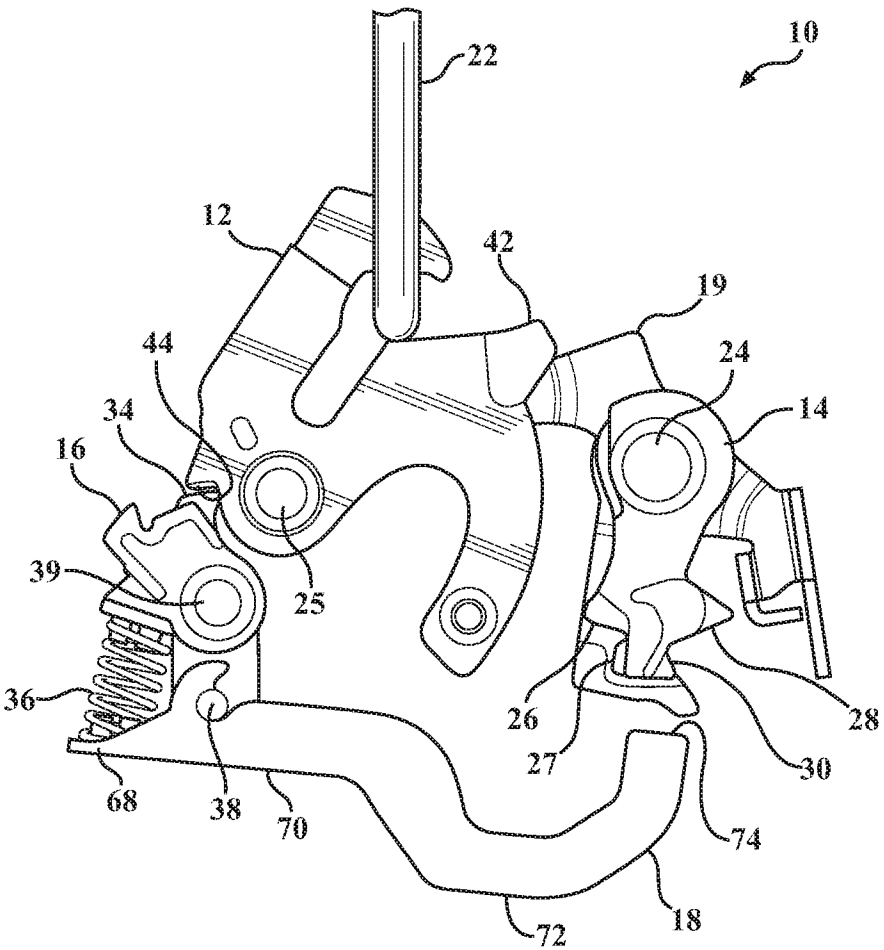
FIGS. 15A and 15B are views similar to FIGS. 14A and 14B with the double pull latch assembly shown after completion of the actuation of the auxiliary release lever with the ratchet in the second closed position.
Figure 15A:
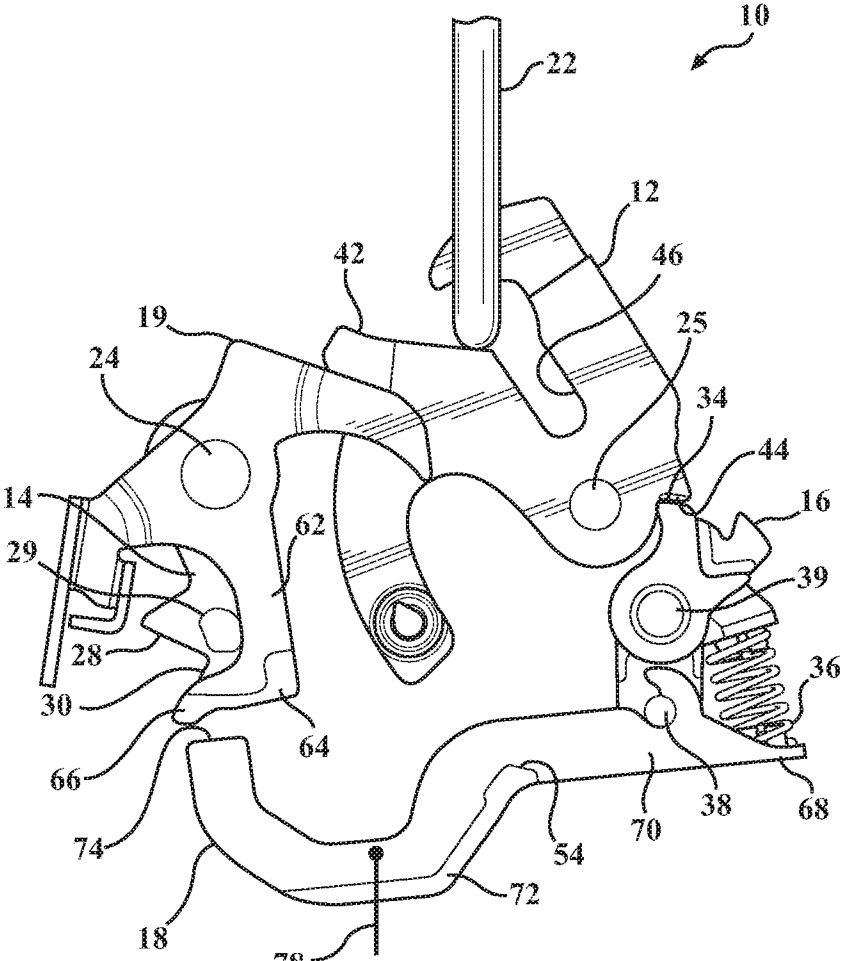

Now, when latch 10 is desired to be unlatched from within trunk 17 by a person locked with trunk 17 to allow the hood 13 to be partially opened, with the predetermined condition having been met, such as engine running or exceeding a predetermined speed, by way of example and without limitation, and the latch 10 operating in a safety mode, the person only need actuate auxiliary release member 56. Selective actuation of auxiliary release member 56 causes cable/rod 58 to pull auxiliary release lever 19, which causes drive arm 62 to engage and pull driven member 29 of primary pawl 14, but the leg 66 fails to engage the coupling lever 18 due to its being in the disengaged position, out from potential contact with auxiliary release lever 19. Accordingly, the primary locking surface 26 of primary pawl 14 is moved out from engagement from primary locking surface 42, whereupon ratchet 12 is caused to move under the bias of biasing member 40 from the primary closed position to the secondary closed position (FIGS. 15A, 15B). At this time, hood 13 may be moved to a partially opened position, thereby allowing air into the trunk 17 and allowing the person within the trunk 17 to voice outwardly therefrom, thereby being able to attract attention, and also at this time, hood 13 is maintained in the partially opened position and prevented from moving to a fully opened position, thereby preventing the trunk 17 or frunk 17 to open in an unsafe operating condition of the vehicle such as when the predetermined condition exists. For example, hood 13 is prevented from being opened when the vehicle 10 is above a speed, such as five kilometers per hour, which may for example in the configuration where hood 13 is a front hood 13 which encloses a front trunk 17, also referred to as frunk 17 and configured to swing upwardly and rearward towards a fully opened position as illustratively shown in FIG. 1, cause the hood 13 to be unsafely propelled upwards if caught by the air moving at the vehicle at speed thereby obscuring the view of a driver and/or impacting the windshield of the vehicle. The predetermined condition may therefore be set based upon the desired level of safety to the vehicle and driver, as well as for the safety of an entrapped person within the trunk 17, or frunk 17. Further yet, as described above, upon the predetermined condition no longer existing, as sensed by sensor 80, the latch 10 can be shifted to a normal mode of operation, for example the coupling lever 18 can be returned to the engaged position to allow a second actuation of auxiliary release member 56 to cause the ratchet 12 to move to the fully open position, thereby allowing the hood 13 to be opened.

Referring to FIGS. 16A-23B, a latch 110 constructed in accordance with another aspect of the disclosure for incorporation into motor vehicle 11 is shown, wherein the same reference numerals as used above for latch 10, offset by a factor of 100, are used to identify like features. Latch 110 includes a ratchet 112, a primary pawl 114, a secondary pawl 116, and a coupling link, also referred to as coupling lever 118. The ratchet 112 is movable between a primary closed position (FIGS. 16A-17B, 20A-21B), a secondary closed position (FIGS. 18A-18B) and an open position in response to selective movement of the primary and secondary pawls 114, 116. The pivotal movement of the ratchet 112 may take place about a pin 125 that can be mounted to a housing (not shown). In the primary and secondary closed positions, the ratchet 112 prevents the withdrawal of the striker 22 that is mounted to the vehicle hood 13 and/or some other closure panel having latch 110. When in the primary closed position, as discussed above for latch 10, the hood 13 is in a fully closed state, as compared to when ratchet 112 is in the secondary closed position, wherein the hood 13 is in a partially closed state, but prevented from being moved to the fully open position by ratchet 112.

Figure 16B:
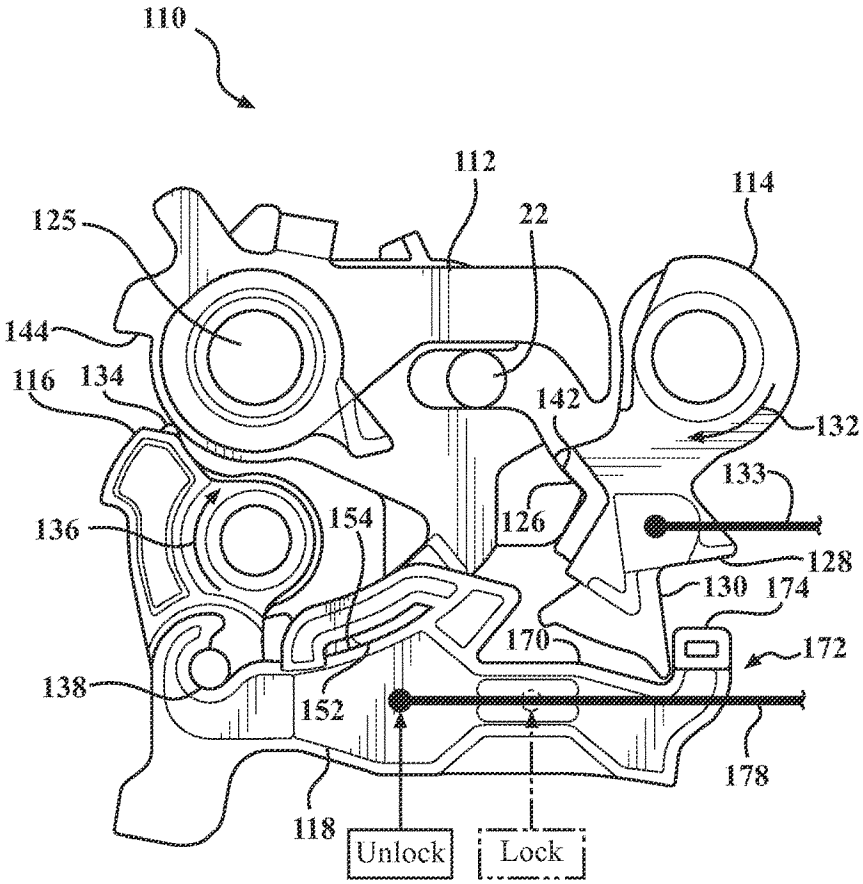
FIGS. 16A and 16B are opposite side views of a double pull latch assembly associated with the vehicle shown in FIG. 1 shown in a fully latched position and constructed according to another aspect of the present disclosure.
Figure 16A:
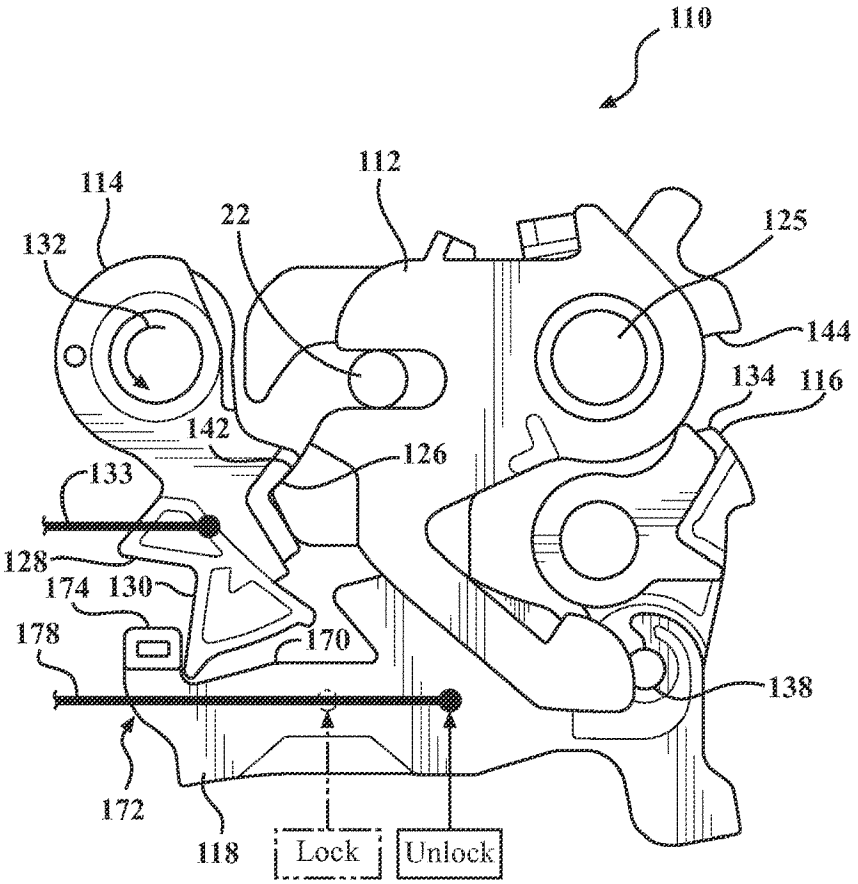
Figure 17B:
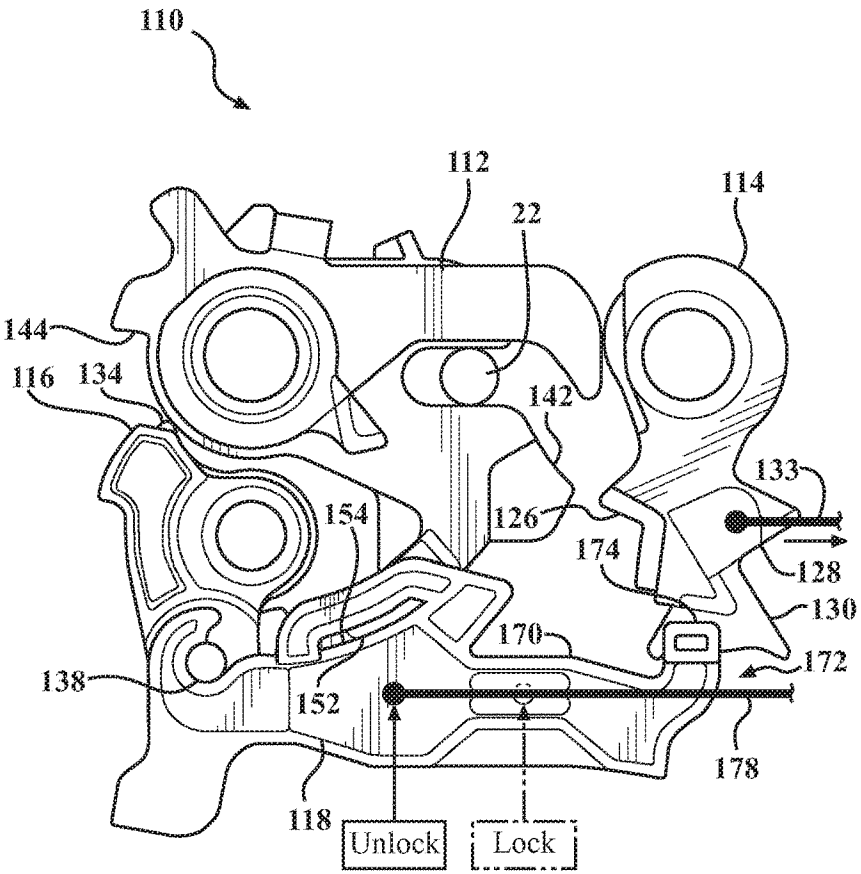
FIGS. 17A and 17B are views similar to FIGS. 16A and 16B with the double pull latch assembly shown during a first actuation of a primary pawl.
Figure 17A:
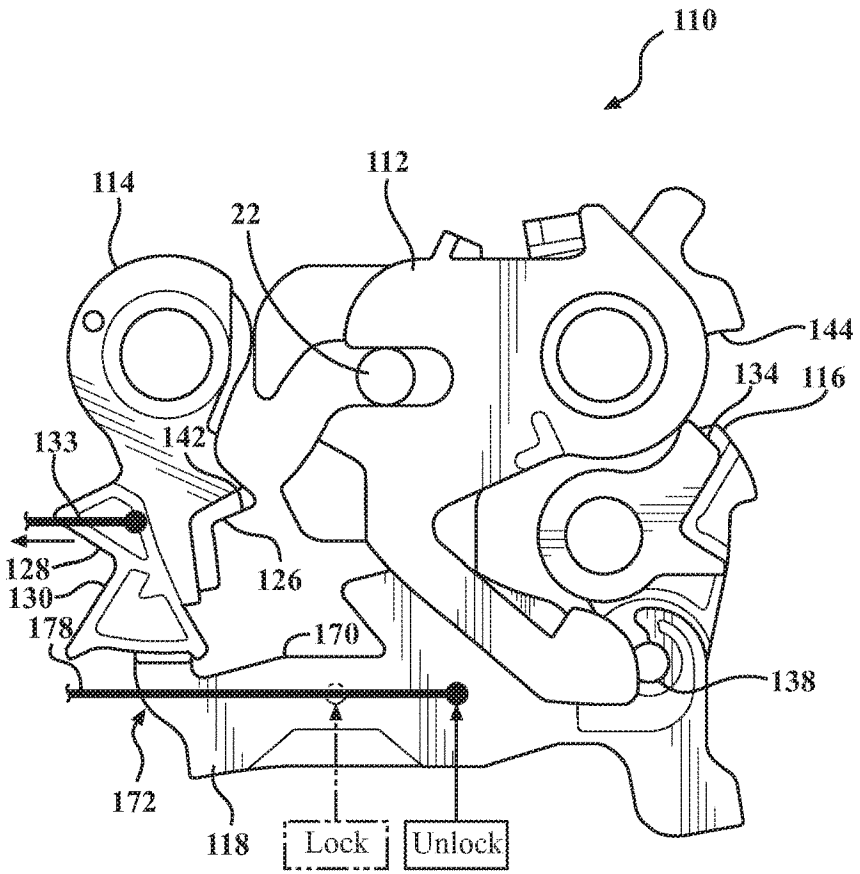

Primary pawl 114 has a primary locking surface 126 configured for selective engagement with a primary lock surface 142 of ratchet 112 and is biased toward the primary locking position via any suitable biasing member, such as a spring member, shown schematically in FIG. 16B at arrow 132.

Secondary pawl 116 has a secondary locking surface 134 biased into abutment with ratchet 112 via any suitable biasing member, such as a spring member, shown schematically in FIG. 16B at arrow 136, by way of example and without limitation. Primary pawl 114 and secondary pawl 116 form a pawl mechanism or assembly mounted in the housing and operable in a primary locking state, a secondary locking state and an unlocking state, the pawl assembly or mechanism configured in the primary locking state to hold the ratchet 112 in the primary closed position and in the secondary locking state to hold the ratchet 112 in a secondary closed position, and in the unlocking state to release the ratchet 112 from at least one of the primary closed position and secondary closed position.

Figure 18B:
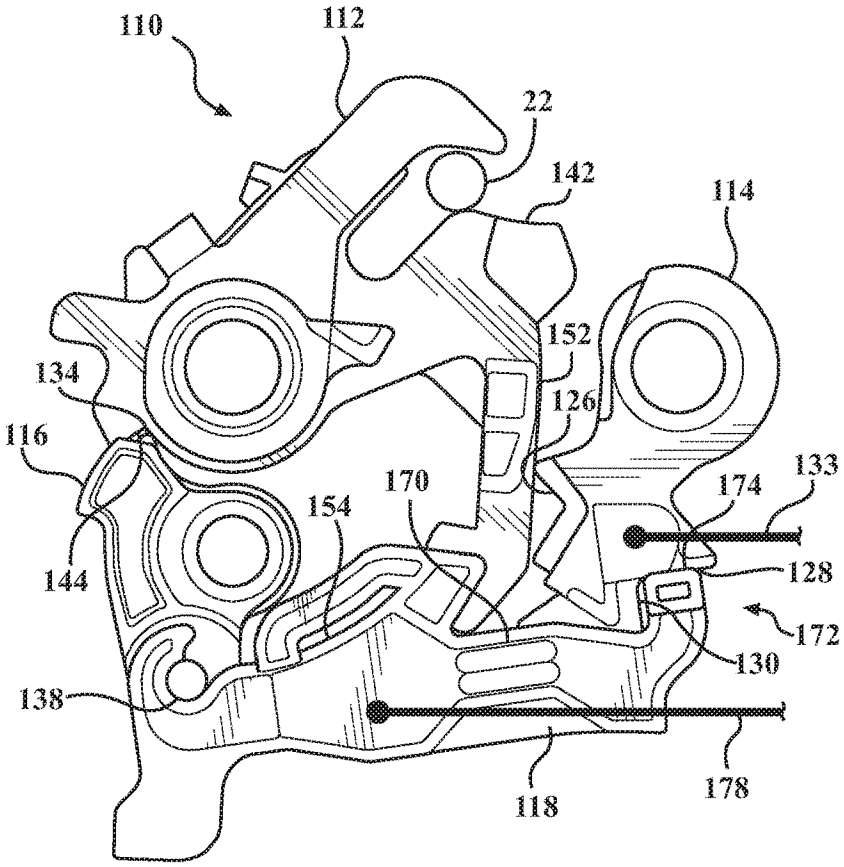
FIGS. 18A and 18B are views similar to FIGS. 17A and 17B with the double pull latch assembly shown after completion of the first actuation.
Figure 18A:
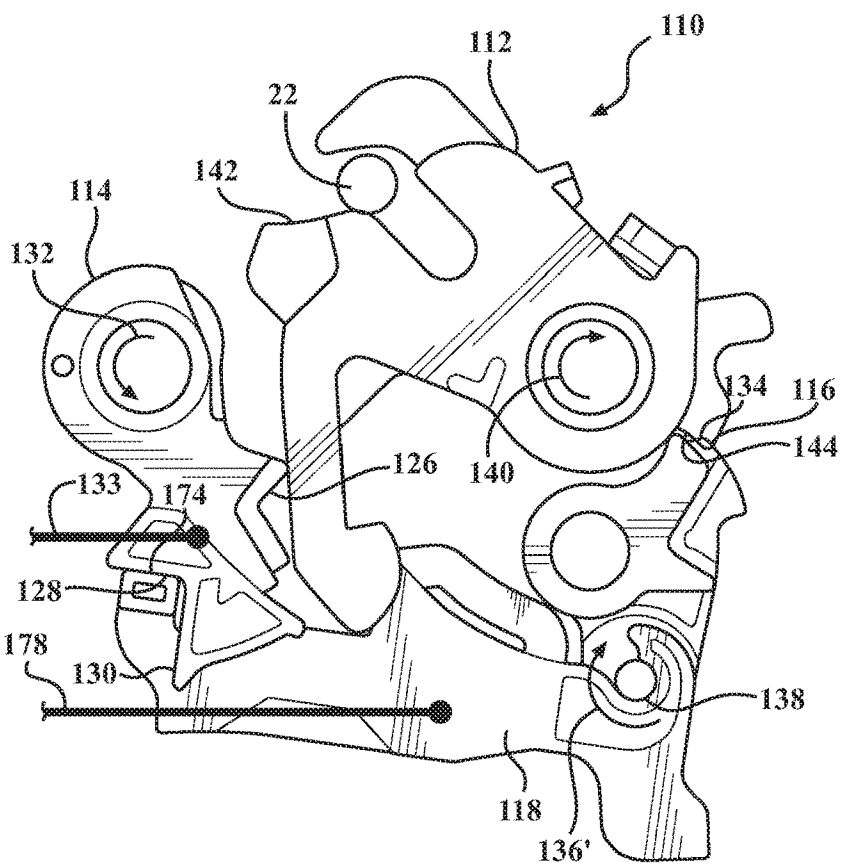

The coupling lever 118 is pivotably mounted to the secondary pawl 116 via pin 138 for movement between a disengaged position, also referred to as home position (FIGS. 16A-17B) and a connected position, also referred to as an engaged position (FIGS. 18A-19B). The coupling lever 118 is biased toward the engaged position by any suitable biasing member, and is shown as being biased schematically in the direction of arrow 136' (FIG. 18A). Coupling lever 118 extends along a generally straight portion 170 from pin 138 to a generally hook-shaped portion 172 that terminates at a free end 174. Coupling lever 118 is an illustrative example of a coupling mechanism between primary pawl 114 and secondary pawl 116.

Figure 20B:
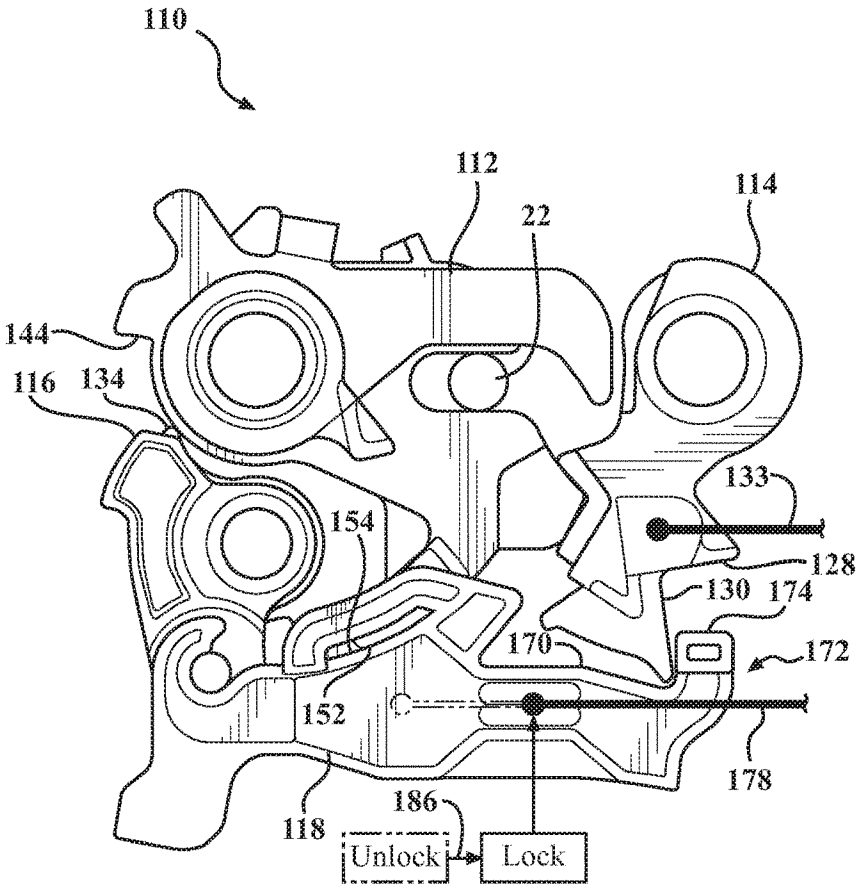
FIGS. 20A and 20B are views similar to FIGS. 16A and 16B with the double pull latch assembly shown while the vehicle is in a predetermined condition causing an actuator to move a coupling lever to a disengaged position.
Figure 20A:
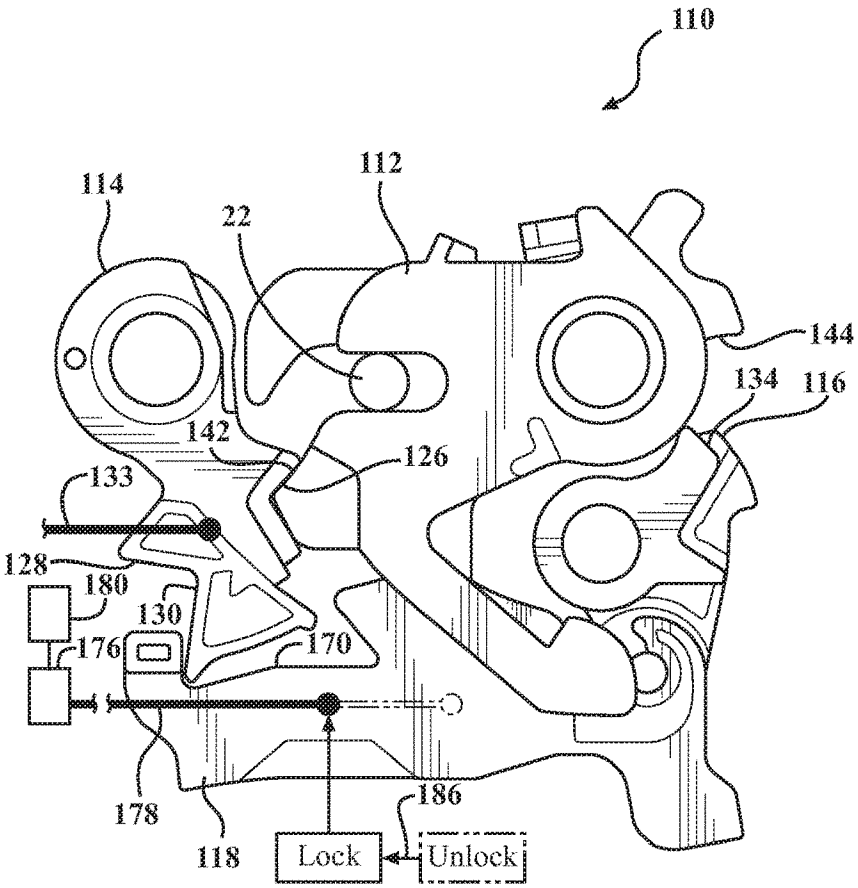
Figure 21B:
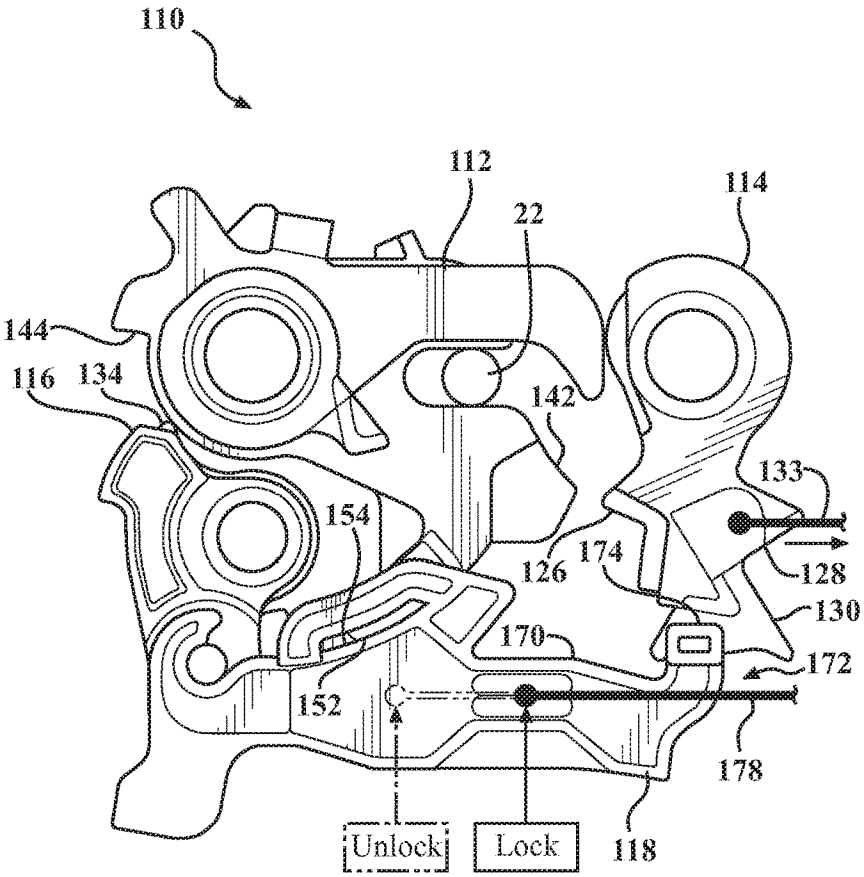
FIGS. 21A and 21B are views similar to FIGS. 20A and 20B with the double pull latch assembly shown during a first actuation of primary pawl with the coupling lever moved to the disengaged position.
Figure 21A:
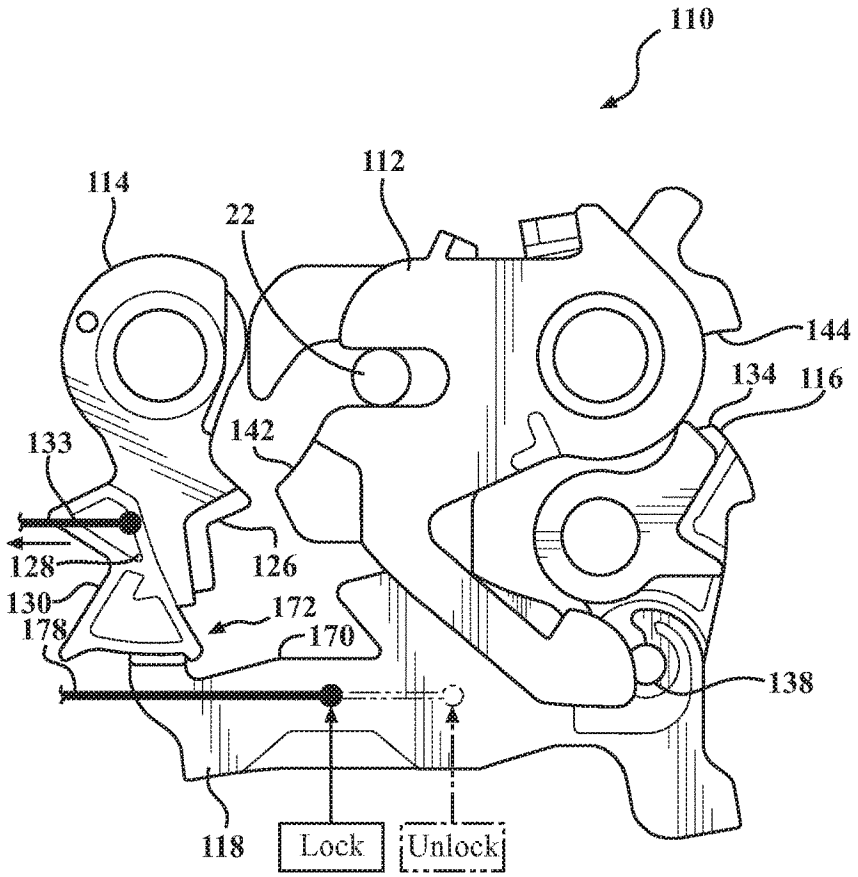
Figure 22B:
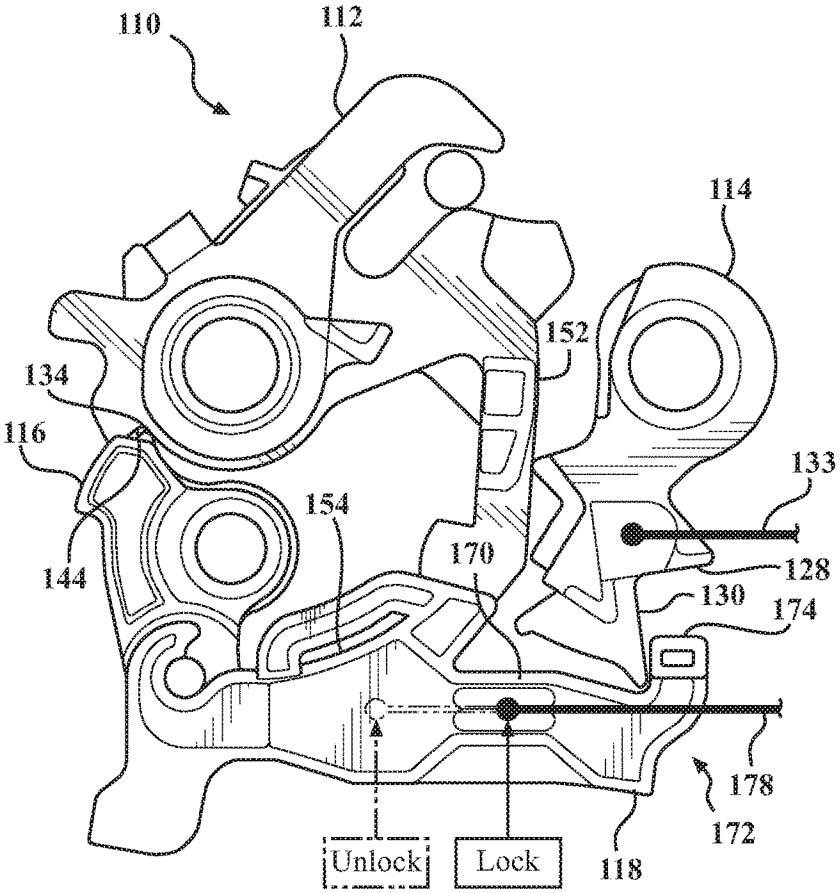
FIGS. 22A and 22B are views similar to FIGS. 21A and 21B with the double pull latch assembly shown after completion of the first actuation of the primary pawl and with a ratchet in the second closed position.
Figure 22A:
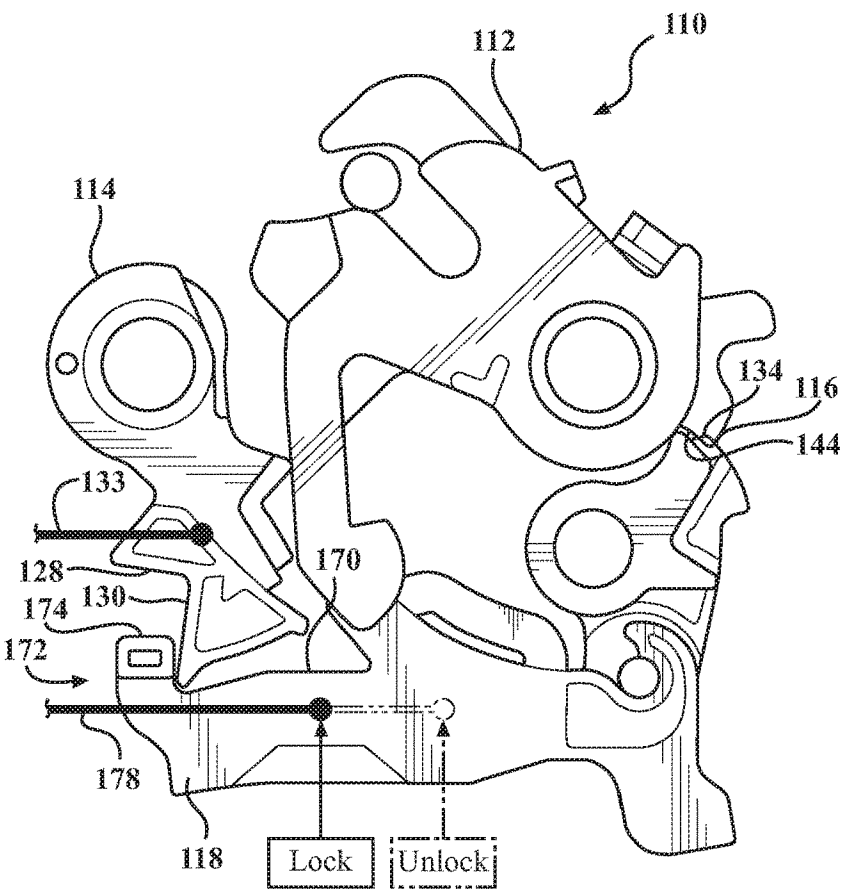
Figure 23B:
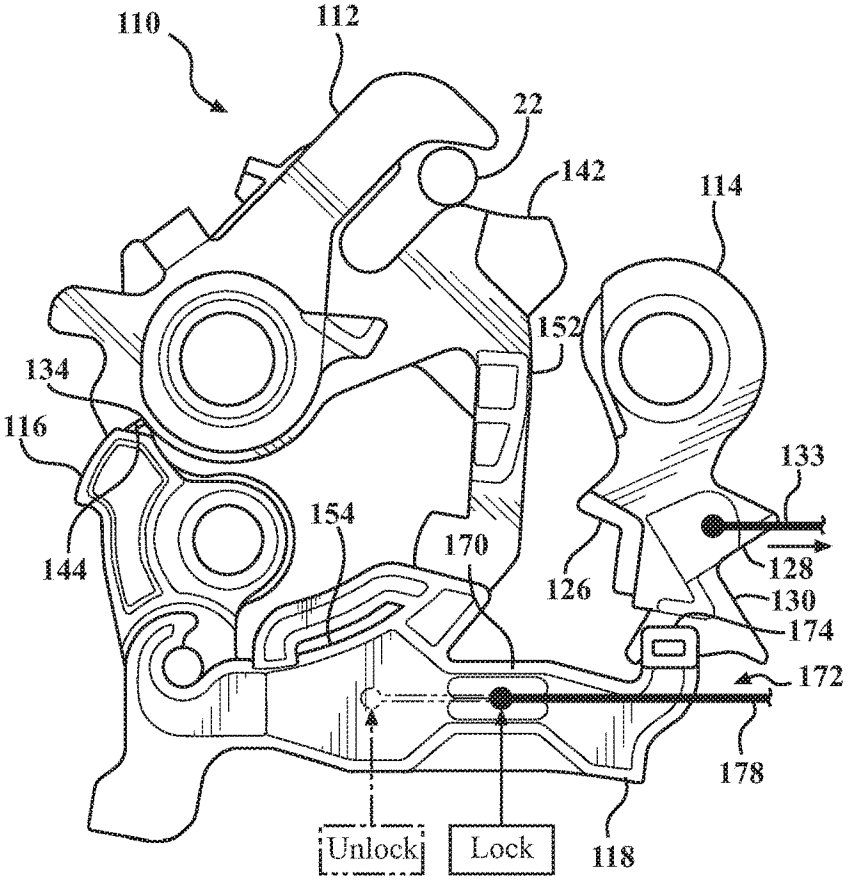
FIGS. 23A and 23B are views similar to FIGS. 22A and 22B illustrating how a second actuation of the primary pawl does not cause the release of a secondary pawl due to the coupling lever being moved to the disengaged position.
Figure 23A:
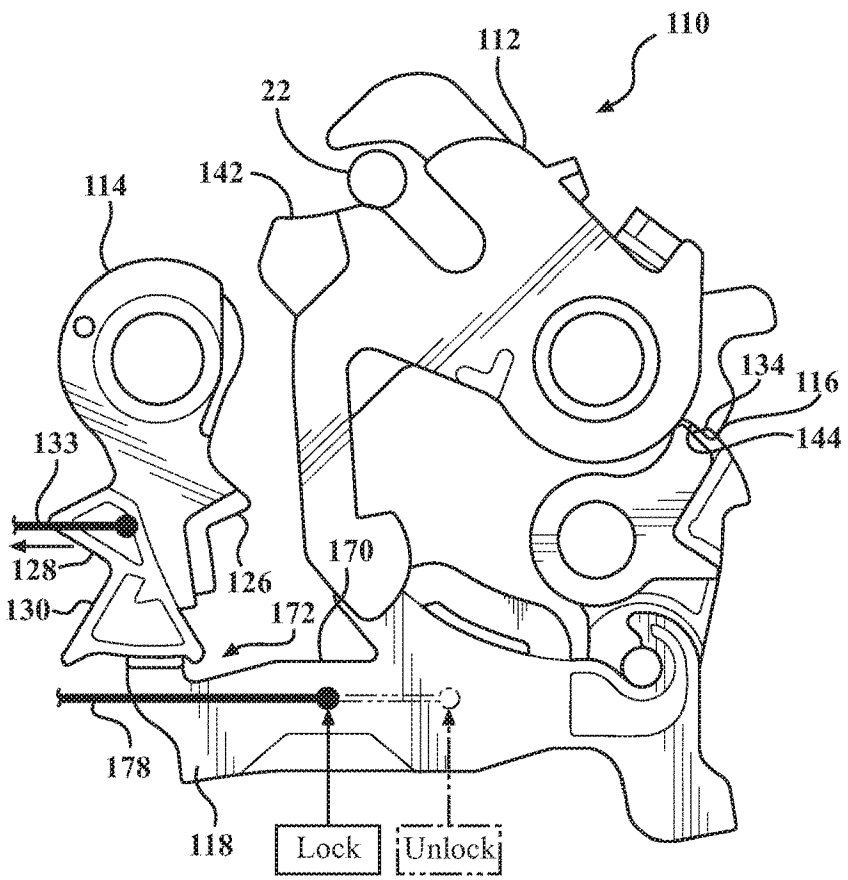

As shown schematically in FIG. 20A, an actuator 176 is operably coupled to the coupling lever 118, such as via a rod or cable 178, by way of example and without limitation. The actuator 176 is configured for communication with a sensor 180 as discussed above for actuator 76, to selectively maintain the coupling lever 118 in the home position, regardless of the position of the ratchet 112, in response to a predetermined state of the vehicle 11. It is to be recognized that the sensor 180 can be configured as discussed above for sensor 80, and thus, no further discussion is needed. It is to be recognized that the actuator 176 will return the coupling lever 118 for operable movement between the disengaged, home position and the engaged position upon the sensor 180 detecting the predetermined state no longer exists, such as the vehicle 11 slowing below a predetermined speed or the engine being turned off, by way of example and without limitation.

Figure 19B:
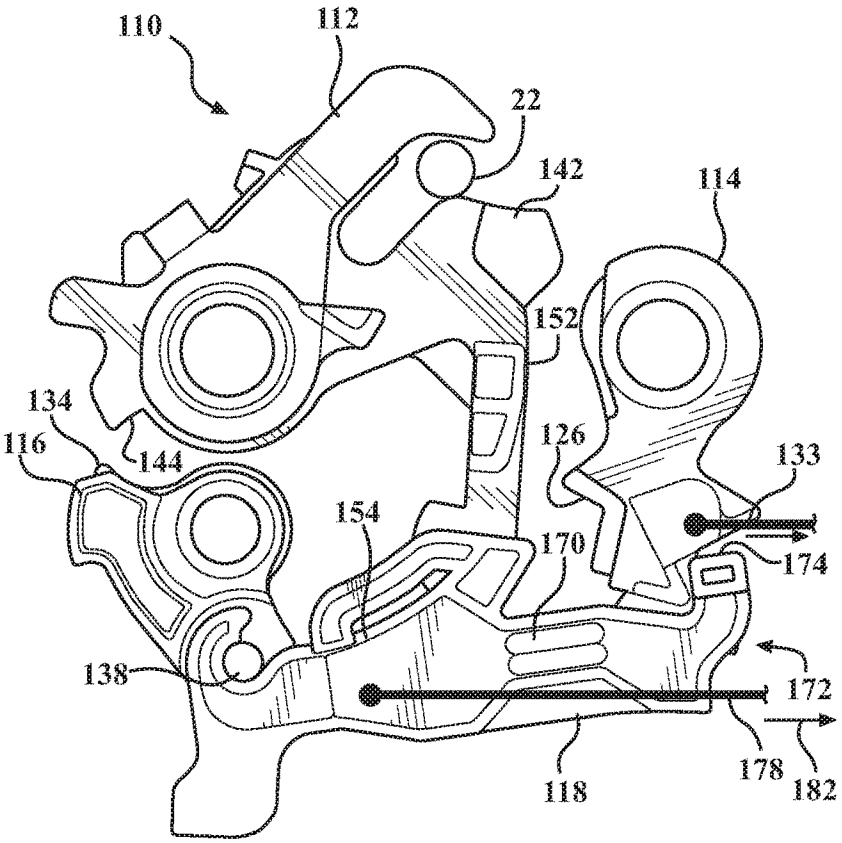
FIGS. 19A and 19B are views similar to FIGS. 17A and 17B with the double pull latch assembly shown after a second actuation of a primary pawl with the double pull latch assembly shown in a fully open position.
Figure 19A:
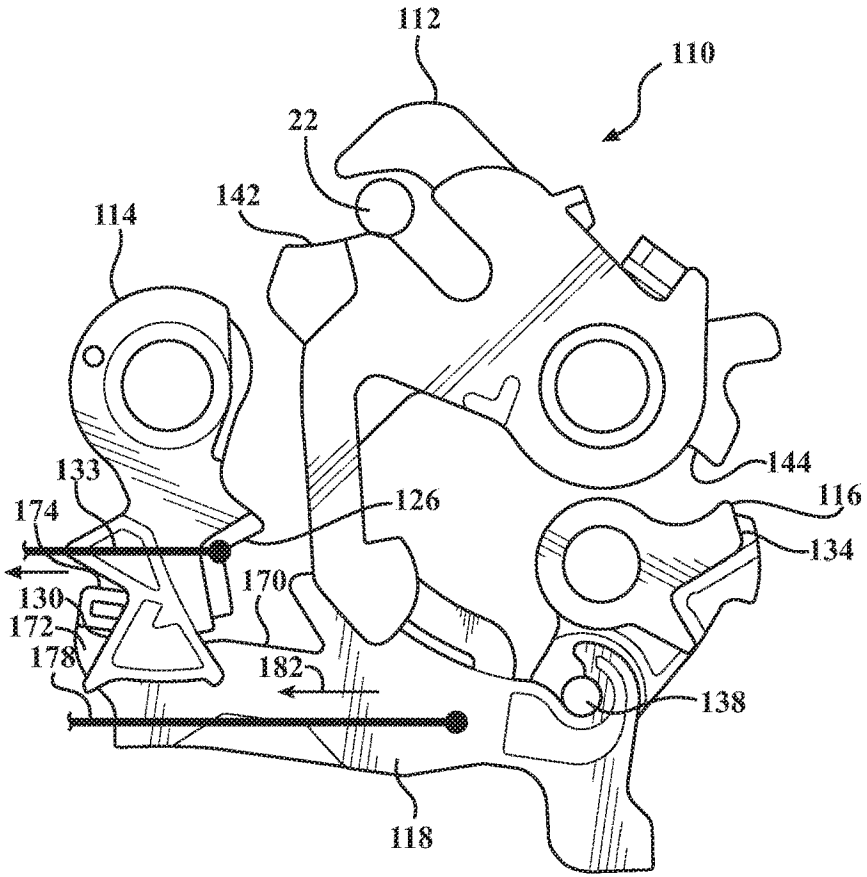

In use, in a normal release condition, with the coupling lever 118 in the home position and the ratchet 112 in the primary closed position (FIGS. 16A, 16B), movement of the primary pawl 114 from the primary locking position or state to the primary unlocking position or state (FIGS. 17A-17B) in response to a first actuation of the release member (e.g. pawl release member, such as rod or cable 133, by way of example and without limitation) causes the ratchet 112 to move from the primary closed position to the secondary closed position. During movement of the ratchet 112 to the secondary closed position or state, a holding surface 152 of ratchet 112 slides along shoulder 154 of coupling lever 118 and ultimately moves out of contact with shoulder 154, whereupon the coupling lever 118 is automatically biased by biasing member 136' to move from the home position to the engaged position. Upon the primary locking surface 126 of primary pawl 114 moving out from engagement from primary locking surface 142 of ratchet 112, a biasing member 140 (FIG. 18A) biases ratchet 112 to the secondary closed position, whereat secondary locking surface 134 of secondary pawl 116 engages secondary locking surface 144 of ratchet 112 to releasably maintain the ratchet 112 in the secondary closed position. Upon performing a first actuation of primary pawl 114, primary pawl 114 is biased by a biasing member 132 (FIGS. 16A, 18A) to return to its home primary locking position whereupon a second stop surface 128 of primary pawl 114 confronts and abuts free end 174 of coupling lever 118, thereby holding the coupling lever 118 in the engaged position (FIGS. 18A, 18B). Then, when desired to fully release latch 110, repeated actuation of the primary pawl 114 is performed, such as via a second actuation of actuation device 35 inside the passenger compartment 37, causing movement of the primary pawl 114 to the primary unlocking position in response to a second actuation of the release member, whereupon a drive surface 130 of primary pawl 114 engages the hook-shaped portion 172 of the coupling lever 118 immediately adjacent free end 174 and moves the coupling lever 118 in translation generally along a direction indicated by arrow 182 (FIGS. 19A, 19B). With coupling lever 118 moved in the direction of arrow 182, the secondary pawl 116 is caused to pivot out from the secondary locking position to the secondary unlocking position, whereupon secondary locking surfaces 134, 144 move out of engagement from one another, whereupon ratchet 112 is caused to move under the bias of biasing member 140 from the secondary closed position to the open position (similarly as shown in FIGS. 6A, 6B). At this time, hood 13 may be moved to a fully open position. The above is performed in normal course of use, and in a normal mode of operation of the latch 110 without a predetermined condition having been met, such as the engine running or exceeding a predetermined speed, by way of example and without limitation, by actuation of the latch 110 from within the passenger compartment 37 via actuation device 35.

Now, when latch 110 is desired to be unlatched from within trunk 17 by a person locked with trunk 17 to allow the hood 13 to be opened, without a predetermined condition having been met the latch 110 operating in a normal mode, such as engine not running or the vehicle not exceeding a predetermined speed, by way of example and without limitation, the person only need actuate auxiliary release member 56. Selective actuation of auxiliary release member 56 causes release member 133 to act on and pivot primary pawl 114, which allows the ratchet 112 to move from the primary closed position to the secondary closed position, as discussed above. Accordingly, release member 133 can be operable to actuate latch 110 via auxiliary release member 56 and actuation device 35 via incorporation of an actuation member splitter box 57 (FIG. 1), such that release member 133 is both actuatable via actuation device 35 and auxiliary release member 56. Upon actuating auxiliary release member 56, the primary locking surface 126 of primary pawl 114 is moved out from engagement from primary locking surface 142 and simultaneously the coupling lever 118 is moved in translation along the direction of arrow 182 to pivot the secondary pawl 116 from the secondary locking position to the secondary unlocking position, whereupon ratchet 112 is caused to move under the bias of biasing member 140 directly from the primary closed position to the open position. At this time, hood 13 may be moved to a fully open position.

As discussed above, a predetermined condition can be implemented to prevent unwanted release of the ratchet 112 to the fully open position, thereby preventing the unwanted and/or unsafe opening of hood 13. In both a normal unlatching mode performed from within the passenger compartment 37 and in an emergency unlatching mode performed from within the trunk 17, if the predetermined condition has been met, the ratchet 112 can be caused to move from the primary closed position to the secondary closed position, but not to the fully open position. With reference to FIGS. 20A-23B, a normal mode of unlatching the latch 110 from within the passenger compartment 37 is shown, wherein the predetermined condition is met, such as engine running or vehicle traveling in excess of a predetermined speed (e.g. 5 km/h), by way of example and without limitation. Upon the predetermined condition being met, sensor 180 signals actuator 176 to move cable or rod 178 within coupling lever 118 in the direction of arrow 186 (FIGS. 20A, 20B), whereupon coupling lever 118 is maintained in the disengaged, home position or state under the tension or force applied by cable/rod 178 on coupling lever 118 as long as the predetermined condition exists. Accordingly, the bias imparted by biasing member 136' is overcome by cable/rod 178, thereby preventing the coupling lever 118 from moving toward the engaged position. With this, it is to be recognized that the coupling lever 118 can be released such that it can move from the disengaged, home position or state to the engaged position or state via actuator 176 returning the cable/rod 178 from the illustrated lock position to the illustrated unlock position upon the predetermined condition no longer existing there by shifting the latch 110 from a safety mode to a normal mode of operation in accordance with an illustrative example. Upon being maintained in the disengaged, home position, the coupling lever 118 is maintained out from potential contact with primary pawl 114. As such, movement of the primary pawl 114 from the primary locking position or state to the primary unlocking position or state (FIGS. 21A-21B) in response to a first actuation of the release member 133 causes the ratchet 112 to move from the primary closed position to the secondary closed position. However, it can be seen in FIGS. 23A, 23B that with the coupling lever 118 maintained in the disengaged, home position, a second actuation of primary pawl 114 fails to cause ratchet 112 to move from the secondary closed position, due to the hook-portion 172 of coupling lever 118 being maintained out of potential contact from drive surface 130 of primary pawl 114. Accordingly, the hood 13 is prevented from being able to open as long as the predetermined condition is met.

When latch 110 is desired to be unlatched from within trunk 17 by a person locked with trunk 17 to allow the hood 13 to be partially opened, with the latch 110 operating in a safety mode and the predetermined condition having been met, such as engine running or exceeding a predetermined speed, by way of example and without limitation, the person only need actuate auxiliary release member 56. Selective actuation of auxiliary release member 56 causes release member 133, via activation of intermediary release member 133*a*, acting on splitter box 57 as shown in FIG. 1, to act on and pivot primary pawl 114, which allows the primary locking surface 126 of primary pawl 114 to be moved out from engagement from primary locking surface 142, whereupon ratchet 112 is caused to move under the bias of biasing member 140 from the primary closed position to the secondary closed position. At this time, hood 13 may be moved to a partially opened position and maintained in the partially opened position, thereby safely allowing air into the trunk 17 or frunk 17 and allowing the person within the trunk 17 or frunk 17 to voice outwardly therefrom, thereby being able to attract attention, and without the hood 13 allowed to move from the partially opened position to a fully opened position. Further yet, as described above, upon the predetermined condition no longer existing, as sensed by sensor 180, the coupling lever 118 can be returned to the engaged position with the latch 110 operating in a normal mode to allow a second actuation of auxiliary release member 56 to cause the ratchet 112 to move to the fully open position, thereby allowing the hood 13 to be opened. In the event power is not available for the actuator 176 to maintain the latch 110 in a safety mode of operation, coupling lever 118 may be moved from the disengaged position (lock) to the engaged position (unlock) under influence of biasing member 136' to thereby shift by default the latch 110 into a normal mode of operation.

Referring to FIGS. 24A-26B, a latch 210 constructed in accordance with another aspect of the disclosure for incorporation into motor vehicle 11 is shown, wherein the same reference numerals as used above for latch 10, offset by a factor of 200, are used to identify like features. Latch 210 includes a ratchet 212, a primary pawl 214, a secondary pawl 216, and a coupling link, also referred to as coupling lever 218. The ratchet 212 is movable between a primary closed position (FIGS. 24A-25B), a secondary closed position (FIGS. 26A, 26B) and an open position (similarly as shown in FIGS. 6A, 6B) in response to selective movement of the primary and secondary pawls 214, 216. The pivotal movement and function of the ratchet 212 is as discussed above for ratchet 12 and 112, and thus, further discussion is believed unnecessary.

Figure 24B:
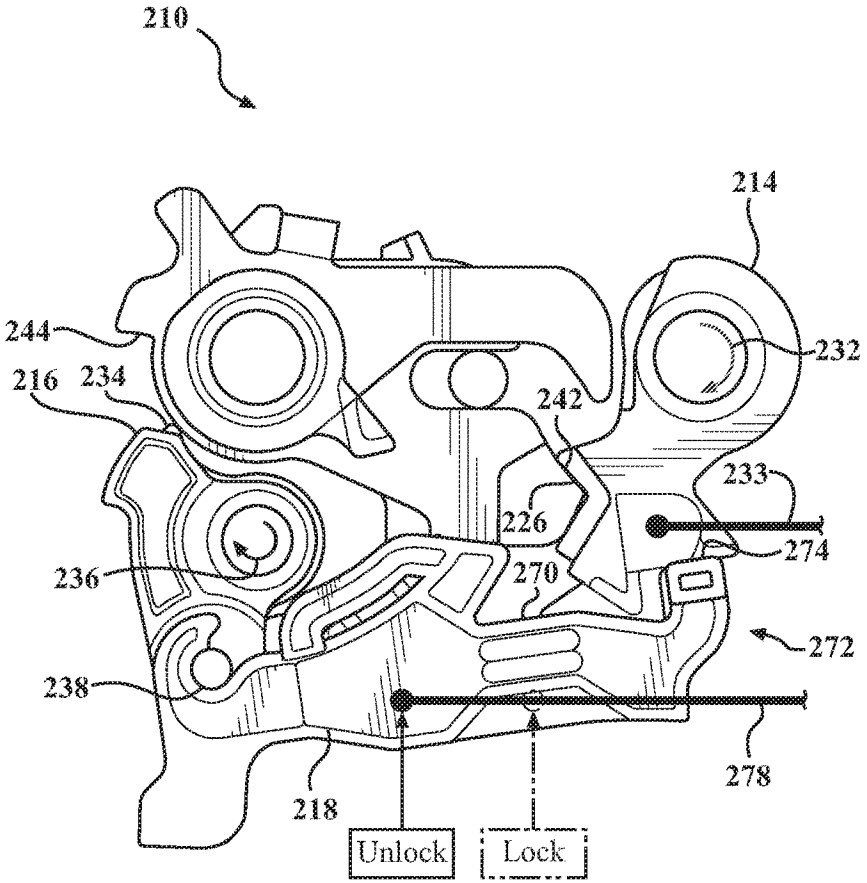
FIGS. 24A and 24B are opposite side views of a double pull latch assembly associated with the vehicle shown in FIG. 1 shown in a fully latched position and constructed according to another aspect of the present disclosure.

Primary pawl 214 has a primary locking surface 226 configured for selective engagement with a primary lock surface 242 of ratchet 212 and is biased toward the primary locking position via any suitable biasing member, such as a spring member, shown schematically in FIG. 24B at arrow 232.

Figure 24A:
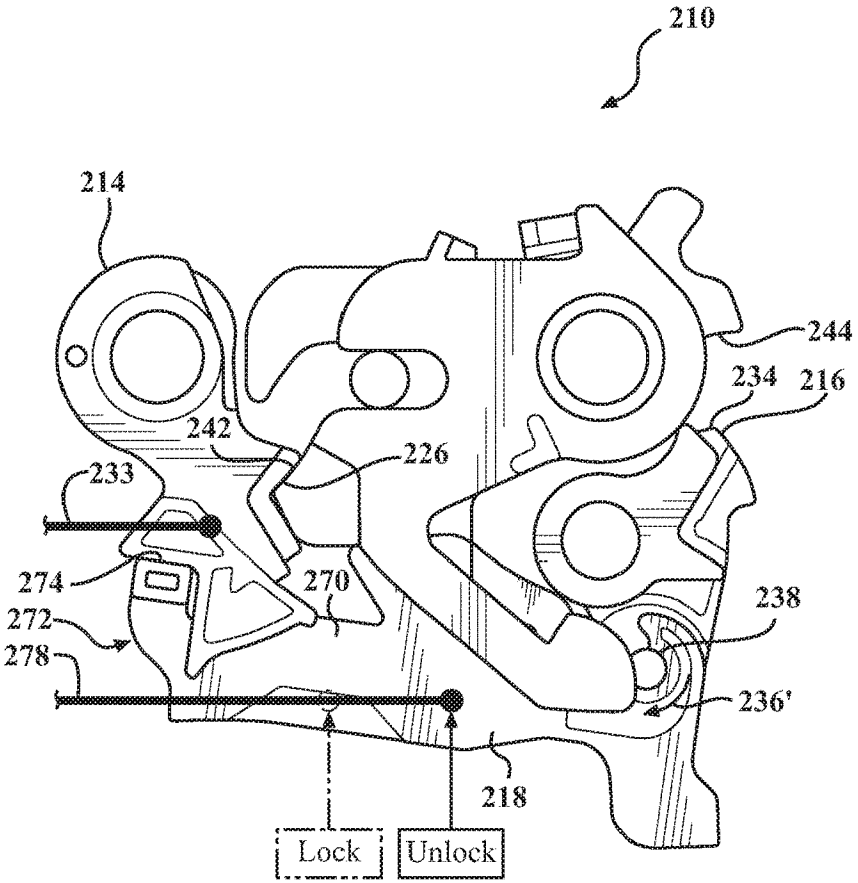
Figure 25B:
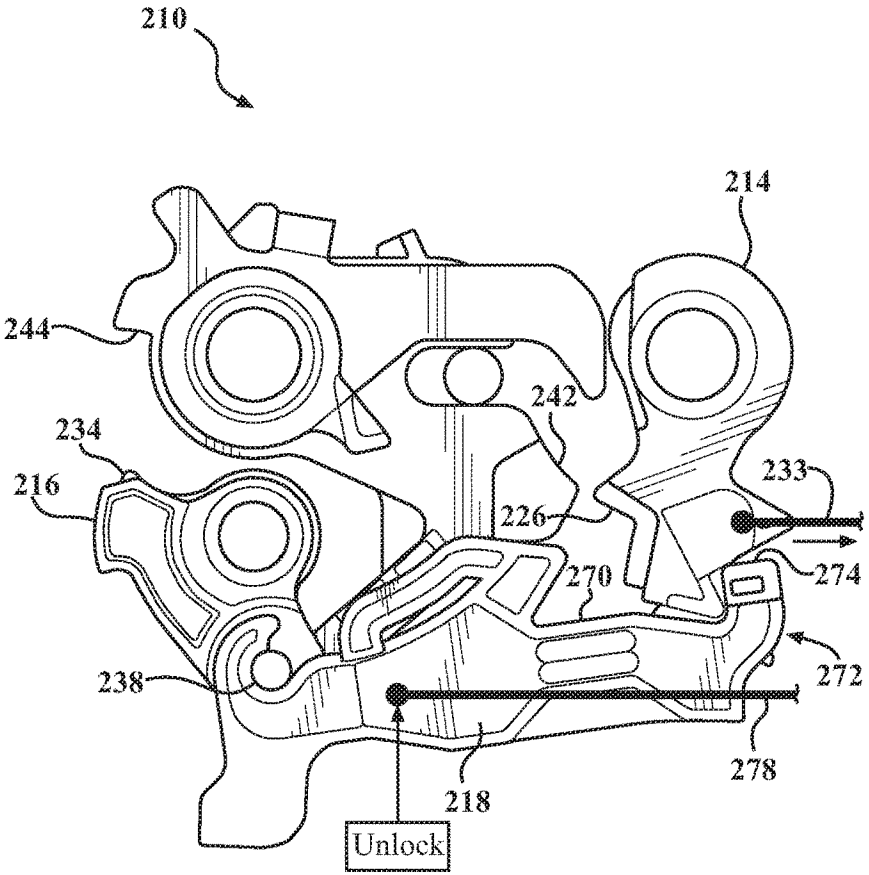
FIGS. 25A and 25B are views similar to FIGS. 24A and 24B with the double pull latch assembly shown during a first actuation of a primary pawl and a secondary pawl.
Figure 25A:
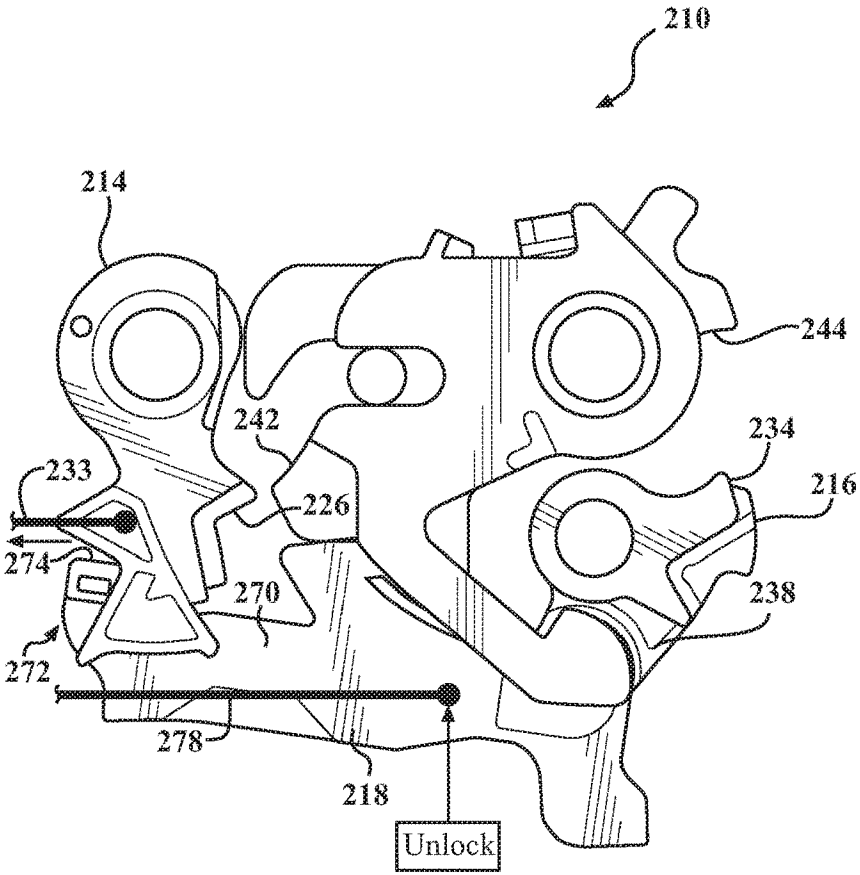
Figure 26B:
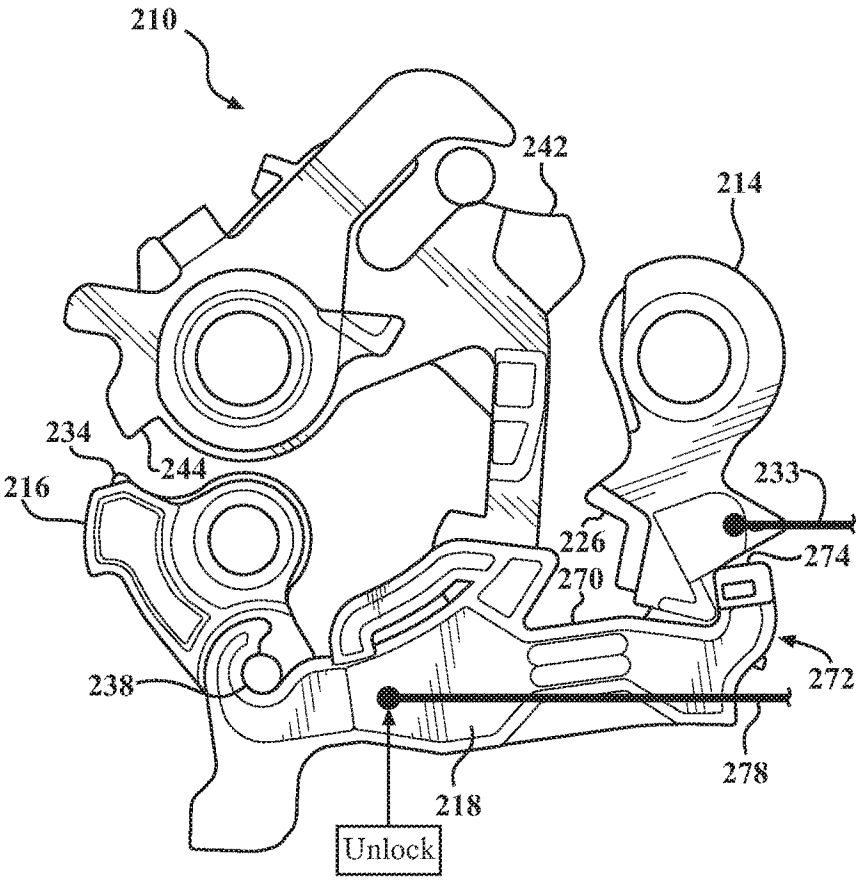
FIGS. 26A and 26B are views similar to FIGS. 25A and 25B with the double pull latch assembly shown after completion of the first actuation with the double pull latch assembly shown in a fully open position.
Figure 26A:
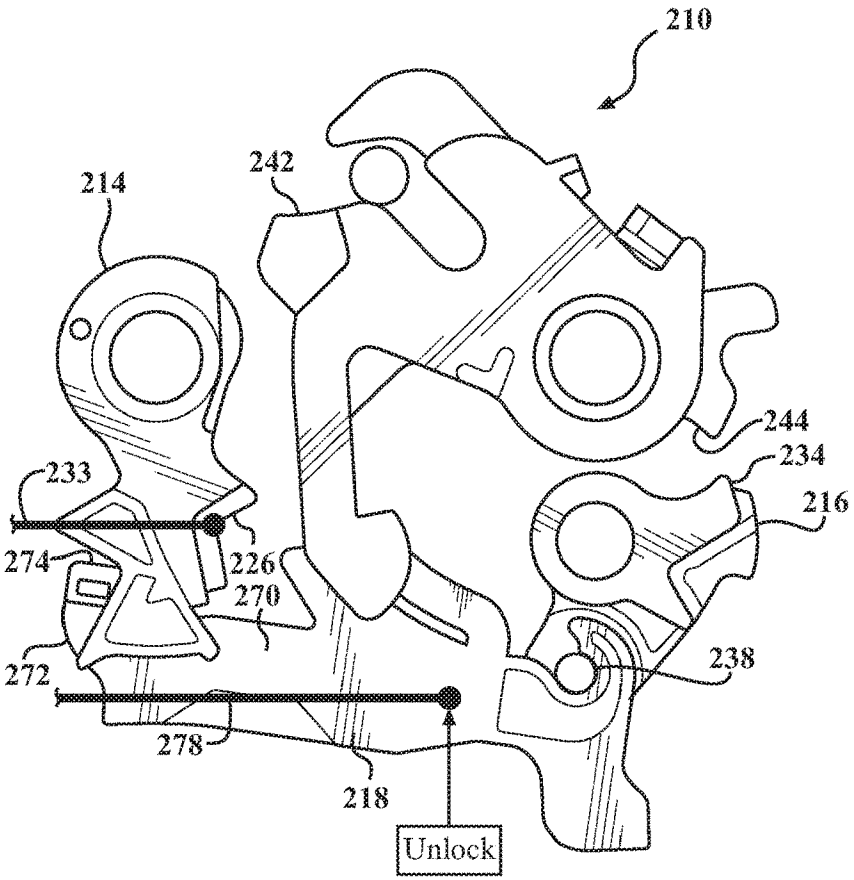
Figure 27B:
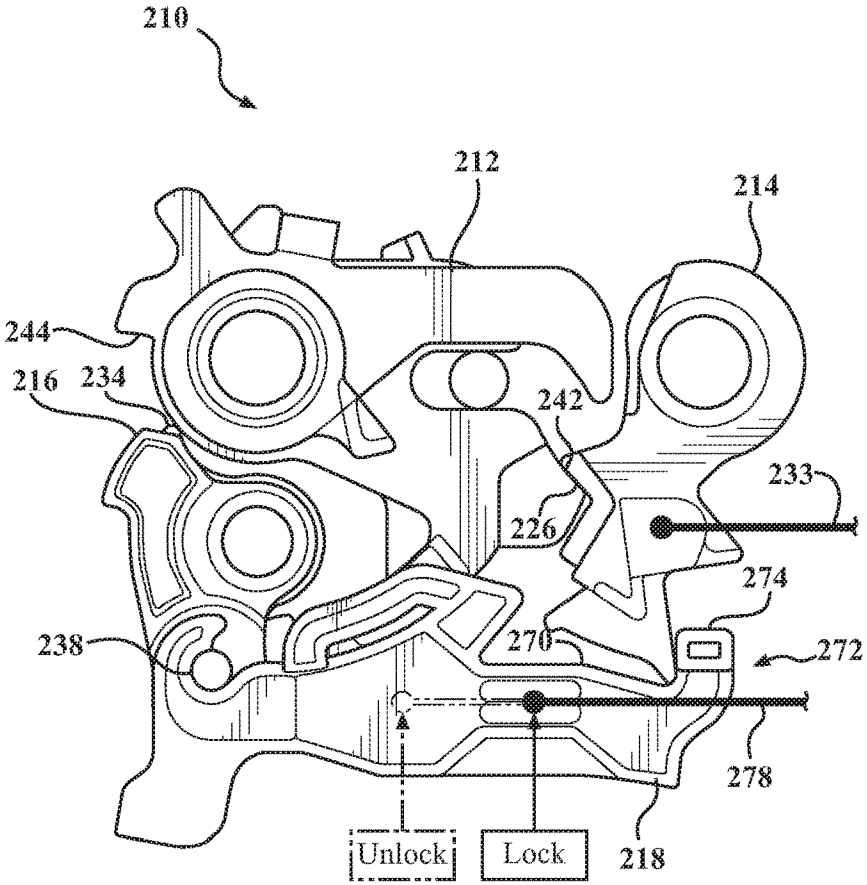
FIGS. 27A and 27B are views similar to FIGS. 20A and 20B of the double pull latch assembly of FIGS. 24A-25B shown while the vehicle is in a predetermined condition causing an actuator to move a coupling lever to a disengaged position.
Figure 27A:
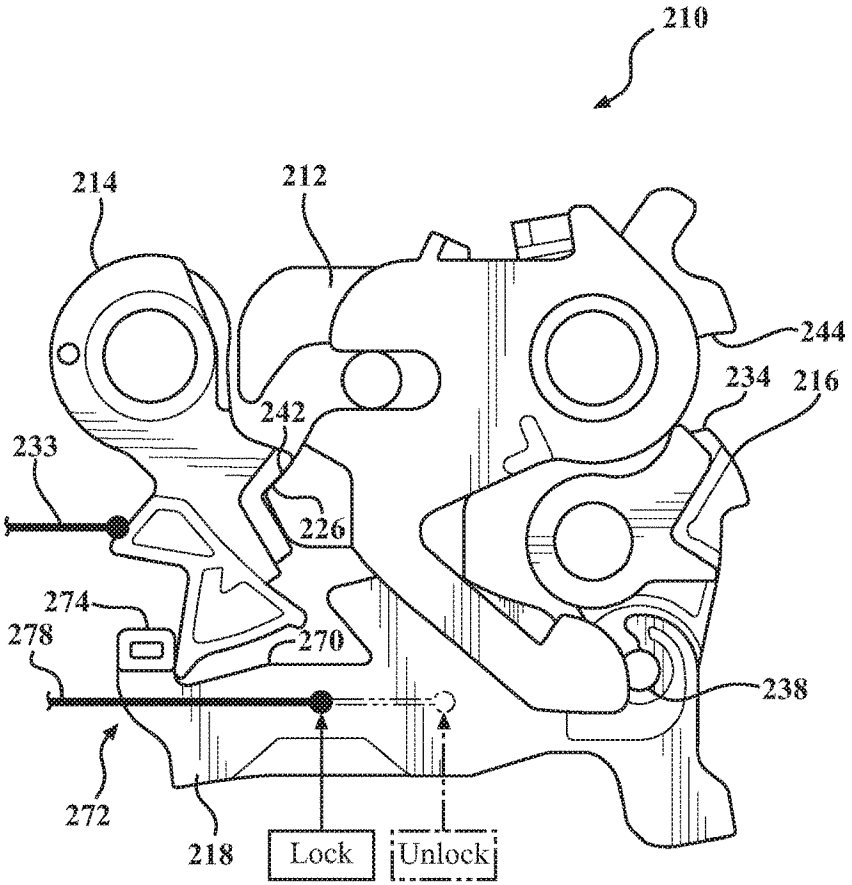

Secondary pawl 216 has a secondary locking surface 234 biased into abutment with a secondary locking surface 244 of ratchet 212 via any suitable biasing member, such as a spring member, shown schematically in FIG. 24A at arrow 236', by way of example and without limitation. Primary pawl 214 and secondary pawl 216 illustratively form a pawl assembly mounted in the housing and operable in a primary locking state, a secondary locking state and an unlocking state, the pawl assembly configured in the primary locking state to hold the ratchet 212 in the primary closed position and in the secondary locking state to hold the ratchet 212 in a secondary closed position, and in the unlocking state to release the ratchet 212 from at least one of the primary closed position and secondary closed position.

The coupling lever 218 is pivotably mounted to the secondary pawl 216 via pin 238 for selective movement between a disconnected position, also referred to as disengaged position (FIGS. 27A-30B) and a connected position, also referred to as an engaged position (FIGS. 24A-26B). The coupling lever 218 is biased toward the engaged position by any suitable biasing member, and is shown as being biased schematically in the direction of arrow 236' (FIG. 24A). Coupling lever 218 is the same as coupling lever 118 and extends along a generally straight portion 270 from pin 238 to a generally hook-shaped portion 272 that terminates at a free end 274.

Figure 28B:
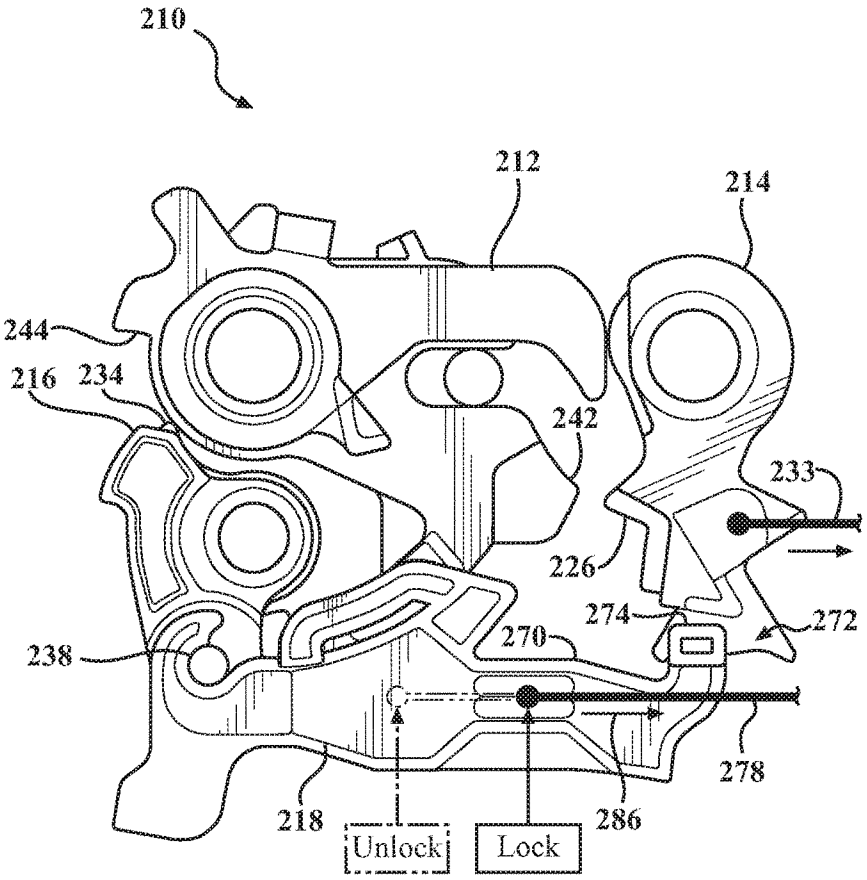
FIGS. 28A and 28B are views similar to FIGS. 21A and 21B of the double pull latch assembly of FIGS. 24A-25B shown during a first actuation of primary pawl with the coupling lever moved to the disengaged position.
Figure 28A:
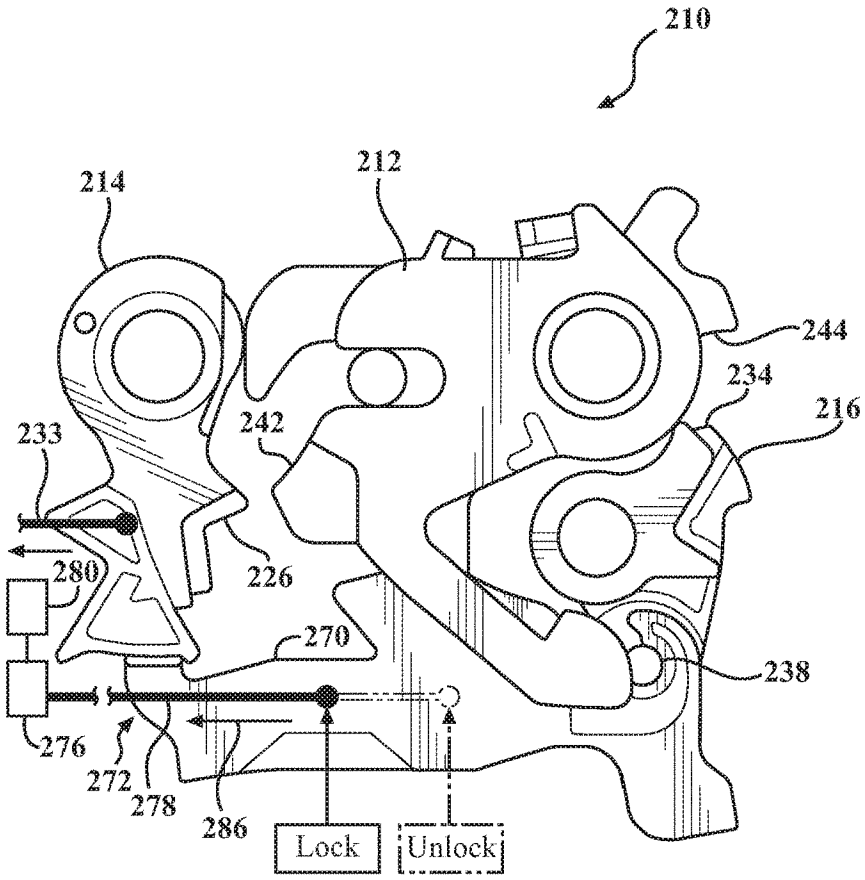
Figure 29B:
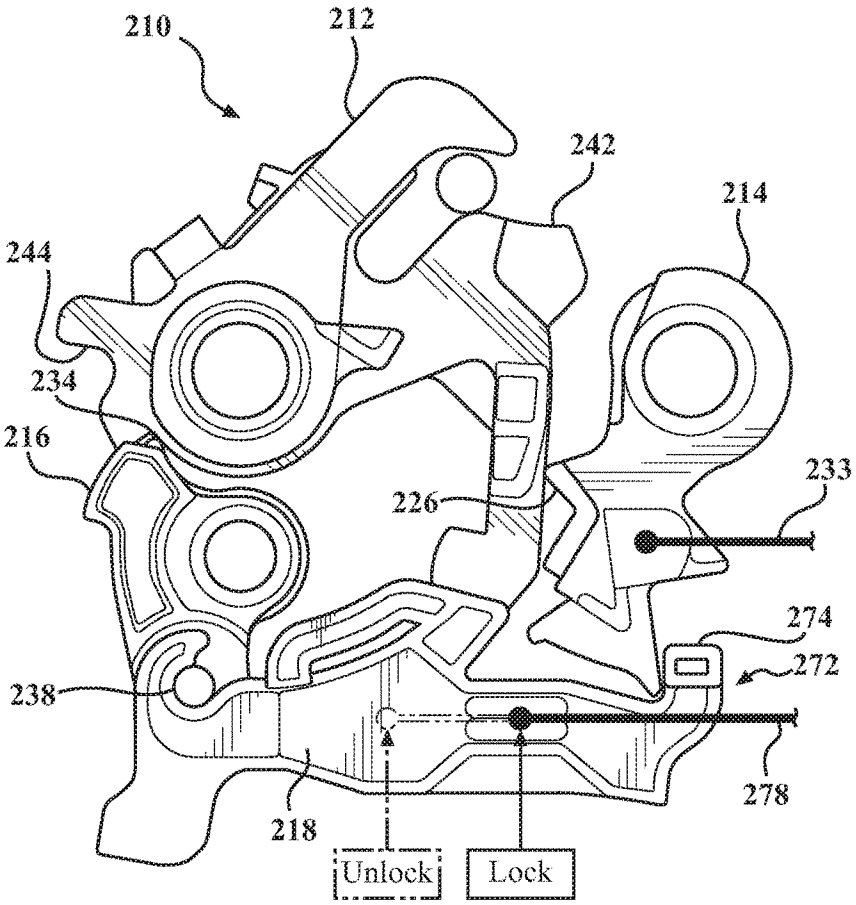
FIGS. 29A and 29B are views similar to FIGS. 22A and 22B of the double pull latch assembly of FIGS. 24A-25B shown after completion of the first actuation of the primary pawl and with a ratchet in the second closed position.
Figure 29A:
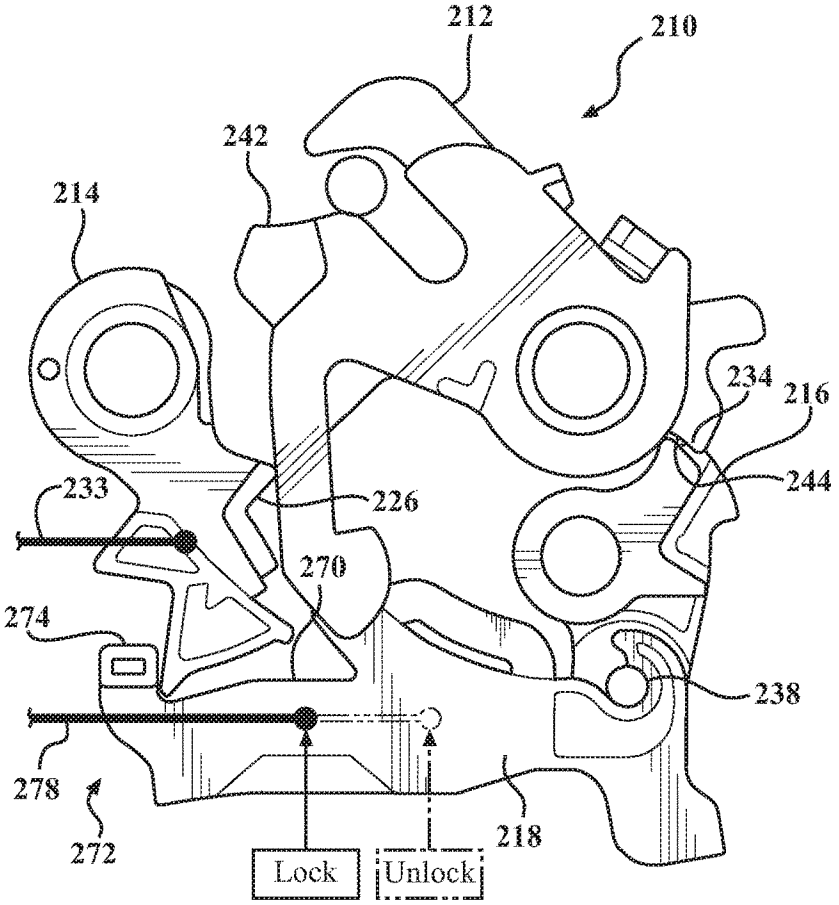
Figure 30B:
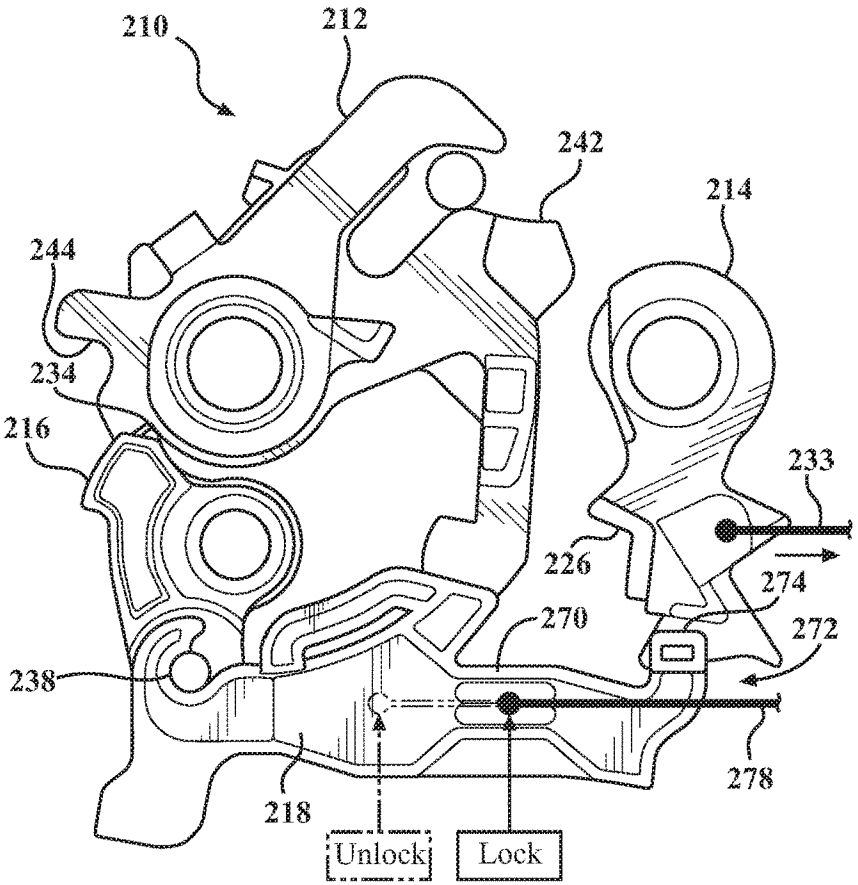
FIGS. 30A and 30B are views similar to FIGS. 23A and 23B of the double pull latch assembly of FIGS. 24A-25B illustrating how a second actuation of the primary pawl does not cause the release of a secondary pawl due to the coupling lever being moved to the disengaged position.
Figure 30A:
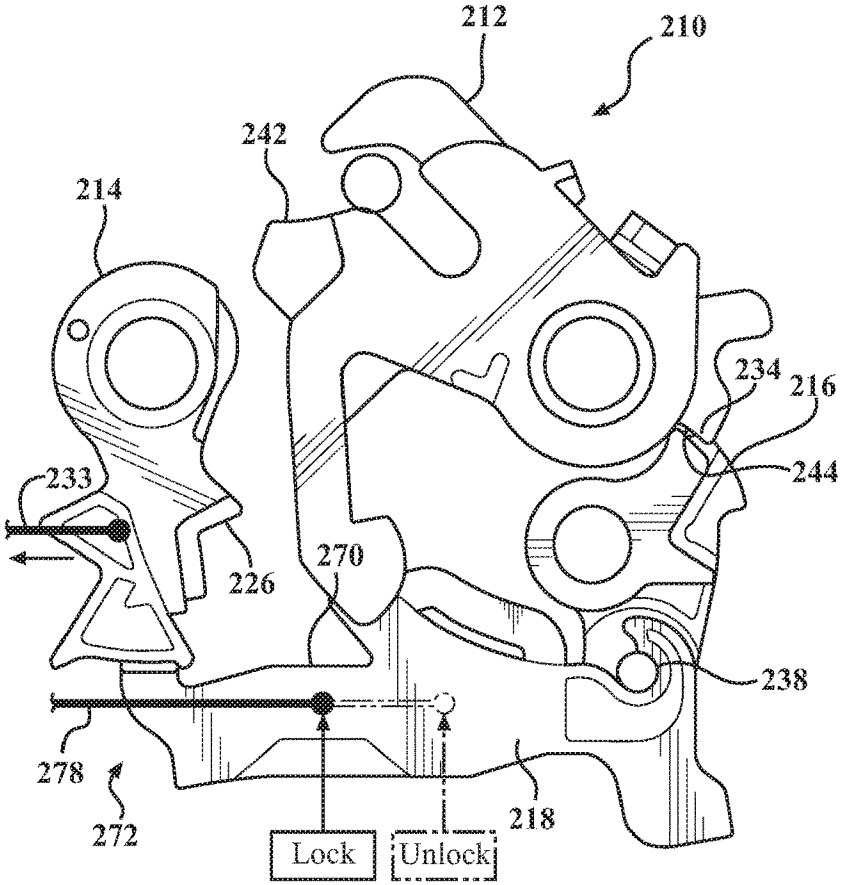

As shown schematically in FIG. 28A, an actuator 276 is operably coupled to the coupling lever 218, such as via a rod or cable 278, by way of example and without limitation. The actuator 276 is configured for communication with a sensor 280 as discussed above for actuator 76, 176 to selectively move the coupling lever 218 from the engaged position (FIGS. 24A-26B) against the bias imparted by biasing member 236' to the disengaged position (FIGS. 27A-30B), regardless of the position of the ratchet 212, in response to a predetermined state of the vehicle 11. It is to be recognized that the sensor 280 can be configured as discussed above for sensor 80, and thus, no further discussion is believed necessary. It is to be recognized that the actuator 276 will return the coupling lever 218 for operable movement to the engaged position upon the sensor 280 detecting the predetermined state no longer exists, such as the vehicle 11 slowing below a predetermined speed or the engine being turned off, by way of example and without limitation. Accordingly, the main difference between latch 110 and 210 is with regard to the normal operating position of the coupling lever 218, with the coupling lever 218 of latch 210 being normally maintained in the engaged position.

With the coupling lever 218 of latch 210 being normally maintained in the engaged position, a single pull actuation of latch 210 can be achieved and a rapid and simple escape of an entrapped person from the trunk 17 or trunk 17 is possible. As such, in use, in a normal release condition, with the coupling lever 218 in the engaged position and the ratchet 212 in the primary closed position (FIGS. 24A, 24B), movement of the primary pawl 214 from the primary locking position to the primary unlocking position (FIGS. 25A-25B) in response to a first actuation of the release member (e.g. pawl release member, such as rod or cable 133, by way of example and without limitation) causes the ratchet 212 to move from the primary closed position to the open position. Accordingly, the primary locking surface 226 of primary pawl 214 moves out from engagement from primary locking surface 242 of ratchet 212 and the secondary locking surface 234 of secondary pawl 216 moves from engagement with secondary locking surface 244 of ratchet 212, whereupon ratchet 212 is caused to move under the bias of biasing member 240 to the open position (similarly as shown in FIGS. 6A, 6B) via a single pull actuation. At this time, hood 13 may be moved to a fully open position. The above is performed in normal course of use, for example with the latch 210 operating in a normal mode without a predetermined condition having been met, such as engine not running or not exceeding a predetermined speed, by way of example and without limitation, by actuation of the latch 210 from within the passenger compartment 37 via actuation device 35, or from within the trunk 17 or frunk 17 by actuation of auxiliary release member 56.

As discussed above, a predetermined condition can be implemented to prevent unwanted release of the ratchet 212 to the fully open position, thereby preventing the unwanted and/or unsafe opening of hood 13, for example which may be desirable when the vehicle 11 is in motion for example and without limitation. In both a normal unlatching mode performed from within the passenger compartment 37 and in an emergency unlatching mode performed from within the trunk 17, if the predetermined condition has been met, the ratchet 212 can be caused to move from the primary closed position to the secondary closed position, but not to the fully open position. With reference to FIGS. 27A-30B, a normal mode of unlatching the latch 210 from within the passenger compartment 37 is shown, wherein the predetermined condition is met, such as engine running or vehicle traveling in excess of a predetermined speed (e.g. 5 km/h), by way of example and without limitation. Upon the predetermined condition being met, sensor 280 signals actuator 276 to move cable or rod 278 within coupling lever 218 in the direction of arrow 286 (FIGS. 28A, 28B), whereupon coupling lever 218 is moved from the engaged position (unlock) to the disengaged position (lock) under the tension or force applied by cable/rod 278 on coupling lever 218 as long as the predetermined condition exists, and thereby shifting the latch 210 into a safety mode of operation. Accordingly, the bias imparted by biasing member 236' is overcome by cable/rod 278, thereby preventing the coupling lever 218 from moving to the engaged position. With this, it is to be recognized that the coupling lever 218 can be released such that it can return from the disengaged position to the engaged position via actuator 276 releasing the cable/rod 278 from the illustrated lock position to the illustrated unlock position upon the predetermined condition no longer existing. The bias imparted by biasing member 236' can facilitate the return of cable/rod 278 from the illustrated lock position to the illustrated unlock position and coupling lever 218 to the engaged position. Upon being moved to the disengaged position, the coupling lever 218 is maintained out from potential contact with primary pawl 214, as discussed above for coupling lever 118. As such, movement of the primary pawl 214 from the primary locking position to the primary unlocking position (FIGS. 28A-28B) in response to a first actuation of the release member 133 causes the ratchet 212 to move from the primary closed position to the secondary closed position. However, it can be seen in FIGS. 30A and 30B that with the coupling lever 218 moved to the disengaged position, the secondary pawl 216 remains engaged with ratchet 212 during the first actuation, and further yet, a second actuation of primary pawl 214 fails to cause ratchet 212 to move from the secondary closed position to the open position, due to the hook-portion 272 of coupling lever 218 being maintained out of potential contact from drive surface 230 of primary pawl 214. Accordingly, the latch 210 is prevented from being able to be moved to the open position, and thus, hood 13 is prevented from being able to open as long as the predetermined condition is met.

When latch 210 is desired to be unlatched from within trunk 17 by a person locked with trunk 17 to allow the hood 13 to be partially opened, with the predetermined condition having been met, such as engine running or exceeding a predetermined speed, by way of example and without limitation, the person only need actuate auxiliary release member 56, as discussed above for latch 110. Selective actuation of auxiliary release member 56 causes release member 233, via splitter box 57, to act on and pivot primary pawl 214, which allows the primary locking surface 226 of primary pawl 214 to be moved out from engagement from primary locking surface 242, whereupon ratchet 212 is caused to move under the bias of biasing member 240 from the primary closed position to the secondary closed position; however, the secondary pawl 216 remains engaged with ratchet 212 during the first actuation and during any subsequent actuations as a result of the coupling lever 218 being disengaged from potential communication with primary pawl 214. As such, upon performing the first actuation, hood 13 may be moved to a partially opened position, thereby allowing air into the trunk 17 and allowing the person within the trunk 17 to voice outwardly therefrom, thereby being able to attract attention, without the trunk 17 or trunk 17 being able to move to an opened position. Further yet, as described above, upon the predetermined condition no longer existing, as sensed by sensor 280, the latch 210 may be shifted to a normal mode of operation, for example the coupling lever 218 can be returned to the engaged position under the influence of biasing member 236' to allow actuation of auxiliary release member 56 to cause the ratchet 212 to move to the fully open position, thereby allowing the hood 13 to be opened. In the event power is not available for the actuator 276 to maintain the latch 210 into a safety mode of operation, coupling lever 218 is moved from the disengaged position (lock) to the engaged position (lock) under influence of biasing member 236' to thereby shift by default the latch 210 into a normal mode of operation.

Figure 31B:
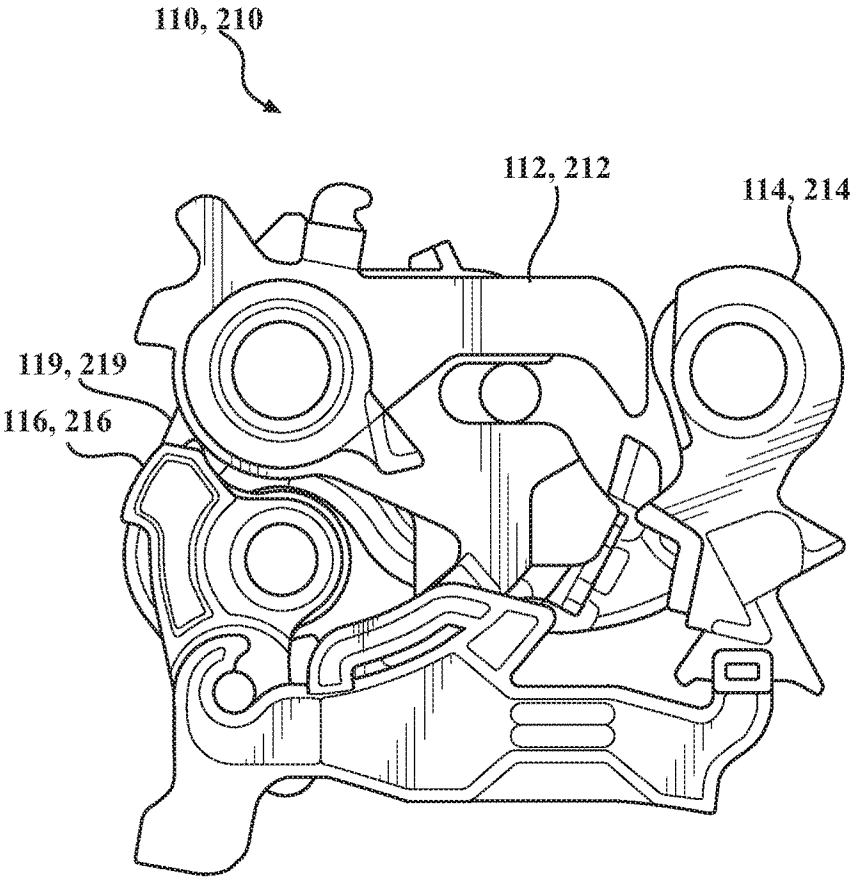
FIGS. 31A and 31B are opposite side views of a double pull latch assembly, such as discussed for FIGS. 16A, 16B and 24A, 24B, illustrating an auxiliary release lever configured for selective actuation of the latch from within and/or external from a stowage compartment, including from outside the vehicle, in accordance with another aspect of the disclosure.
Figure 31A:
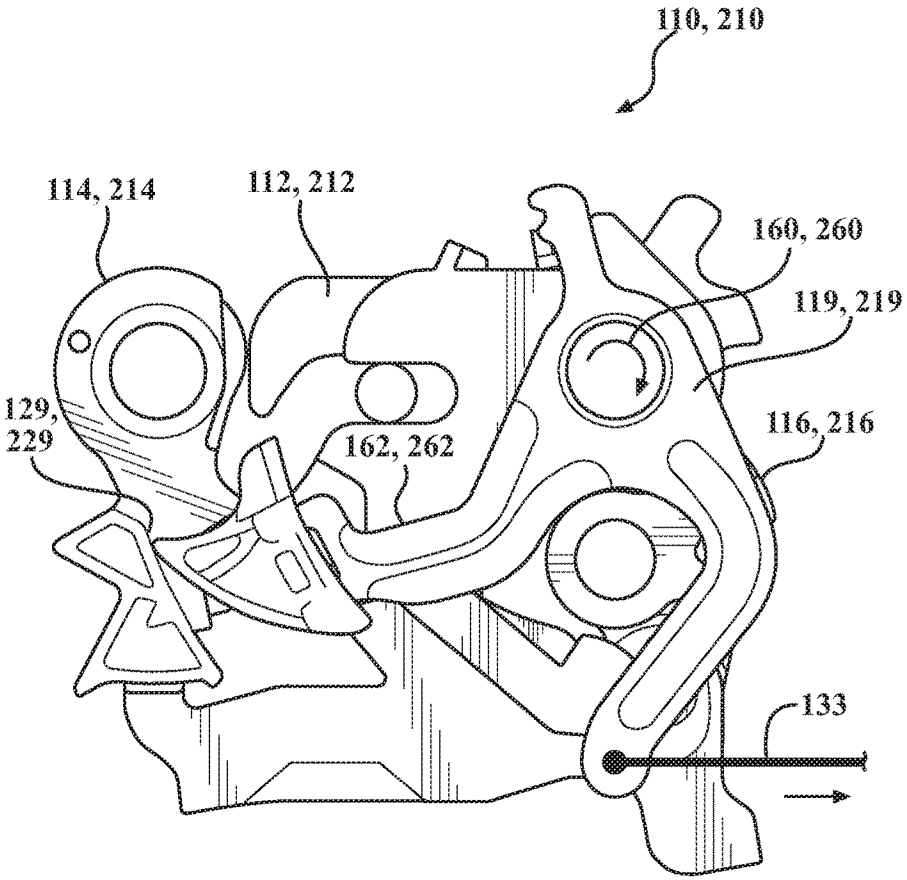

Now referring to FIGS. 31A-31B, an emergency or auxiliary release lever 119, 219 can be configured for selective actuation of the latch 110, 210 from within a stowage compartment (e.g. trunk 17 or frunk 17) or from outside the vehicle 11 via an actuation device accessible from the outside, such as within a grill region or wheel well region, by way of example and without limitation, in accordance with another aspect of the disclosure. The auxiliary release lever 119, 219 can be configured for attachment to the auxiliary release member (shown schematically at 56 in FIG. 1) within the trunk 17, such as via cable/rod 133 and via splitter box 57. The auxiliary release lever 119, 219 is mounted for pivoting movement about an axis, shown as the same axis as ratchet 112, 212, by way of example and without limitation, between a released position and an actuated position in response to selective actuation of the auxiliary release member 56. Auxiliary release lever 119, 219 is biased toward the released position, such as via any suitable biasing member, including a spring member, shown schematically at 160, 260. Auxiliary release lever 119, 219 has an elongate drive arm 162, 262 extending into operable camming engagement with a driven member 129, 229 of primary pawl 114, 214. As discussed above for latch 110, auxiliary release lever 119 can be actuated from within trunk 17 via selective actuation of auxiliary release member 56, wherein upon the predetermined condition not being met and the latch 210 operating in a normal mode, the ratchet 112 of latch 110 can be moved from the primary closed position to the secondary closed position, wherein secondary pawl 116 remains locked with ratchet 112, and then from the secondary closed position to the open position in a double pull actuation process, and wherein upon the predetermined condition being met and the latch 210 operating in a safety mode, the ratchet 112 of latch 110 can be moved from the primary closed position to the secondary closed position, but not to the open position until the predetermined condition no longer exists. As further discussed above for latch 210, auxiliary release lever 219 can be actuated from within trunk 17 via selective actuation of auxiliary release member 56, wherein upon the predetermined condition not being met and the latch 210 operating in a safety mode, the ratchet 212 of latch 210 can be moved from the primary closed position to the open position in a single pull actuation process, such that both primary pawl 214 and secondary pawl 216 release from locking engagement with ratchet 212, and wherein upon the predetermined condition being met and the latch 210 operating in a normal mode, the ratchet 212 of latch 210 can be moved from the primary closed position to the secondary closed position, wherein secondary pawl 216 remains in locking engagement with ratchet 212, but is not moveable to the open position until the predetermined condition is absent.

Figure 31E:
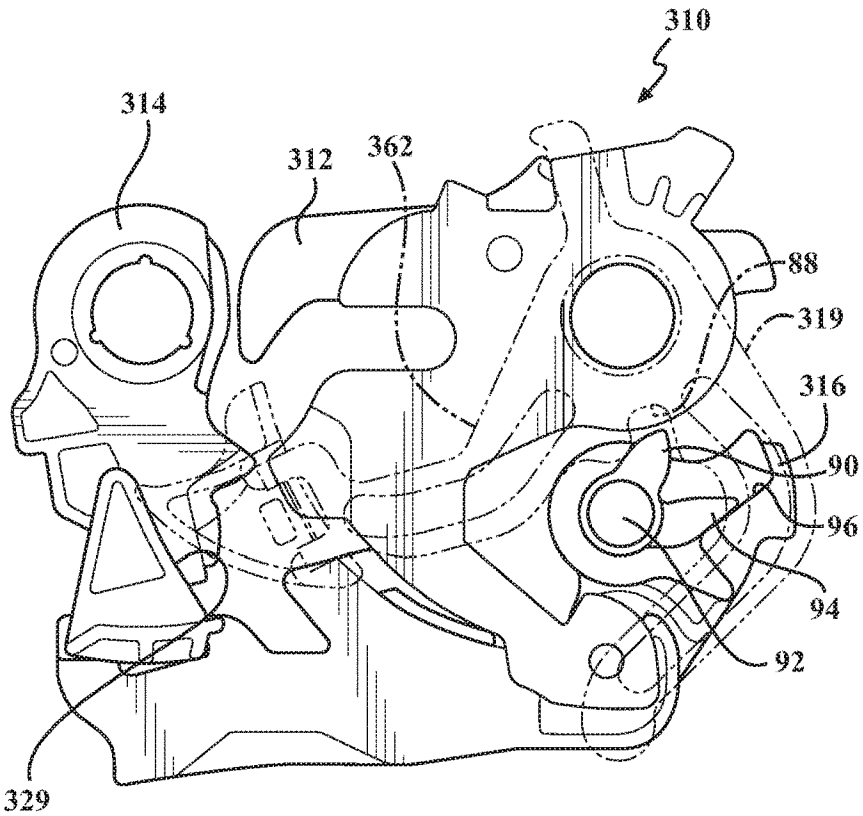
FIG. 31E is a side view of the double pull latch assembly of FIG. 31C illustrating the auxiliary release lever in an actuated state.
Figure 31C:
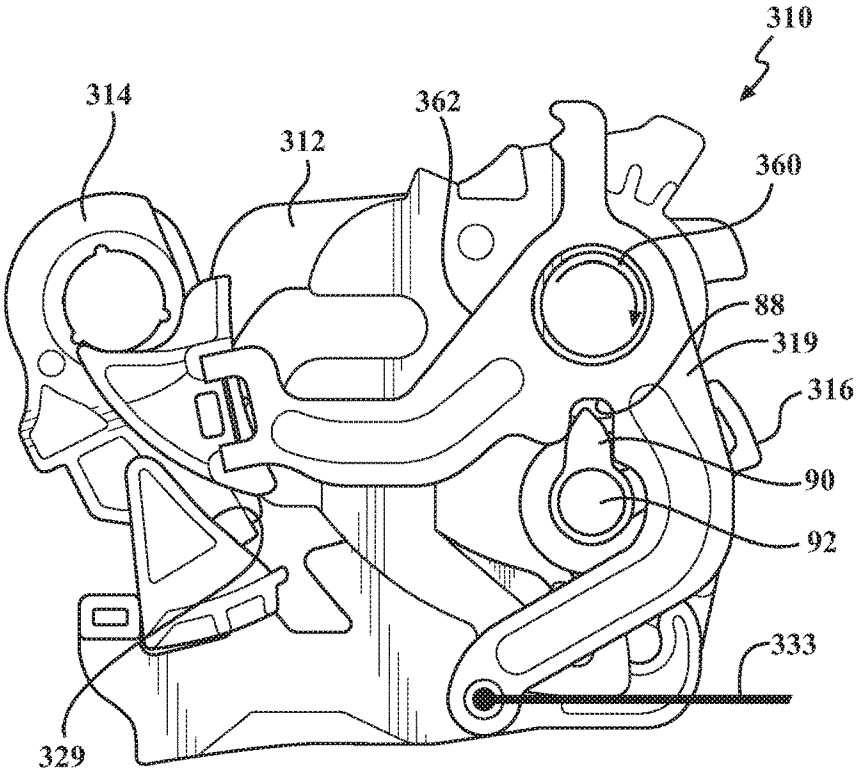
FIG. 31C is a side view of a double pull latch assembly, such as discussed for FIGS. 16A, 16B and 24A, 24B, illustrating an auxiliary release lever configured for selective actuation of the latch from within and/or external from a stowage compartment, including from outside the vehicle, in accordance with yet another aspect of the disclosure.
Figure 31D:
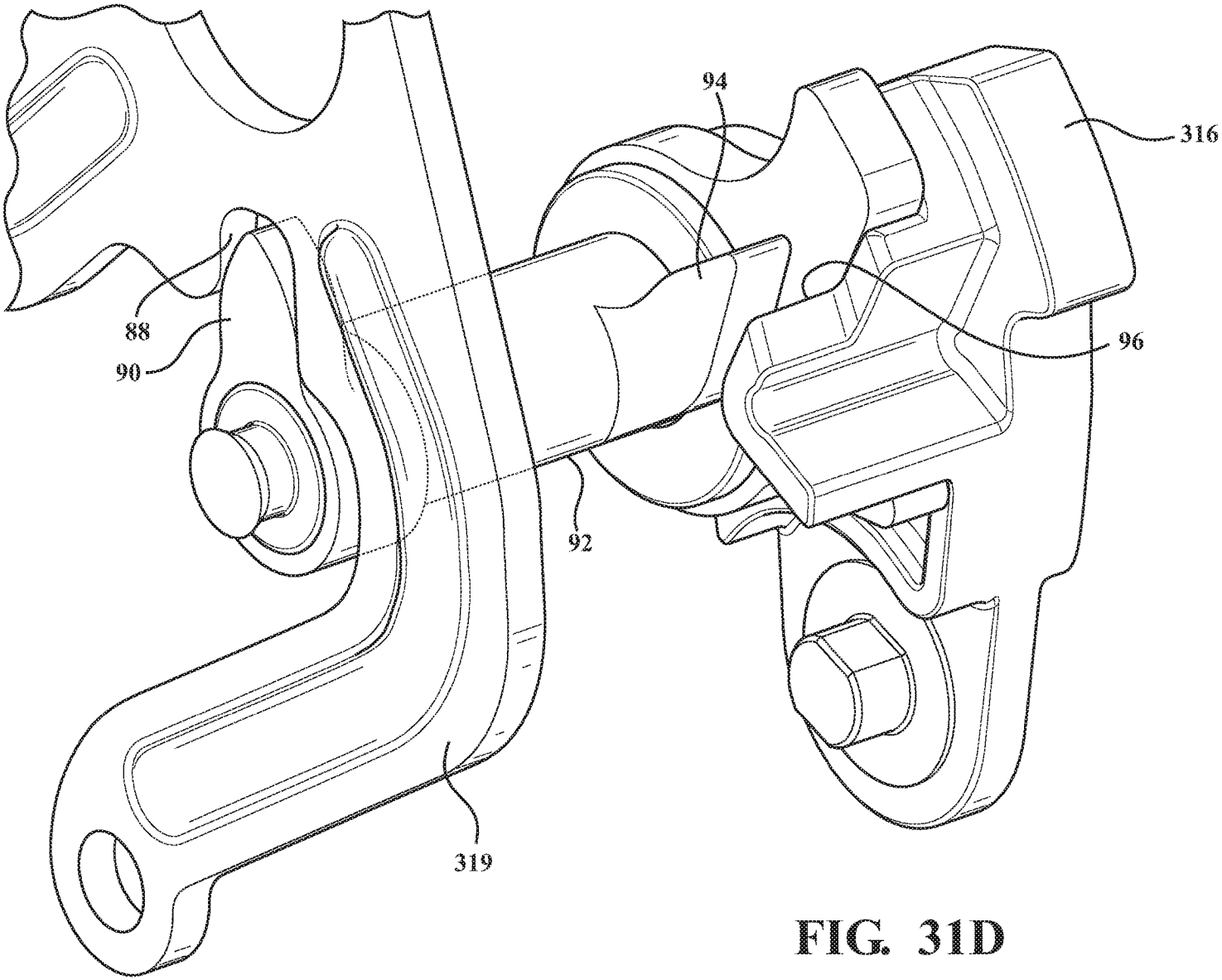
FIG. 31D is a perspective view illustrating a portion of the double pull latch assembly of FIG. 31C.

Now referring to FIGS. 31C to 31E, a latch 310 having an emergency or auxiliary release lever 319 in accordance with another aspect of the disclosure is illustrated, wherein the same reference numerals as used above for latch 210 are used, offset by a factor of 300, to identify like features. The auxiliary release lever 319 is generally operable as discussed above for release lever 219, and can be configured for selective actuation of the latch 310 from within a stowage compartment (e.g. trunk 17 or frunk 17) or from outside the vehicle 11, as discussed above. The auxiliary release lever 319 is mounted for pivoting movement about an axis, shown as the same axis as ratchet 312, by way of example and without limitation, between a released position and an actuated position, and is biased toward the released position, such as via a spring member, shown schematically at 360. Auxiliary release lever 319 has an elongate drive arm 362 extending into operable camming engagement with a driven member 329 of primary pawl 314. As discussed above for latch 110, auxiliary release lever 319 can be actuated from within trunk 17 via selective actuation of auxiliary release member 56, wherein upon the predetermined condition not being met and the latch 310 operating in a normal mode, the ratchet 312 of latch 310 can be moved from the primary closed position to the secondary closed position, wherein secondary pawl 316 remains locked with ratchet 312, and then from the secondary closed position to the open position in a double pull actuation process, and wherein upon the predetermined condition being met and the latch 310 operating in a safety mode, the ratchet 312 of latch 310 can be moved from the primary closed position to the secondary closed position, but not to the open position until the predetermined condition no longer exists. Auxiliary release lever 319 is further configured for direct and/or indirect operable driving engagement with secondary pawl 316. As such, a single actuation of auxiliary release lever 319 can cause primary pawl 314 to move from its primary locking position to its primary unlocking position and can cause secondary pawl 316 to move from its secondary locking position to its secondary unlocking position. Accordingly, selective actuation of auxiliary release lever 319 can cause latch 310 to be moved from the primary closed position to the open position via a single actuation of auxiliary release lever 319. In particular, auxiliary release lever 319 is shown having a drive feature 88, shown as a recess or notch, by way of example and without limitation, configured for receipt of a driven feature 90, shown as a protrusion or cog, by way of example and without limitation, of secondary pawl 316 therein. It is to be recognized that the drive feature 88 could be a protrusion or cog, while the driven feature 90 could be a recess or notch. The driven feature 90 projects radially outwardly from an axle or hub 92 in spaced relation from secondary pawl 316, wherein the hub 92 is shown as extending along an axis about which secondary pawl 316 rotates, thereby providing increased leverage of driven feature 90 to affect rotation for secondary pawl 316. A drive member 94 also extends radially outwardly from hub 92 for engagement with a cam surface 96 of secondary pawl 316. As such, as driven feature 92 is caused to rotate in response to select movement of auxiliary release lever 319, drive member 94 is caused to rotate conjointly with driven feature 90 and hub 92, thereby engaging cam surface 96 and causing movement of secondary pawl 316 from its secondary locking position to its secondary unlocking position (clockwise direction of rotation of secondary pawl 316 as viewed in FIG. 31E). Concurrently with movement of secondary pawl 316 from its secondary locking position to its secondary unlocking position, primary pawl 314 is moved from its primary locking position to its primary unlocking position via engagement of elongate drive arm 362 with driven member 329 of primary pawl 314, thereby resulting in a single pull actuation of latch 310.

Figure 32:
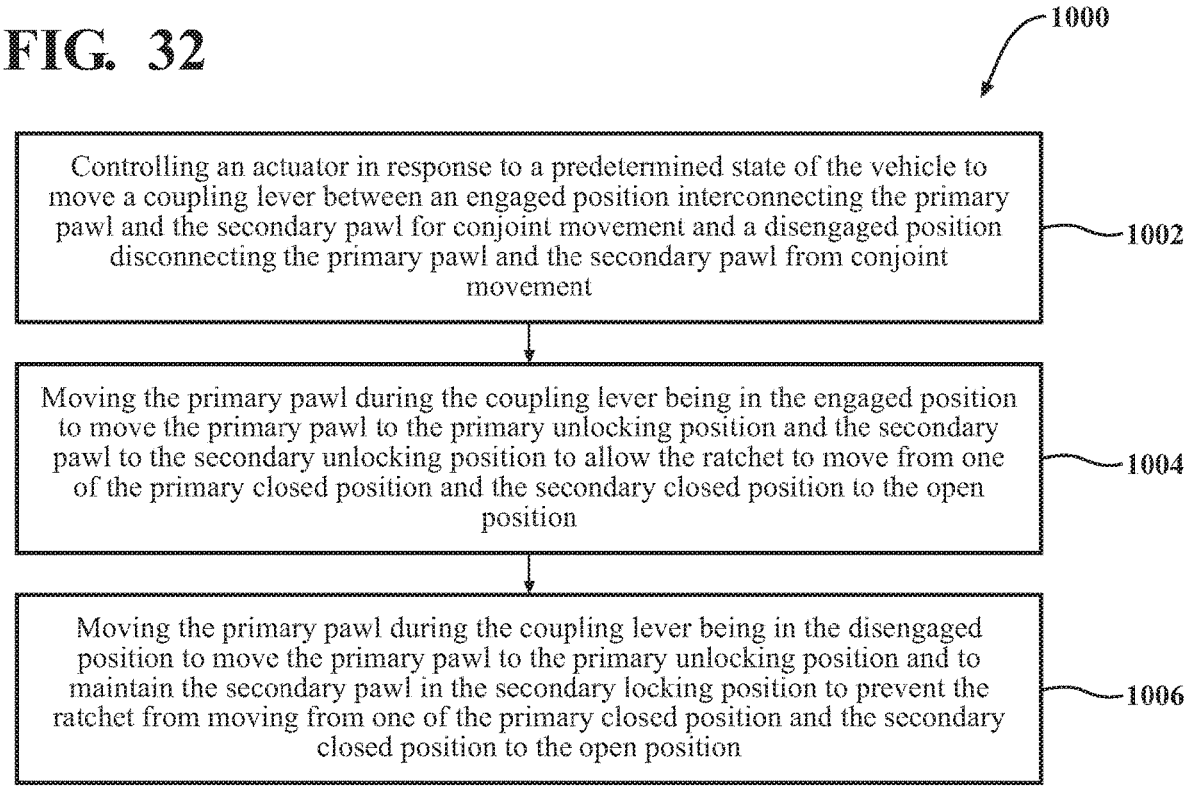
FIGS. 32 and 33 illustrate methods of releasing a latch assembly for a hood of a trunk of a vehicle, in accordance with illustrative embodiments.

Now referring to FIG. 32, there is illustrated a method 1000 of releasing a latch assembly for a hood of a trunk, such as a frunk, of a vehicle, the latch assembly including a ratchet movable between a primary closed position, a secondary closed position and an open position, a primary pawl moveable between a primary locking position to hold the ratchet in the primary closed position and a primary unlocking position to release the ratchet from the primary closed position, and a secondary pawl moveable between a secondary locking position to hold the ratchet in the secondary closed position and a secondary unlocking position to release the ratchet from the secondary closed position. The method 1000 illustratively includes the steps of controlling 1002 an actuator in response to a predetermined state of the vehicle to move a coupling lever between an engaged position interconnecting the primary pawl and the secondary pawl for conjoint movement and a disengaged position disconnecting the primary pawl and the secondary pawl from conjoint movement, moving 1004 the primary pawl during the coupling lever being in the engaged state to move the primary pawl to the primary unlocking position and the secondary pawl to the secondary unlocking position to allow the ratchet to move from one of the primary closed position and the secondary closed position to the open position, and moving 1006 the primary pawl during the coupling lever being in the disengaged state to move the primary pawl to the primary unlocking position and to maintain the secondary pawl in the secondary locking position to prevent the ratchet from moving from one of the primary closed position and the secondary closed position to the open position. The method 1000 may for example further include the step of moving an auxiliary release member within the trunk configured in operable communication with the primary pawl to pivot the primary pawl between the primary locking position and the primary unlocking position in response to selective actuation of the auxiliary release member.

Figure 33:
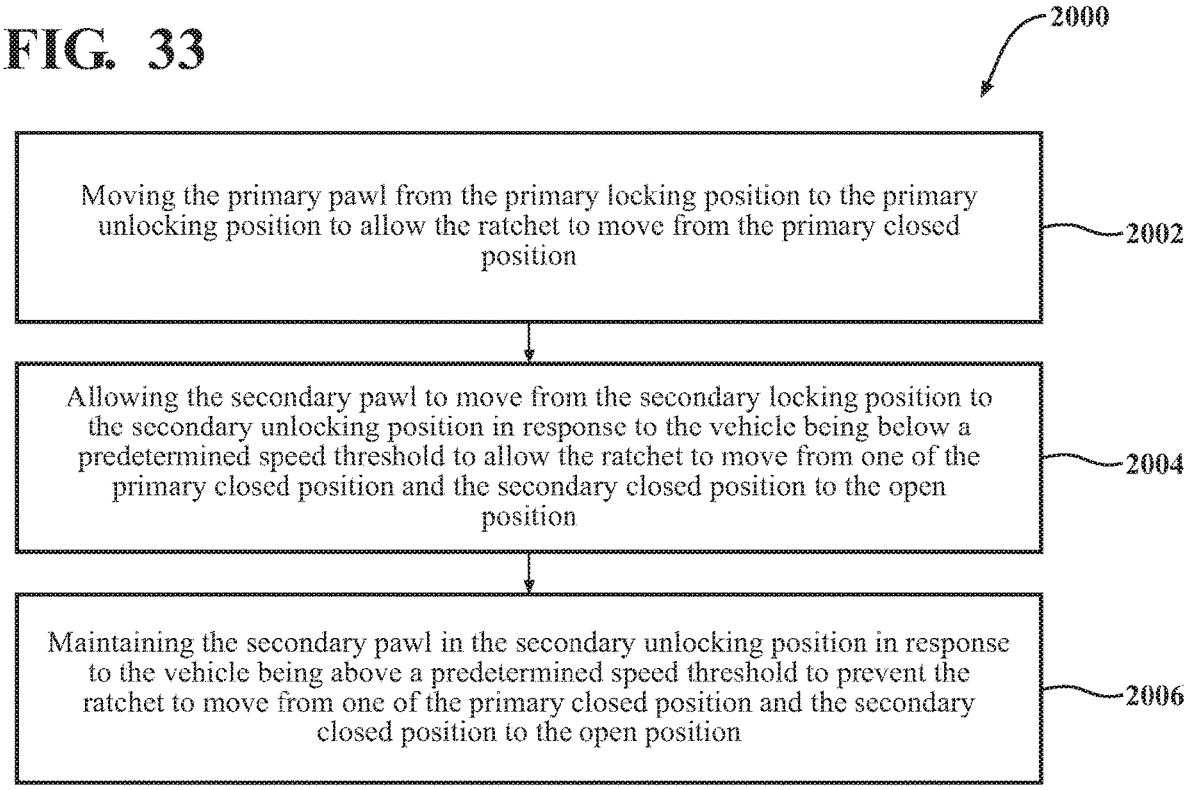

Now referring to FIG. 33, there is illustrated a method 2000 of releasing a latch assembly for a hood of a trunk, such as a frunk, of a vehicle, the latch assembly comprising a ratchet movable between a primary closed position, a secondary closed position and an open position, a primary pawl moveable between a primary locking position to hold the ratchet in the primary closed position and a primary unlocking position to release the ratchet from the primary closed position, and a secondary pawl moveable between a secondary locking position to hold the ratchet in the secondary closed position and a secondary unlocking position to release the ratchet from the secondary closed position. The method 2000 illustratively includes the steps of moving 2002 the primary pawl from the primary locking position to the primary unlocking position to allow the ratchet to move from the primary closed position to the secondary closed position, allowing 2004 the secondary pawl to move from the secondary locking position to the secondary unlocking position in response to the vehicle being below a predetermined speed threshold, or in response to a predetermined state no longer existing or not existing, to allow the ratchet to move from one of the primary closed position and the secondary closed position to the open position, and maintaining 2006 the secondary pawl in the secondary unlocking position in response to the vehicle being above a predetermined speed threshold, or in response to a predetermined state existing to prevent the ratchet to move from one of the primary closed position and the secondary closed position to the open position.

Figure 34:
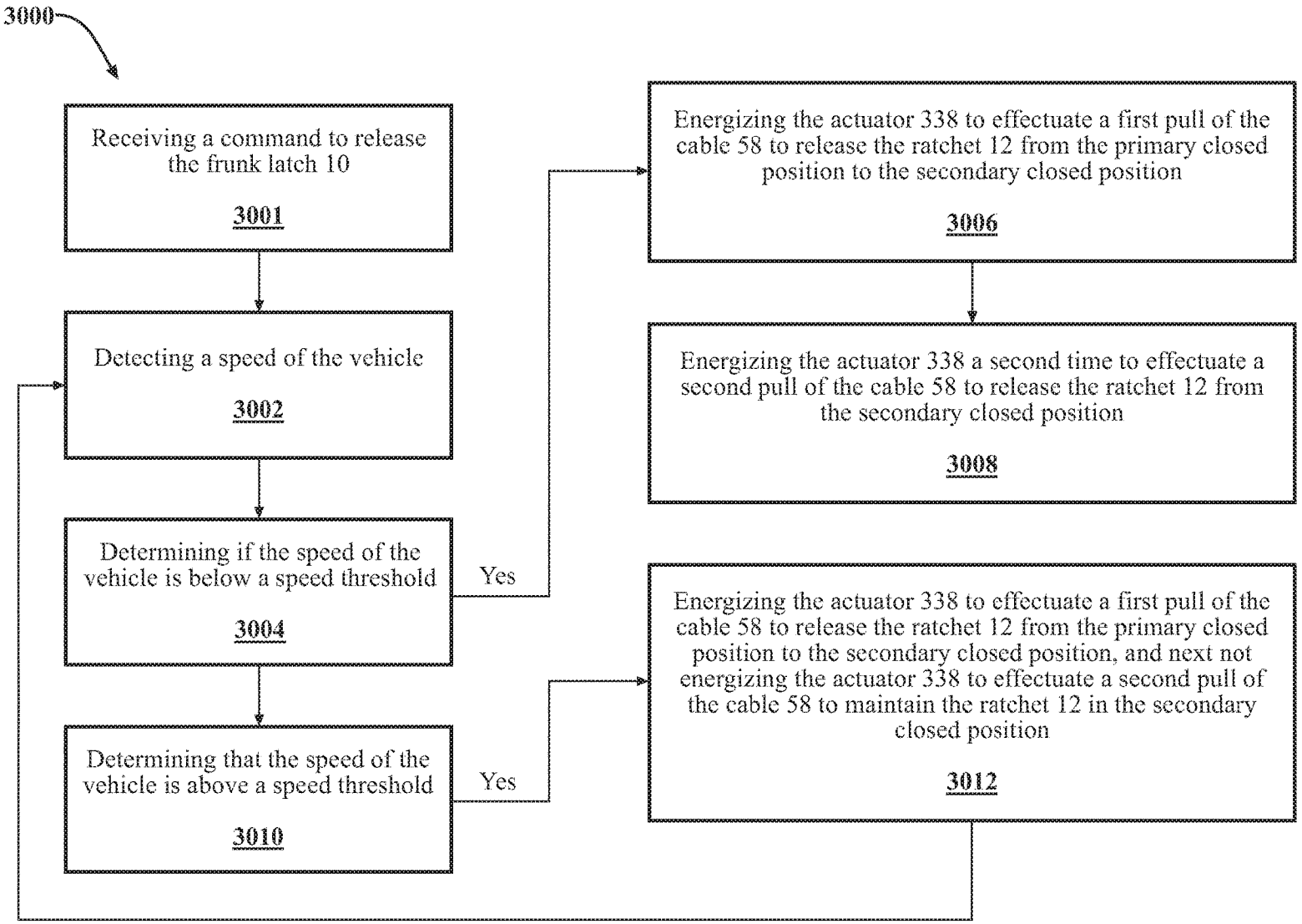
FIG. 34 is a method of operating a power release double pull latch, in accordance with an illustrative embodiment.

Now referring to FIG. 34, in another embodiment, coupling lever 18, 118 may be configured to be maintained in its home position, interconnected and coupled between primary pawl 14, 114, 214, 314 and secondary pawl 16, 116, 216, 316 and in lieu of selectively moving the coupling lever 18, 118 between its home position and disengaged position in a manner as described herein above for shifting the latch 10, 110, 210, 310 between its normal mode and safety mode of operation, release member 58, 113, 233, 333 may be connected to a power auxiliary release member 56 having a power actuation operation, for example driving cable 58, 113, 233, 333 using a motor 338 to control the position of the ratchet 12 in response to an activation of a switch, button, or other electrical signaling device provided within the trunk 17 or frunk 17 and accessible to an entrapped person there within. Accordingly, there is provided a method 3000 of controlling a power release actuator for actuating a double pull frunk (a front trunk) latch 10, for example for providing safety features related to entrapment within the frunk 17. For example a controller 117, having a computing unit and a memory coupled to the computing unit for storing instructions and/or executable code and/or software, and/or the like, of the methods and steps described herein as non-limiting examples to be executed by the computing unit, may be provided local or remote from latch 10, 110, 210, 310 and be configured to control a power actuator having a motor 338 to engergize and de-engergize in response to determining the predetermined state of the vehicle or detecting a state of the vehicle, such as the speed of the vehicle above or below the predetermined speed threshold, such as 5 km per hour, whether an engine of the vehicle is on or off, and whether a shift mechanism of the vehicle is in a park or a non-park position as examples. The method 3000 may include the steps, as executed by the controller 117 having the computing unit and the memory for storing instructions to be executed by the computing unit, receiving a command to release the frunk latch 10 at step 3001, for example from a signal received directly by controller 117 from the signally device such as a switch 171 for example provided in the interior of the frunk 17 accessible and activated by a user entrapped in the frunk 17, or indirectly from the BCM 115 in a configuration where BCM 115 may be in communication with switch 171 rather than controller 117 and configured to control motor 338, then detecting if a predetermined condition exists, for example detecting if a speed of the vehicle is above a threshold speed 3002, for example as determined by a Body Control Module 115 of the vehicle in communication with a vehicle speed sensor as an example. Controller 117 being in electrical communication with the Body Control Module 115 may be configured to receive such information from the BCM 115 or may be in direct communication with the vehicle speed sensor. Then determining if the predetermined condition does exist, for example determining if the speed of the vehicle is below a speed threshold 3004, such as 5 km per hour, then energizing the actuator 338 to effectuate a first pull of the cable 58, 113, 233, 333 to release the ratchet 12 from the primary closed position to allow the ratchet 12 to move to the secondary closed position 3006, in a manner as described herein above as the first pull of a double pull release operation, then energizing the actuator 338 a second time to effectuate a second pull of the cable 58, 113, 233, 333 to release the ratchet 12 from the secondary closed position 3008. After each actuated pull of cable 58, 113, 233, 333, the motor 338 may be controlled, or reset, to return the cable 58 to a non-actuated state. If it is determined that the predetermined condition exists, for example the speed of the vehicle is above a speed threshold 3010, such as 5 km per hour, then the controller 117 proceeds with energizing the actuator 338 to effectuate a first pull of the cable 58, 113, 233, 333 to release the ratchet 12 from the primary closed position to the secondary closed position 3008, and next not energizing the actuator 338 to effectuate a second pull of the cable 58 to maintain the ratchet 12 in the secondary closed position 3012. Illustratively, such a method 3000 of controlling a power release actuator for actuating a latch for a trunk 17, such as a frunk 17, is made with reference to the double pull frunk (a front trunk) latch 10 described herein, but may also apply for a power release control operation of other double pull type latches which may be employed for a frunk 17 and which may be controlled electronically, for example by controller 117, to shift the double pull latch between a normal mode of operation and a safety mode of operation based on the number of actuations of a cable or release member driven by actuator operably connected to a pawl of the latch, such as the one described in commonly owned Patent Application Pub. No. US2014/0361554 entitled "Double pull latch for closure panel such as hood", published Dec. 11, 2014, the entire contents of which is incorporated herein by reference, and may also apply generally to double pull latches having a pawl mechanism operable in a primary locking state, a secondary locking state and an unlocking state, where the pawl assembly is configured in the primary locking state to hold the ratchet in the primary closed position and in the secondary locking state to hold the ratchet in a secondary closed position, and in the unlocking state to release the ratchet from at least one of the primary closed position and secondary closed position. Controller 117 may therefore control actuator 338 only when the predetermined condition is met and when a trigger signal from the signally device, such as switch 171 is detected, and therefore the transition between a normal mode and a safety mode does not only occur when the predetermined condition is met, but also in addition to when a trigger signal from the signally device is detected. Actuator 338 is therefore able to be operated less frequently and only in entrapment situations.

The foregoing description of the embodiments has been provided for purposes of illustration and description. It is not intended to be exhaustive or to limit the disclosure. Individual elements, assemblies/subassemblies, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A latch assembly for a hood of a trunk of a vehicle, comprising:

a housing;

a ratchet mounted in said housing for pivoting movement between a primary closed position, a secondary closed position, and an open position, wherein said ratchet is biased toward the open position;

a pawl assembly mounted in said housing and operable in a primary locking state, a secondary locking state, and an unlocking state, the pawl assembly configured in the primary locking state to hold the ratchet in the primary closed position, configured in the secondary locking state to hold the ratchet in the secondary closed position, and configured in the unlocking state to release the ratchet from at least one of the primary closed position and secondary closed position, the pawl assembly further operable in a normal mode for allowing the pawl assembly to shift from one of the primary locking state and the secondary locking state to the unlocking state and in a safety mode for preventing the pawl assembly to shift from the secondary locking state to the unlocking state; and a release mechanism configured to be accessible within the trunk for actuating the pawl assembly, wherein actuation of the release mechanism when the pawl assembly is operable in the normal mode and in the primary locking state, shifts the pawl mechanism to one of the secondary locking state and the unlocking state, wherein actuation of the release mechanism when the pawl assembly is operable in the safety mode and in the primary locking state, shifts the pawl assembly to the secondary locking state.

2. The latch assembly of claim 1, wherein the trunk is provided at a front of the vehicle.

3. The latch assembly of claim 1, wherein the pawl assembly comprises:

a primary pawl configured for operable communication with a release member and being mounted in said housing for pivoting movement between a primary locking position and a primary unlocking position in response to movement of the release member, said primary pawl being biased toward the primary locking position;

a secondary pawl mounted in said housing for pivoting movement between a secondary locking position and a secondary unlocking position, said secondary pawl being biased toward the secondary locking position;

a coupling lever for interconnecting the primary pawl and the secondary pawl, said coupling lever being moveable between an engaged position, when the pawl assembly is operable in the normal mode, and a disengaged position, when the pawl assembly is operable in the safety mode, and being biased toward the engaged position; and the latch assembly comprises:

an auxiliary release member configured to be accessible within the trunk and configured in operable communication with the primary pawl to pivot the primary pawl between the primary locking position and the primary unlocking position in response to a first actuation of the auxiliary release member, wherein with said coupling lever in the disengaged position and said ratchet in the primary closed position, actuation of said auxiliary release member causes said primary pawl to pivot from the primary locking position to the primary unlocking position and said secondary pawl to move into said secondary locking position to hold said ratchet in said secondary closed position, and wherein said secondary pawl is prevented from pivoting from the secondary locking position to the secondary unlocking position.

4. The latch assembly of claim 3, wherein with said coupling lever in the engaged position and said ratchet in the primary closed position, actuation of said auxiliary release member causes said primary pawl to pivot from the primary locking position to the primary unlocking position and said secondary pawl to move into said secondary unlocking position, resulting in said ratchet pivoting from the primary closed position to the open position.

5. The latch assembly of claim 4, further including an actuator operably coupled to said coupling lever, said actuator being configured for communication with a vehicle sensor to selectively move said coupling lever between the engaged position and the disengaged position in response to a predetermined condition of the vehicle, with said coupling lever remaining in the disengaged position until the predetermined condition is absent.

6. The latch assembly of claim 5, wherein said coupling lever is biased into the engaged position when the ratchet is in the primary closed position and when the predetermined condition is absent.

7. The latch assembly of claim 5, wherein the predetermined condition includes at least one of a speed of the vehicle, whether an engine of the vehicle is on or off, and whether a shift mechanism of the vehicle is in a park or a non-park position.

8. The latch assembly of claim 3, wherein movement of said primary pawl from the primary locking position to the primary unlocking position in response to the first actuation of the auxiliary release member causes said ratchet to move from the primary closed position to the secondary closed position, whereupon said coupling lever is automatically biased from the disengaged position to the engaged position, and wherein upon biased return of said primary pawl toward the primary locking position and repeated movement of said primary pawl to the primary unlocking position in response to a second actuation of the auxiliary release member, said primary pawl engages and moves said coupling lever thereby causing said secondary pawl to pivot from the secondary locking position to the secondary unlocking position, whereupon said ratchet moves from the secondary closed position to the open position.

9. The latch assembly of claim 3, wherein with said coupling lever has a home position between the engaged position and the disengaged position, wherein movement of said primary pawl from the primary locking position to the primary unlocking position in response to the first actuation of the auxiliary release member causes said ratchet to move from the primary closed position to the secondary closed position, whereupon said coupling lever is automatically biased from the home position to the engaged position, and wherein upon biased return of said primary pawl toward the primary locking position and repeated movement of said primary pawl to the primary unlocking position in response to a second actuation of the auxiliary release member, said primary pawl engages and moves said coupling lever thereby causing said secondary pawl to pivot from the secondary locking position to the secondary unlocking position, whereupon said ratchet moves from the secondary closed position to the open position.

10. The latch assembly of claim 9, wherein said coupling lever is held in the home position against a bias via abutment with said ratchet when said ratchet is in the primary closed position.

11. The latch assembly of claim 10, wherein said ratchet moves out of abutment with said coupling lever when said ratchet moves from the primary closed position to the secondary closed position, whereupon said coupling lever is biased into the engaged position into abutment with said primary pawl.

12. The latch assembly of claim 3, further including an auxiliary release lever configured for attachment to the auxiliary release member within the trunk and being mounted to the latch assembly for pivoting movement between a released position and an actuated position in response to selective actuation of the auxiliary release member, said auxiliary release lever being configured for operable engagement with said primary pawl to effect movement of said primary pawl between the primary locking position and the primary unlocking position.

13. The latch assembly of claim 11, further including an actuator operably coupled to said coupling lever, said actuator being configured for communication with a vehicle sensor to selectively move said coupling lever between the engaged position and the disengaged position in response to a predetermined condition of the vehicle, with said coupling lever remaining in the disengaged position until the predetermined condition is absent.

14. A method of releasing a latch assembly for a hood of a trunk of a vehicle, the latch assembly comprising a ratchet movable between a primary closed position, a secondary closed position, and an open position, a primary pawl moveable between a primary locking position to hold the ratchet in the primary closed position and a primary unlocking position to release the ratchet from the primary closed position, and a secondary pawl moveable between a secondary locking position to hold the ratchet in the secondary closed position and a secondary unlocking position to release the ratchet from the secondary closed position, the method comprising the steps of:

moving the primary pawl from the primary locking position to the primary unlocking position to allow the ratchet to move from the primary closed position;

maintaining the secondary pawl in the secondary locking position in response to a predetermined condition of the vehicle;

and allowing the secondary pawl to move from the secondary locking position to the secondary unlocking position in response to the predetermined condition being absent;

wherein the predetermined condition is at least one of a speed of the vehicle, whether an engine of the vehicle is on or off, and whether a shift mechanism of the vehicle is in a park or a non-park position.

15. The method of claim 14, further including maintaining the secondary pawl in the secondary locking position in response to the speed of the vehicle being above a predetermined speed threshold to prevent the ratchet from moving to the open position.

16. The method of claim 14, wherein the primary pawl and the secondary pawl are interconnected with a coupling lever, and wherein the method further comprises the step of moving the coupling lever between an engaged position and a disengaged position, with the coupling lever being biased toward the engaged position, wherein with said coupling lever in the disengaged position the secondary pawl is maintained in the secondary locking position.

17. The method of claim 16, wherein the method further comprises the step of moving the primary pawl from the primary locking position to the primary unlocking position, when the coupling lever is in the engaged position and the ratchet is in the primary closed position, and thereby causing the secondary pawl to move from the secondary locking position to the secondary unlocking position.

18. The method of claim 17, further including causing the primary pawl to move from the primary locking position to the primary unlocking position and the secondary pawl to move from the secondary locking position to the secondary unlocking position in a single actuation.

19. The method of claim 17, wherein an actuator is coupled to the coupling lever, and the method further comprising the step of controlling the actuator to move the coupling lever between the engaged position and the disengaged position in response to the predetermined condition.

20. The method of claim 14, wherein the primary pawl is operably connected to an auxiliary release member within the trunk, and the method further comprising the step of pivoting the primary pawl between the primary locking position and the primary unlocking position in response to selective actuation of the auxiliary release member.

* * * * *